US012376644B2

(12) United States Patent
Constantinou et al.

(10) Patent No.: US 12,376,644 B2
(45) **Date of Patent: *Aug. 5, 2025**

(54) LAYERED MATERIALS, METHODS OF MAKING, METHODS OF USE, AND ARTICLES INCORPORATION THE LAYERED MATERIALS

(71) Applicant: NIKE, Inc., Beaverton, OR (US)

(72) Inventors: Jay Constantinou, Beaverton, OR (US); Caleb W. Dyer, Beaverton, OR (US); Jeremy D. Walker, Portland, OR (US); Zachary C. Wright, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 51 days.

This patent is subject to a terminal disclaimer.

(21) Appl. No.: 18/464,778

(22) Filed: Sep. 11, 2023

(65) Prior Publication Data

US 2023/0413944 A1 Dec. 28, 2023

Related U.S. Application Data

(63) Continuation of application No. 17/455,087, filed on Nov. 16, 2021, now Pat. No. 11,786,007, which is a (Continued)

(51) Int. Cl.
*A43B 13/12* (2006.01)
*A43B 5/02* (2006.01)

(Continued)

(52) U.S. Cl.
CPC ..... *A43B 13/122* (2013.01); *A43B 5/02* (2013.01); *A43B 13/04* (2013.01); *A43B 13/26* (2013.01);

(Continued)

(58) Field of Classification Search
CPC ..... A43B 5/02; A43B 13/04; A43B 13/122; A43B 13/26; A43C 15/02; A43C 15/16; A43C 15/168; Y10T 428/24802
See application file for complete search history.

(56) References Cited

U.S. PATENT DOCUMENTS 5,866,058 A 2/1999 Batchelder et al.
5,969,076 A 10/1999 Lai et al.

(Continued)

FOREIGN PATENT DOCUMENTS

EP 2462908 A1 6/2012

OTHER PUBLICATIONS

International Search Report for PCT/US2019/028255 mailed on Jul. 30, 2019.

(Continued)

*Primary Examiner* — Gerard Higgins
(74) *Attorney, Agent, or Firm* — SHOOK, HARDY & BACON L.L.P.

(57) ABSTRACT

The present disclosure, in general, provides for a layered material that can be incorporated in to textiles (e.g., footwear, apparel, sporting equipment, or components of each). In an aspect, the layered material includes an externally facing layer and a thermoplastic hot melt adhesive layer and optionally one or more inner layers between the externally facing layer and the thermoplastic hot melt adhesive layer. The present disclosure provides for articles including the layered material such as footwear, apparel, sporting equipment, a component of an article of sporting equipment, apparel or footwear, including a outsole structure for footwear.

19 Claims, 5 Drawing Sheets

Related U.S. Application Data continuation of application No. 16/389,101, filed on Apr. 19, 2019, now Pat. No. 11,213,091.

(60) Provisional application No. 62/666,248, filed on May 3, 2018.

(51) Int. Cl.

| | |
|---|---|
| ***A43B 13/04*** | (2006.01) |
| ***A43B 13/26*** | (2006.01) |
| ***A43C 15/16*** | (2006.01) |
| *A43C 15/02* | (2006.01) |

(52) U.S. Cl.

CPC ..... *A43C 15/16* (2013.01); *A43C 15/168* (2013.01); *A43C 15/02* (2013.01); *Y10T 428/24802* (2015.01)

(56) References Cited

U.S. PATENT DOCUMENTS

| | | | | |
|---|---|---|---|---|
| 11,213,091 | B2 * | 1/2022 | Constantinou ..... | A43C 15/168 |
| 2003/0157288 | A1 | 8/2003 | Bouchette et al. | |
| 2005/0008669 | A1 | 1/2005 | Chen | |
| 2009/0234039 | A1 | 9/2009 | Schuette et al. | |
| 2017/0238653 | A1 | 8/2017 | Baghdadi et al. | |
| 2017/0251751 | A1 | 9/2017 | Baghdadi et al. | |
| 2018/0194974 | A1 * | 7/2018 | Ko ..... | C09J 7/00 |

OTHER PUBLICATIONS

Written Opinion of the International Preliminary Examining Authority for PCT/US2019/028255 mailed on Apr. 24, 2020.

International Preliminary Report on Patentability for PCT/US2019/028255 mailed on Jul. 10, 2020.

* cited by examiner

LAYERED MATERIALS, METHODS OF MAKING, METHODS OF USE, AND ARTICLES INCORPORATION THE LAYERED MATERIALS

CROSS-REFERENCE TO RELATED APPLICATIONS

This application is a continuation of U.S. patent application entitled "LAYERED MATERIALS, METHODS OF MAKING, METHODS OF USE, AND ARTICLES INCORPORATION THE LAYERED MATERIALS", having application Ser. No. 17/455,087, filed Nov. 16, 2021, which is a continuation of U.S. patent application entitled "LAYERED MATERIALS, METHODS OF MAKING, METHODS OF USE, AND ARTICLES INCORPORATION THE LAYERED MATERIALS", having application Ser. No. 16/389,101, filed Apr. 19, 2019, now issued as U.S. Pat. No. 11,213,091, which application claims the benefit of and priority to U.S. provisional application entitled "LAYERED MATERIALS, METHODS OF MAKING, METHODS OF USE, AND ARTICLES INCORPORATION THE LAYERED MATERIALS", having Application Ser. No. 62/666,248 filed May 3, 2018, the contents of which are each incorporated by reference in their entirety.

BACKGROUND

Articles of apparel and sporting equipment of various types are frequently used for a variety of activities including outdoor, military use, and/or competitive sports. During the use of these articles, the externally facing surfaces of the articles may frequently make contact with the ground and/or be exposed to soil. Thus, ground or soil may accumulate on the externally facing surfaces. This ground or soil often includes inorganic materials, such as mud, dirt, and gravel; organic materials, such as grass, turf, and excrement; or combinations thereof.

DESCRIPTION

Figure 1C:
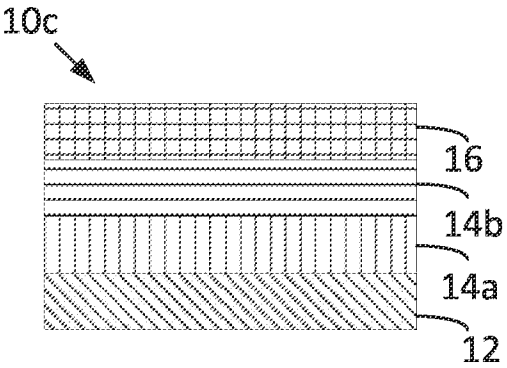
FIGS. 1A-1D illustrate cross-sectional view of layered materials of the present disclosure.

The present disclosure, in general, provides for a layered material that can be incorporated in to textiles (e.g., footwear, apparel, sporting equipment, or components of each). Specifically, the layered material can be included in footwear having traction elements such as cleats, where the layered material can be positioned among the traction elements and/or between the toe region and heel region of the outsole component (e.g., midfoot region). The layered material includes an externally facing layer and a second layer (e.g., a thermoplastic hot melt adhesive layer) and optionally one or more inner layers between the externally facing layer and the second layer. The externally facing layer can absorb fluid (e.g., water) and when sufficiently wet can provide compressive compliance and/or expulsion of uptaken water and/or an externally facing surface having a high concentration of water. In particular, it is believed that the compressive compliance of the wet layered material, the expulsion of water from the wet layered material, the presence of a water layer on the externally facing layer, or any combination of these mechanisms, can disrupt the adhesion of soil on or at the outsole component, or the cohesion of the particles to each other, or can disrupt both the adhesion and cohesion. This disruption in the adhesion and/or cohesion of soil is believed to be a responsible mechanism for preventing (or otherwise reducing) the soil from accumulating on the footwear outsole component (due to the presence of the wet material). As can be appreciated, preventing soil from accumulating on the bottom of footwear can improve the performance of traction elements present on the outsole component during wear on unpaved surfaces, can prevent the footwear from gaining weight due to accumulated soil during wear, can preserve ball handling performance of the footwear, and thus can provide significant benefits to wearer as compared to an article of footwear without the material present on the outsole component. The thermoplastic hot melt adhesive layer allows the attachment of the layered material, including the hydrogel layer, to be secured to the article (e.g., footwear).

As stated above, the layered material can include one or more inner layers such as a tie layer, an elastomeric layer, or a regrind layer. In some examples, inclusion of a tie layer can improve the adhesion of the hydrogel layer to the thermoplastic hot melt adhesive layer. In other examples, inclusion of an elastomeric layer can improve the ability to conform the layered material to a curved surface. In other examples, inclusion of a regrind layer in the layered material can provide a core layer which is less costly and reduces waste in the manufacturing process. Including reground hydrogel material in the regrind layer may also provide additional water uptake capacity while acting as a tie layer.

The hydrogel material can include a polyurethane hydrogel. The thermoplastic hot melt adhesive material can include one or more thermoplastic polymers such as polyesters, polyethers, polyamides, polyurethanes and polyolefins, any copolymers thereof, and combinations thereof. The elastomeric layer can comprise an elastomer material such as a thermoplastic polymer. The tie material can comprise a thermoplastic polymer. The thermoplastic polymer can be polyesters, polyethers, polyamides, polyurethanes, polyolefins, any copolymers thereof, and any combinations thereof. The regrind layer can comprise a regrind material, which may be scrap material such as from unused hydrogel material, thermoplastic hot melt adhesive material, elastomeric material, and/or tie material, or from other areas in the manufacturing of the article or from other sources, and optionally also including none scrap material.

The present disclosure provides for an article of footwear, comprising: an outsole component on a side of the article of footwear, wherein the side is configured to be ground facing, wherein the outsole component comprises a layered material having an externally facing layer and a second layer opposite the externally facing layer, wherein the externally facing layer includes at least a portion of an outer surface of the article of footwear, wherein the externally facing layer comprises a hydrogel material and the second layer comprises a thermoplastic hot melt adhesive material, and wherein the article of footwear comprises one or more of the traction elements on the side of the article of footwear configured to be ground facing.

The present disclosure provides for a method of making an article of footwear, comprising: affixing an outsole component and a layered material to one another, thereby forming the article, wherein the layered material comprises an externally facing layer and a second layer opposite the externally facing layer, wherein the externally facing layer comprises a hydrogel material and the second layer comprises a thermoplastic hot melt adhesive material, wherein the article of footwear comprises one or more of the traction elements on the side of the article of footwear configured to be ground facing.

The present disclosure provides for a layered material, comprising: an externally facing layer of a first material comprising a hydrogel material, and a second material comprising a thermoplastic hot melt adhesive. In addition, a structure can include the layered material as described herein.

The present disclosure provides for a method of making an article, comprising: affixing a first component and the layered material as described herein to one another, thereby forming the article. In aspects, the article comprises a product of the method described above.

The present disclosure provides for a process for manufacturing an article comprising: placing a first element on a molding surface; placing the thermoplastic hot melt adhesive layer as described herein in contact with at least a portion of the first element on the molding surface; while the thermoplastic hot melt adhesive layer is in contact with the component on the molding surface, increasing a temperature of the thermoplastic hot melt adhesive layer to a temperature that is at or above an activation temperature of the thermoplastic hot melt adhesive; and subsequent to the increasing the temperature of the thermoplastic hot melt adhesive, while the thermoplastic hot melt adhesive layer remains in contact with the component on the molding surface, decreasing the temperature of the thermoplastic hot melt adhesive to a temperature below the melting temperature $T_m$ of the thermoplastic hot melt adhesive; and thereby bonding the layered material to the component forming a bonded component. The structure can comprise an article formed by the process described above.

The present disclosure provides for a component comprising: a layered material as described herein includes the externally facing layer of the first material comprising the hydrogel material and the second material comprising the thermoplastic hot melt adhesive, the layered material having an external perimeter, wherein the externally facing layer of the layered material is present on at least a portion of a side of the component; and a second polymeric material is affixed to the thermoplastic hot melt adhesive layer and to the external perimeter of the layered material.

The present disclosure provides for a method of manufacturing a component comprising: placing a layered material as described herein including an external perimeter, the externally facing layer comprising the hydrogel material, and the second material comprising the thermoplastic hot melt adhesive into a mold so that a portion of the externally facing layer contacts a portion of the molding surface; restraining the portion of the externally facing layer against the portion of the molding surface while flowing a second polymeric material into the mold; solidifying the second polymeric material in the mold thereby bonding the second polymeric material to the thermoplastic hot melt adhesive layer and the external perimeter of the layered material, producing the component with the portion of the externally facing layer of the layered material forming an outermost layer of the component; and removing the component from the mold.

This disclosure is not limited to particular aspects described, and as such may, of course, vary. The terminology used herein serves the purpose of describing particular aspects only, and is not intended to be limiting, since the scope of the present disclosure will be limited only by the appended claims.

Where a range of values is provided, each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

As will be apparent to those of skill in the art upon reading this disclosure, each of the individual aspects described and illustrated herein has discrete components and features which may be readily separated from or combined with the features of any of the other several aspects without departing from the scope or spirit of the present disclosure. Any recited method may be carried out in the order of events recited or in any other order that is logically possible.

The present disclosure can employ, unless otherwise indicated, techniques of material science, chemistry, textiles, polymer chemistry, textile chemistry, and the like, which are within the skill of the art. Such techniques are explained fully in the literature.

Unless otherwise indicated, any of the functional groups or chemical compounds described herein can be substituted or unsubstituted. A "substituted" group or chemical compound, such as an alkyl, alkenyl, alkynyl, cycloalkyl, cycloalkenyl, aryl, heteroaryl, alkoxyl, ester, ether, or carboxylic ester refers to an alkyl, alkenyl, alkynyl, cycloalkyl, cycloalkenyl, aryl, heteroaryl, alkoxyl, ester, ether, or carboxylic ester group, has at least one hydrogen radical that is substituted with a non-hydrogen radical (i.e., a substituent). Examples of non-hydrogen radicals (or substituents) include, but are not limited to, alkyl, cycloalkyl, alkenyl, cycloalkenyl, alkynyl, ether, aryl, heteroaryl, heterocycloalkyl, hydroxyl, oxy (or oxo), alkoxyl, ester, thioester, acyl, carboxyl, cyano, nitro, amino, amido, sulfur, and halo. When a substituted alkyl group includes more than one non-hydrogen radical, the substituents can be bound to the same carbon or two or more different carbon atoms.

Unless otherwise defined, all technical and scientific terms used herein have the same meaning as commonly understood by one of ordinary skill in the art of microbiology, molecular biology, medicinal chemistry, and/or organic chemistry. Although methods and materials similar or equivalent to those described herein can be used in the practice or testing of the present disclosure, suitable methods and materials are described herein.

As used in the specification and the appended claims, the singular forms "a," "an," and "the" may include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

As used herein, the term "weight" refers to a mass value, such as having the units of grams, kilograms, and the like. Further, the recitations of numerical ranges by endpoints include the endpoints and all numbers within that numerical range. For example, a concentration ranging from 40 percent by weight to 60 percent by weight includes concentrations of 40 percent by weight, 60 percent by weight, and all water uptake capacities between 40 percent by weight and 60 percent by weight (e.g., 40.1 percent, 41 percent, 45 percent, 50 percent, 52.5 percent, 55 percent, 59 percent, etc.).

As used herein, the term "providing", such as for "providing a layered material", when recited in the claims, is not intended to require any particular delivery or receipt of the provided item. Rather, the term "providing" is merely used to recite items that will be referred to in subsequent elements of the claim(s), for purposes of clarity and ease of readability.

As used herein, the terms "at least one" and "one or more of" an element are used interchangeably, and have the same meaning that includes a single element and a plurality of the elements, and may also be represented by the suffix "(s)" at the end of the element. For example, "at least one polyurethane", "one or more polyurethanes", and "polyurethane(s)" may be used interchangeably and have the same meaning.

Now having described the present disclosure in general, additional details are provided. The present disclosure includes the layered material that can be incorporated into textiles such as footwear or components thereof, apparel or components thereof, sporting equipment or components thereof. Specifically, the layered material can be included in an article of footwear having traction elements disposed on the outsole component. The layered material can be disposed between or among the traction elements and/or along the vertical surface of the shaft of the traction element. The layered material is not on the surface the traction where such a position might cause article of footwear to slip or slide during use. The layered material can alternatively be positioned between the traction elements located on the toe region (e.g., top plate) and the heel region (e.g., heel plate) of the outsole component. In other words, the layer material can be positioned in the midfoot region of the outsole component between the toe region and the heel region of the outsole component.

The layered material includes an externally facing layer and second layer including a thermoplastic hot melt adhesive layer and optionally one or more inner layers between the externally facing layer and the thermoplastic hot melt adhesive layer. Each of the externally facing layer, the second layer, and, when present, the inner layer (individually) can independently have a thickness of about 0.1 millimeters to 10 millimeters, about 0.1 millimeters to 5 millimeters, about 0.1 millimeters to 2 millimeters, about 0.25 millimeters to 2 millimeters, or about 0.5 millimeters to 1 millimeter, where the width and length can vary depending upon the particular application (e.g., article to be incorporated into).

The hydrogel material can comprise a polyurethane hydrogel. The hydrogel material can comprise a polyamide hydrogel, a polyurea hydrogel, a polyester hydrogel, a polycarbonate hydrogel, a polyetheramide hydrogel, a hydrogel formed of addition polymers of ethylenically unsaturated monomers, copolymers thereof (e.g., co-polyesters, co-polyethers, co-polyamides, co-polyurethanes, co-polyolefins), and combinations thereof. Additional details are provided herein.

The second layer (e.g., thermoplastic hot melt adhesive layer) material can comprise one or more thermoplastic polymers such as polyesters, polyethers, polyamides, polyurethanes and polyolefins, copolymers thereof (e.g., co-polyesters, co-polyethers, co-polyamides, co-polyurethanes, co-polyolefins), and combinations thereof. In an aspect, the thermoplastic hot melt adhesive material can comprise a low processing temperature polymeric composition. Additional details are provided herein.

The optional inner layer can be one or more types of layers such as a tie layer, an elastomeric layer, or a regrind layer. The layered material can include one type of inner layer, two types of inner layers, or three types of inner layers. Any one of the types of inner layers can be adjacent (e.g., in contact with) the externally facing layer. Also, any one of the types of inner layers can be adjacent the thermoplastic hot melt adhesive layer. Any one of the types of inner layers can be adjacent one another.

The elastomeric layer can comprise an elastomer material such as a thermoplastic polymer. The thermoplastic polymer can comprise one or more polyesters, polyethers, polyamides, polyurethanes, polyolefins, including any copolymers thereof (e.g., co-polyesters, co-polyethers, co-polyamides, co-polyurethanes, co-polyolefins) and any combination thereof. Additional details are provided herein.

The tie material can comprise a thermoplastic polymer. The thermoplastic polymer can comprise one or more polyesters, polyethers, polyamides, polyurethanes, polyolefins, any copolymers thereof (e.g., co-polyesters, co-polyethers, co-polyamides, co-polyurethanes, co-polyolefins), and any combination thereof. Additional details are provided herein.

The regrind layer can comprise a regrind material, which may be scrap material from other areas in the manufacturing of the article or from other sources. The regrind material can comprise two or more of the following: the hydrogel material, the thermoplastic hot melt adhesive material, the elastomer material, and the tie material. Additional details are provided herein.

Figure 1B:
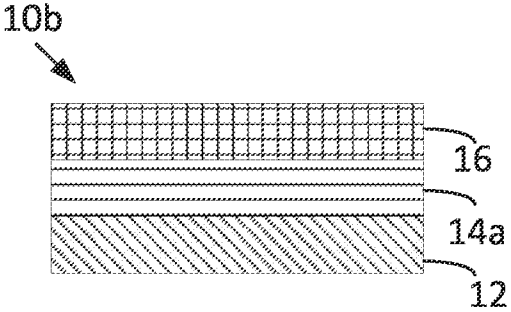
Figure 1A:
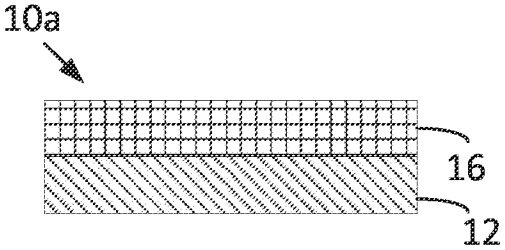

FIGS. 1A to 1D illustrate cross sectional views of layered materials 10*a*, 10*b*, 10*c*, and 10*d*. FIG. 1A illustrates layered material 10*a* having an externally facing layer 12 and a second layer (e.g., the thermoplastic hot melt adhesive layer, and referred to hereafter in FIGS. 1A-1D as the thermoplastic hot melt adhesive layer) 16 adjacent one another. FIG. 1B illustrates layered material 10*b* having the externally facing layer 12 and the thermoplastic hot melt adhesive layer 16 with an inner layer 14*a* disposed there between. The inner layer 14*a* can be any one of the tie layer, the elastomeric layer, or the regrind layer.

FIG. 1C illustrates layered material 10*c* having the externally facing layer 12 and the thermoplastic hot melt adhesive layer 16 with two inner layers 14*a* and 14*b* there between. Inner layers 14*a* and 14*b* can each be one of the tie layer, the elastomeric layer, or the regrind layer, while any of the types of inner layers can be adjacent the externally facing layer 12 or the thermoplastic hot melt adhesive layer 16. Alternatively, each of 14*a* and 14*b* can be two different types of tie layers (or elastomeric layers or regrind layers).

Figure 1D:
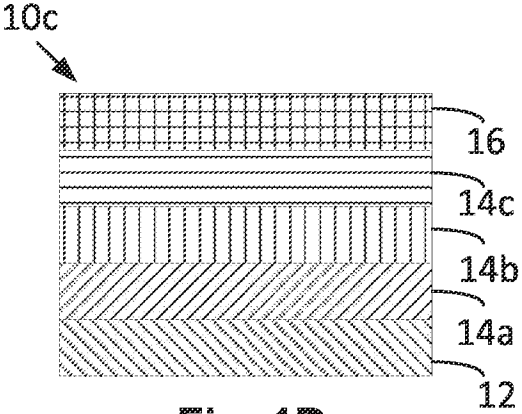

FIG. 1D illustrates layered material 10*d* having the externally facing layer 12 and the thermoplastic hot melt adhesive layer 16 with three inner layers 14*a*, 14*b*, and 14*c* there between. Inner layers 14*a*, 14*b*, and 14*c* can each be one of the tie layer, the elastomeric layer, or the regrind layer, while any of the types of inner layers can be adjacent the externally facing layer 12 or the thermoplastic hot melt adhesive layer 16. Alternatively, two or three of 14*a*, 14*b*, and 14*c* can be two or three different types of tie layers (or elastomeric layers or regrind layers).

The layered material can be incorporated into articles such as textiles. For example, the textile can include footwear or components thereof, apparel (e.g., shirts, jerseys, pants, shorts, gloves, glasses, socks, hats, caps, jackets, undergarments) or components thereof, containers (e.g., backpacks, bags), and upholstery for furniture (e.g., chairs, couches, car seats), bed coverings (e.g., sheets, blankets), table coverings, towels, flags, tents, sails, and parachutes. In addition, the layered material can be used to produce articles or other items that are disposed on the article, where the article can be striking devices (e.g., bats, rackets, sticks, mallets, golf clubs, paddles, etc.), athletic equipment (e.g., golf bags, baseball and football gloves, soccer ball restriction structures), protective equipment (e.g., pads, helmets, guards, visors, masks, goggles, etc.), locomotive equipment (e.g., bicycles, motorcycles, skateboards, cars, trucks, boats, surfboards, skis, snowboards, etc.), balls or pucks for use in various sports, fishing or hunting equipment, furniture, electronic equipment, construction materials, eyewear, timepieces, jewelry, and the like.

The article of footwear of the present disclosure may be designed for a variety of uses, such as sporting, athletic, military, work-related, recreational, or casual use. Primarily, the article of footwear is intended for outdoor use on unpaved surfaces (in part or in whole), such as on a ground surface including one or more of grass, turf, gravel, sand, dirt, clay, mud, and the like, whether as an athletic performance surface or as a general outdoor surface. However, the article of footwear may also be desirable for indoor applications, such as indoor sports including dirt playing surfaces for example (e.g., indoor baseball fields with dirt infields).

The article of footwear can be designed use in outdoor sporting activities, such as global football/soccer, golf, American football, rugby, baseball, running, track and field, cycling (e.g., road cycling and mountain biking), and the like. The article of footwear can optionally include traction elements (e.g., lugs, cleats, studs, and spikes as well as tread patterns) to provide traction on soft and slippery surfaces, where the layered material can be between or among the traction elements and optionally on the sides of the traction elements but on the surface of the traction element that contacts the ground or surface. Cleats, studs and spikes are commonly included in footwear designed for use in sports such as global football/soccer, golf, American football, rugby, baseball, and the like, which are frequently played on unpaved surfaces. Lugs and/or exaggerated tread patterns are commonly included in footwear including boots design for use under rugged outdoor conditions, such as trail running, hiking, and military use.

The traction elements may each include any suitable cleat, stud, spike, or similar element configured to enhance traction for a wearer during cutting, turning, stopping, accelerating, and backward movement. The traction elements can be arranged in any suitable pattern along the bottom surface of the footwear. For instance, the traction elements can be distributed in groups or clusters along the outsole component (e.g., clusters of 2-8 traction elements). The traction elements can be grouped into a cluster at the forefoot (toe) region, a cluster at the midfoot region, and a cluster at the heel region. In an example, six of the traction elements are substantially aligned along the medial side of the outsole component, and the other six traction elements are substantially aligned along the lateral side of the outsole component.

The traction elements may alternatively be arranged along the outsole component symmetrically or non-symmetrically between the medial side and the lateral side, as desired. Moreover, one or more of the traction elements may be arranged along a centerline of outsole component between the medial side and the lateral side, such as a blade, as desired to enhance or otherwise modify performance.

Alternatively (or additionally), traction elements can also include one or more front-edge traction elements, such as one or more blades, one or more fins, and/or one or more cleats (not shown) secured to (e.g., integrally formed with) the backing plate at a front-edge region between forefoot region and cluster. In this application, the externally-facing portion of the layered material can optionally extend across the bottom surface at this front-edge region while maintaining good traction performance.

Furthermore, the traction elements may each independently have any suitable dimension (e.g., shape and size). For instance, in some designs, each traction element within a given cluster (e.g., clusters) may have the same or substantially the same dimensions, and/or each traction element across the entirety of the outsole component may have the same or substantially the same dimensions. Alternatively, the traction elements within each cluster may have different dimensions, and/or each traction element across the entirety of the outsole component may have different dimensions.

Examples of suitable shapes for the traction elements include rectangular, hexagonal, cylindrical, conical, circular, square, triangular, trapezoidal, diamond, ovoid, as well as other regular or irregular shapes (e.g., curved lines, C-shapes, etc.). The traction elements may also have the same or different heights, widths, and/or thicknesses as each other, as further discussed below. Further examples of suitable dimensions for the traction elements and their arrangements along the plate include those provided in soccer/global football footwear commercially available under the tradenames "TIEMPO", "HYPERVENOM", "MAGISTA", and "MERCURIAL" from Nike, Inc. of Beaverton, OR.

The traction elements may be incorporated into the outsole component including the optional backing plate by any suitable mechanism such that the traction elements preferably extend from the bottom surface. The traction elements can be disposed in different areas (e.g., in the toe region, heel region, or both) than the layered material (e.g., in the midfoot region). As discussed below, the traction elements may be integrally formed with the backing plate through a molding process (e.g., for firm ground (FG) footwear). Alternatively, the outsole component or optional backing plate may be configured to receive removable traction elements, such as screw-in or snap-in traction elements. The backing plate may include receiving holes (e.g., threaded or snap-fit holes, not shown), and the traction elements can be screwed or snapped into the receiving holes to secure the traction elements to the backing plate (e.g., for soft ground (SG) footwear).

In further examples, a first portion of the traction elements can be integrally formed with the outsole component or optional backing plate and a second portion of the traction elements can be secured with screw-in, snap-in, or other similar mechanisms (e.g., for SG pro footwear). The traction elements may also be configured as short studs for use with artificial ground (AG) footwear, if desired. In some applications, the receiving holes may be raised or otherwise protrude from the general plane of the bottom surface of the backing plate. Alternatively, the receiving holes may be flush with the bottom surface.

The traction elements can be fabricated from any suitable material for use with the outsole component. For example, the traction elements may include one or more of polymeric materials such as thermoplastic elastomers; thermoset polymers; elastomeric polymers; silicone polymers; natural and synthetic rubbers; composite materials including polymers reinforced with carbon fiber and/or glass; natural leather; metals such as aluminum, steel and the like; and combinations thereof. In aspects in which the traction elements are integrally formed with the backing plate (e.g., molded together), the traction elements preferably include the same materials as the outsole component or backing plate (e.g., thermoplastic materials). Alternatively, in aspects in which the traction elements are separate and insertable into receiving holes of the backing plate, the traction elements can include any suitable materials that can secured in the receiving holes of the backing plate (e.g., metals and thermoplastic materials).

As mentioned above, the traction element may have any suitable dimensions and shape, where the shaft (and the outer side surface) can correspondingly have rectangular, hexagonal, cylindrical, conical, circular, square, triangular, trapezoidal, diamond, ovoid, as well as other regular or irregular shapes (e.g., curved lines, C-shapes, etc.). Similarly, the terminal edge can have dimensions and sizes that correspond to those of the outer side surface, and can be substantially flat, sloped, rounded, and the like. Furthermore, the terminal edge can be substantially parallel to the bottom surface and/or the layered material.

Examples of suitable average lengths for each shaft relative to bottom surface range from 1 millimeter to 20 millimeters, from 3 millimeters to 15 millimeters, or from 5 millimeters to 10 millimeters, where, as mentioned above, each traction element can have different dimensions and sizes (i.e., the shafts of the various traction elements can have different lengths).

Figure 2:
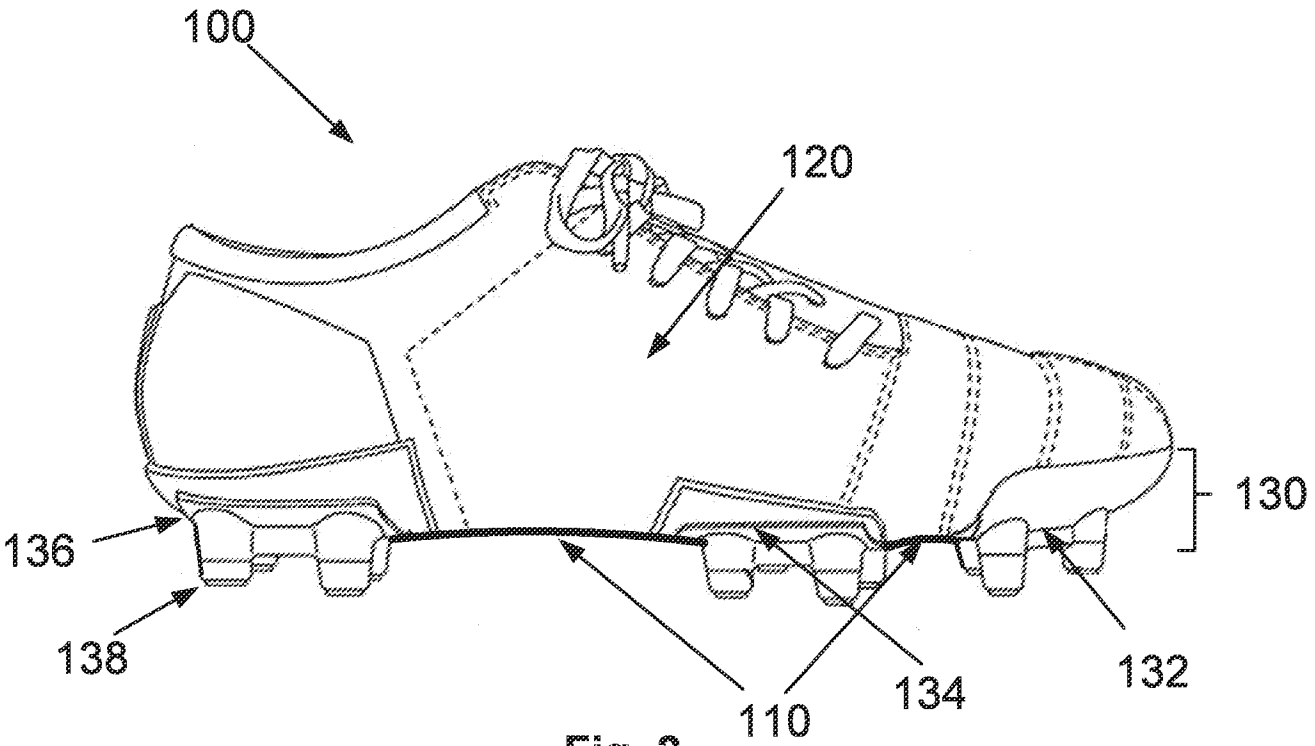
FIG. 2 is a side view of an example of footwear.
Figure 3:
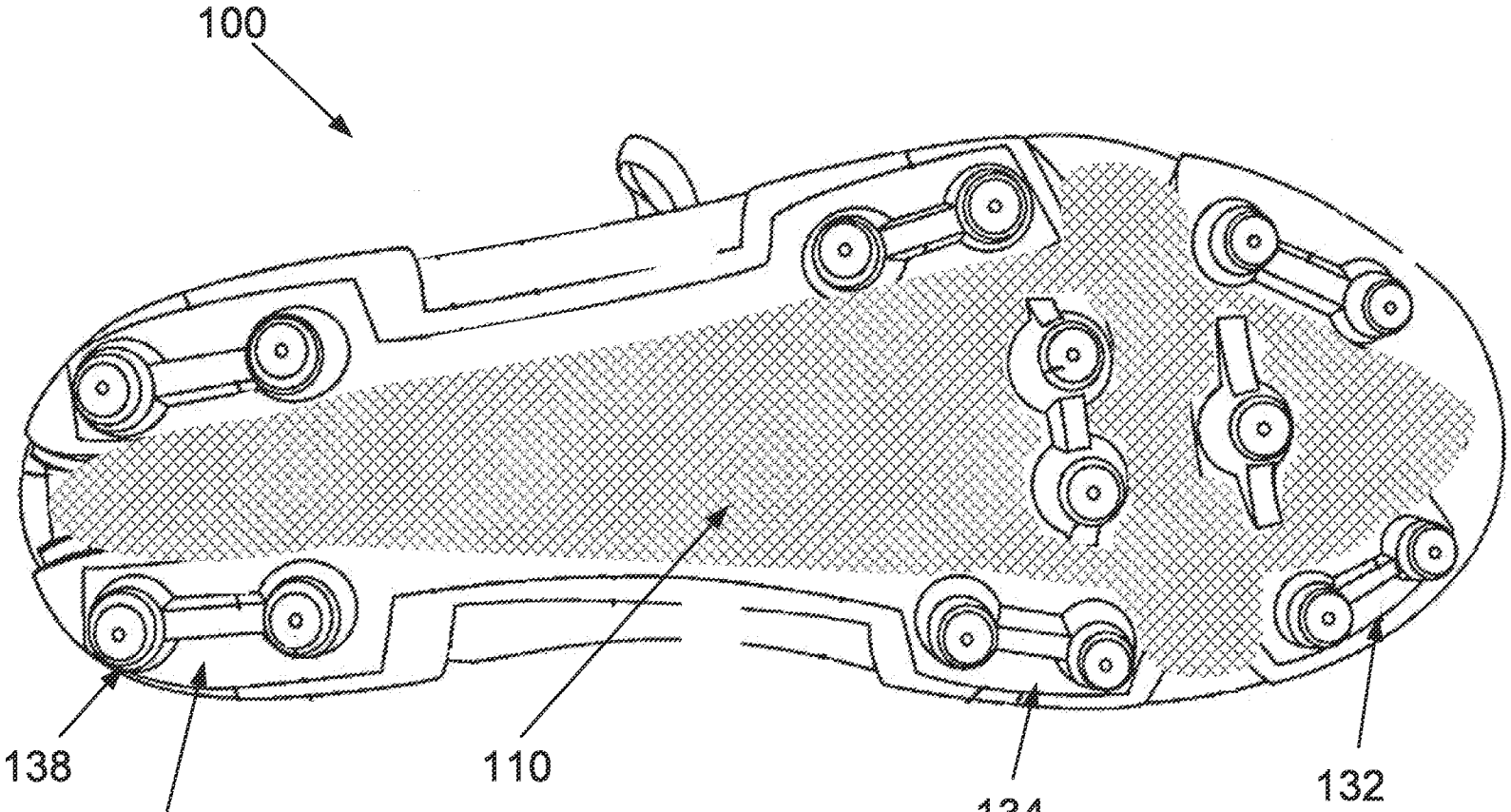
FIG. 3 is a bottom view of an example of footwear.

The layered material can be used as one or more components in an article of footwear (e.g., typically on the outsole component contacting the ground or surface). FIGS. 2 and 3 illustrates an article of footwear 100 that includes an upper 120 and an outsole component 130, where the upper 120 is secured to the outsole component 130. The outsole component 130 can include a toe plate 132 (e.g., toe region), a mid-plate 134 (e.g., midfoot region), and a heel plate 136 (e.g., heel region) and traction elements 138 as well as the layered material 110, where the externally-facing layer is on the outside surface so to be able to contact the ground or surface under normal use. Optionally, the layered material 110 can be an externally-facing layer of the upper 120 in a region proximal to the outsole component 130. In other aspects not depicted, the outsole component 130 may incorporate fluid-filled chambers, plates, moderators, or other elements that further attenuate forces, enhance stability, or influence the motions of the foot.

The upper 120 of the footwear 100 has a body which may be fabricated from materials known in the art for making articles of footwear, and is configured to receive a user's foot. For example, the upper 120 may be made from or include one or more components made from one or more of natural leather; a knit, braided, woven, or non-woven textile made in whole or in part of a natural fiber; a knit, braided, woven or non-woven textile made in whole or in part of a synthetic polymer, a film of a synthetic polymer, etc.; and combinations thereof. The upper 120 and components of the upper 120 may be manufactured according to conventional techniques (e.g., molding, extrusion, thermoforming, stitching, knitting, etc.). The upper 120 may alternatively have any desired aesthetic design, functional design, brand designators, and the like.

The outsole component 130 may be directly or otherwise secured to the upper 120 using any suitable mechanism or method. As used herein, the terms "secured to", such as for an outsole that is secured to an upper, e.g., is operably secured to an upper, refers collectively to direct connections, indirect connections, integral formations, and combinations thereof. For instance, for the outsole component 130 that is secured to the upper 120, the outsole component 130 can be directly connected to the upper 120 using the thermoplastic hot melt adhesive layer and optionally include the outsole 120 indirectly connected to the upper (e.g., with an intermediate midsole), can be integrally formed with the upper (e.g., as a unitary component), and combinations thereof.

Figure 4:
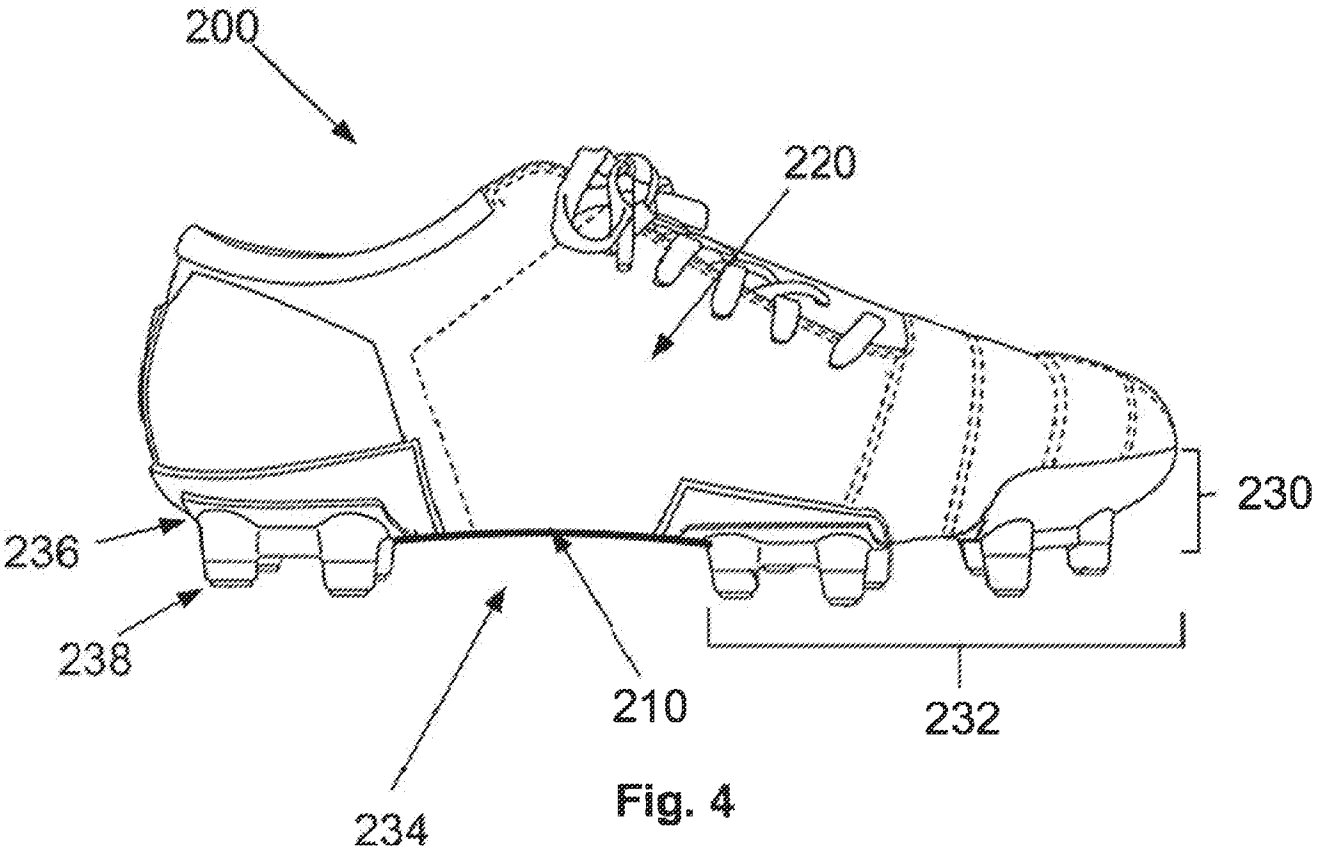
FIG. 4 is a side view of an example of footwear.
Figure 5:
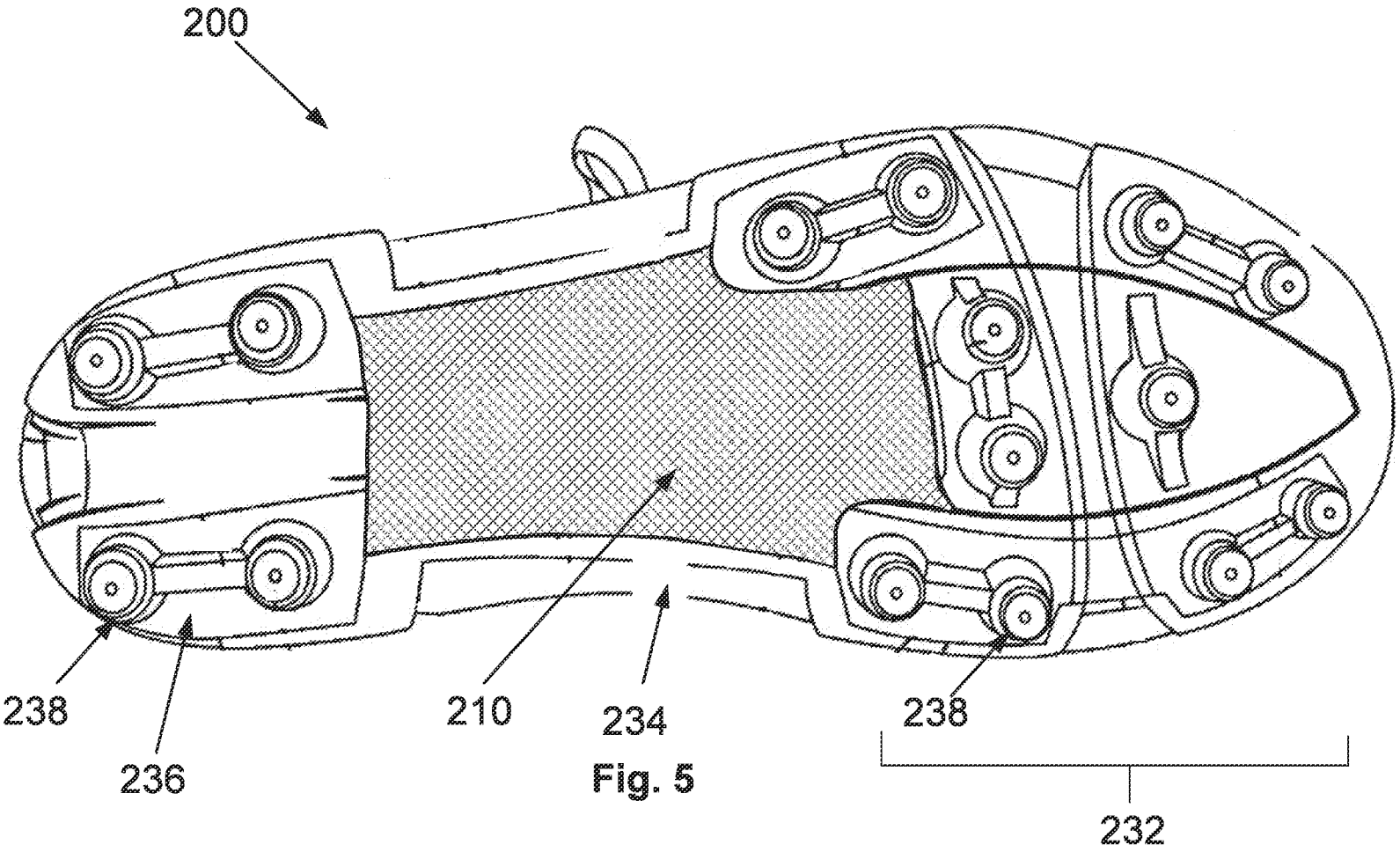
FIG. 5 is a bottom view of an example of footwear.

FIGS. 4 and 5 illustrates an article of footwear 200 that includes an upper 220 and a outsole component 230, where the upper 220 is secured to the outsole component 230. The outsole component 230 can include a toe plate 232 (e.g., toe region), a mid-plate 234 (e.g., midfoot region), and a heel plate 236 (e.g., heel region) and traction elements 238 in the top plate 232 and the heel plate 236 but not the mid-plate 234. The footwear 200 is similar to footwear 100 except that the layered material 210 is positioned between the toe plate 232 and the heel plate 236. The mid-plate 234 includes the layered material 210, where the externally-facing layer is on the outside surface so to be able to contact the ground or surface under normal use. Components or elements 110, 120, 130, 132, 136, and 138 are similar to components or elements 210, 220, 230, 232, 236, and 238. In other aspects not depicted, the outsole component 230 may incorporate fluid-filled chambers, plates, moderators, or other elements that further attenuate forces, enhance stability, or influence the motions of the toot.

For example, the present disclosure provides for an article of footwear having an outsole component on a side of the article of footwear. The side is configured to be ground facing. The outsole component comprises a layered material having an externally facing layer and a second layer opposite the externally facing layer. The externally facing layer includes at least a portion of an outer surface of the article of footwear. The externally facing layer comprises a hydrogel material and the second layer comprises a thermoplastic hot melt adhesive material. The article of footwear comprises one or more of the traction elements on the side of the article of footwear configured to be ground facing. The traction elements can be in the toe region, heel region, or both while the layered material is in the midfoot region.

The term "externally facing" as used in "externally facing layer" refers to the position the element is intended to be in when the element is present in an article during normal use. If the article is footwear, the element is positioned toward the ground during normal use by a wearer when in a standing position, and thus can contact the ground including unpaved surfaces when the footwear is used in a conventional manner, such as standing, walking or running on an unpaved surface. In other words, even though the element may not necessarily be facing the ground during various steps of manufacturing or shipping, if the element is intended to face the ground during normal use by a wearer, the element is understood to be externally-facing or more specifically for an article of footwear, ground-facing. In some circumstances, due to the presence of elements such as traction elements, the externally facing (e.g., ground-facing) surface can be positioned toward the ground during conventional use but may not necessarily come into contact the ground. For example, on hard ground or paved surfaces, the terminal ends of traction elements on the outsole may directly contact the ground, while portions of the outsole located between the traction elements do not. As described in this example, the portions of the outsole located between the traction elements are considered to be externally facing (e.g., ground-facing) even though they may not directly contact the ground in all circumstances.

It has been found that the layered material and articles incorporating the layered material (e.g. footwear) can prevent or reduce the accumulation of soil on the externally-facing layer of the layered material during wear on unpaved surfaces. As used herein, the term "soil" can include any of a variety of materials commonly present on a ground or playing surface and which might otherwise adhere to an outsole or exposed midsole of a footwear article. Soil can include inorganic materials such as mud, sand, dirt, and gravel; organic matter such as grass, turf, leaves, other vegetation, and excrement; and combinations of inorganic and organic materials such as clay. Additionally, soil can include other materials such as pulverized rubber which may be present on or in an unpaved surface.

While not wishing to be bound by theory, it is believed that the layered material (e.g., the hydrogel material in the externally facing layer) in accordance with the present disclosure, when sufficiently wet with water (including water containing dissolved, dispersed or otherwise suspended materials) can provide compressive compliance and/or expulsion of uptaken water. In particular, it is believed that the compressive compliance of the wet layered material, the expulsion of liquid from the wet layered material, or both in combination, can disrupt the adhesion of soil on or at the outsole, or the cohesion of the particles to each other, or can disrupt both the adhesion and cohesion. This disruption in the adhesion and/or cohesion of soil is believed to be a responsible mechanism for preventing (or otherwise reducing) the soil from accumulating on the footwear outsole component (due to the presence of the wet material).

This disruption in the adhesion and/or cohesion of soil is believed to be a responsible mechanism for preventing (or otherwise reducing) the soil from accumulating on the footwear outsole component (due to the presence of the layered material). As can be appreciated, preventing soil from accumulating on the bottom of footwear can improve the performance of traction elements present on the outsole component during wear on unpaved surfaces, can prevent the footwear from gaining weight due to accumulated soil during wear, can preserve ball handling performance of the footwear, and thus can provide significant benefits to wearer as compared to an article of footwear without the material present on the outsole component.

Where the layered material (e.g., the hydrogel material in the externally facing layer) swells, the swelling of the layered material can be observed as an increase in material thickness from the dry-state thickness of the layered material, through a range of intermediate-state thicknesses as additional water is absorbed, and finally to a saturated-state thickness layered material, which is an average thickness of the layered material when fully saturated with water. For example, the saturated-state thickness for the fully saturated layered material can be greater than 150 percent, greater than 200 percent, greater than 250 percent, greater than 300 percent, greater than 350 percent, greater than 400 percent, or greater than 500 percent, of the dry-state thickness for the same layered material (e.g., the hydrogel material), as characterized by the Swelling Capacity Test. The saturated-state thickness for the fully saturated layered material can be about 150 percent to 500 percent, about 150 percent to 400 percent, about 150 percent to 300 percent, or about 200 percent to 300 percent of the dry-state thickness for the same layered material. Examples of suitable average thicknesses for the layered material in a wet state (referred to as a saturated-state thickness) can be about 0.2 millimeters to 10 millimeters, about 0.2 millimeters to 5 millimeters, about 0.2 millimeters to 2 millimeters, about 0.25 millimeters to 2 millimeters, or about 0.5 millimeters to 1 millimeter.

The layered material (e.g., the hydrogel material in the externally facing layer) in neat form can have an increase in thickness at 1 hour of about 35 percent to 400 percent, about percent to 300 percent, or about 100 percent to 200 percent, as characterized by the Swelling Capacity Test. In some further embodiments, the layered material in neat form can have an increase in thickness at 24 hours of about 45 percent to 500 percent, about 100 percent to 400 percent, or about 150 percent to 300 percent. Correspondingly, the outsole component film in neat form can have an increase in film volume at 1 hour of about 50 percent to 500 percent, about 75 percent to 400 percent, or about 100 percent to 300 percent.

The layered material (e.g., the hydrogel material in the externally facing layer) can quickly take up water that is in contact with the layered material. For instance, the layered material can take up water from mud and wet grass, such as during a warmup period prior to a competitive match. Alternatively (or additionally), the layered material can be pre-conditioned with water so that the layered material is partially or fully saturated, such as by spraying or soaking the layered material with water prior to use.

The layered material (e.g., the hydrogel material in the externally facing layer) can exhibit an overall water uptake capacity of about 25 percent to 225 percent as measured in the Water Uptake Capacity Test over a soaking time of 24 hours using the Component Sampling Procedure, as will be defined below. Alternatively, the overall water uptake capacity exhibited by the layered material is in the range of about 30 percent to about 200 percent; alternatively, about 50 percent to about 150 percent; alternatively, about 75 percent to about 125 percent. For the purpose of this disclosure, the term "overall water uptake capacity" is used to represent the amount of water by weight taken up by the layered material as a percentage by weight of dry layered material. The procedure for measuring overall water uptake capacity includes measurement of the "dry" weight of the layered material, immersion of the layered material in water at ambient temperature (~23 degree Celsius) for a predetermined amount of time, followed by re-measurement of the weight of the layered material when "wet". The procedure for measuring the overall weight uptake capacity according to the Water Uptake Capacity Test using the Component Sampling Procedure is described below.

The layered material (e.g., the hydrogel material in the externally facing layer) can also be characterized by a water uptake rate of 10 gram/meter squared/√minute to 120 gram/meter squared/√minute as measured in the Water Uptake Rate Test using the Material Sampling Procedure. The water uptake rate is defined as the weight (in grams) of water absorbed per square meter of the elastomeric material over the square root of the soaking time (√minute). Alternatively, the water uptake rate ranges from about 12 gram/meter squared/√minute to about 100 gram/meter squared/√minute; alternatively, from about 25 gram/meter squared/√minute to about 90 gram/meter squared/√minute; alternatively, up to about 60 gram/meter squared/√minute.

The overall water uptake capacity and the water uptake rate can be dependent upon the amount of the hydrogel material that is present in the layered material. The hydrogel material can characterized by a water uptake capacity of 50 percent to 2000 percent as measured according to the Water Uptake Capacity Test using the Material Sampling Procedure. In this case, the water uptake capacity of the hydrogel material is determined based on the amount of water by weight taken up by the hydrogel material as a percentage by weight of dry hydrogel material. Alternatively, the water uptake capacity exhibited by the hydrogel material is in the range of about 100 percent to about 1500 percent; alternatively, in the range of about 300 percent to about 1200 percent.

As also discussed above, in some aspects, the surface of the layered material (e.g., the hydrogel material in the externally facing layer) preferably exhibits hydrophilic properties. The hydrophilic properties of the layered material surface can be characterized by determining the static sessile drop contact angle of the layered material's surface. Accordingly, in some examples, the layered material's surface in a dry state has a static sessile drop contact angle (or dry-state contact angle) of less than 105 degree, or less than degree, less than 85 degree, as characterized by the Contact Angle Test. The Contact Angle Test can be conducted on a sample obtained in accordance with the Article Sampling Procedure or the Co-Extruded Film Sampling Procedure. In some further examples, the layered material in a dry state has a static sessile drop contact angle ranging from 60 degrees to 100 degrees, from 70 degrees to 100 degrees, or from 65 degrees to 95 degrees.

In other examples, the surface of the layered material (e.g., the hydrogel material in the externally facing layer) in a wet state has a static sessile drop contact angle (or wet-state contact angle) of less than 90 degrees, less than 80 degrees, less than 70 degrees, or less than 60 degrees. In some further examples, the surface in a wet state has a static sessile drop contact angle ranging from 45 degrees to 75 degrees. In some cases, the dry-state static sessile drop contact angle of the surface is greater than the wet-state static sessile drop contact angle of the surface by at least 10 degrees, at least 15 degrees, or at least 20 degrees, for example from 10 degrees to 40 degrees, from 10 degrees to 30 degrees, or from 10 degrees to 20 degrees.

The surface of the layered material (e.g., the hydrogel material in the externally facing layer), including the surface of an article can also exhibit a low coefficient of friction when the material is wet. Examples of suitable coefficients of friction for the layered material in a dry state (or dry-state coefficient of friction) are less than 1.5, for instance ranging from 0.3 to 1.3, or from 0.3 to 0.7, as characterized by the Coefficient of Friction Test. The Coefficient of Friction Test can be conducted on a sample obtained in accordance with the Article Sampling Procedure, or the Co-Extruded Film Sampling Procedure. Examples of suitable coefficients of friction for the layered material in a wet state (or wet-state coefficient of friction) are less than 0.8 or less than 0.6, for instance ranging from 0.05 to 0.6, from 0.1 to 0.6, or from 0.3 to 0.5. Furthermore, the layered material can exhibit a reduction in its coefficient of friction from its dry state to its wet state, such as a reduction ranging from 15 percent to 90 percent, or from 50 percent to 80 percent. In some cases, the dry-state coefficient of friction is greater than the wet-state coefficient of friction for the material, for example being higher by a value of at least 0.3 or 0.5, such as 0.3 to 1.2 or 0.5 to 1.

Furthermore, the compliance of the layered material (e.g., the hydrogel material in the externally facing layer), including an article comprising the material, can be characterized by based on the layered material's storage modulus in the dry state (when equilibrated at 0 percent relative humidity (RH)), and in a partially wet state (e.g., when equilibrated at 50 percent RHor at 90 percent RH), and by reductions in its storage modulus between the dry and wet states. In particular, the layered material can have a reduction in storage modulus ($\Delta E'$) from the dry state relative to the wet state. A reduction in storage modulus as the water concentration in the hydrogel-containing material increases corresponds to an increase in compliance, because less stress is required for a given strain/deformation.

The layered material (e.g., the hydrogel material in the externally facing layer) exhibits a reduction in the storage modulus from its dry state to its wet state (50 percent RH) of more than 20 percent, more than 40 percent, more than 60 percent, more than 75 percent, more than 90 percent, or more than 99 percent, relative to the storage modulus in the dry state, and as characterized by the Storage Modulus Test with the Neat Film Sampling Process.

In some further aspects, the dry-state storage modulus of the layered material (e.g., the hydrogel material in the externally facing layer) is greater than its wet-state (50 percent RH) storage modulus by more than 25 megaPascals, by more than 50 megaPascals, by more than 100 megaPascals, by more than 300 megaPascals, or by more than 500 megaPascals, for example ranging from 25 megaPascals to 800 megaPascals, from 50 megaPascals to 800 megaPascals, from 100 megaPascals to 800 megaPascals, from 200 megaPascals to 800 megaPascals, from 400 megaPascals to 800 megaPascals, from 25 megaPascals to 200 megaPascals, from 25 megaPascals to 100 megaPascals, or from 50 megaPascals to 200 megaPascals. Additionally, the dry-state storage modulus can range from 40 megaPascals to 800 megaPascals, from 100 megaPascals to 600 megaPascals, or from 200 megaPascals to 400 megaPascals, as characterized by the Storage Modulus Test. Additionally, the wet-state storage modulus can range from 0.003 megaPascals to 100 megaPascals, from 1 megaPascals to 60 megaPascals, or from 20 megaPascals to 40 megaPascals.

The layered material (e.g., the hydrogel material in the externally facing layer) can exhibit a reduction in the storage modulus from its dry state to its wet state (90 percent RH) of more than 20 percent, more than 40 percent, more than 60 percent, more than 75 percent, more than 90 percent, or more than 99 percent, relative to the storage modulus in the dry state, and as characterized by the Storage Modulus Test with the Neat Film Sampling Process. The dry-state storage modulus of the layered material can be greater than its wet-state (90 percent RH) storage modulus by more than 25 megaPascals, by more than 50 megaPascals, by more than 100 megaPascals, by more than 300 megaPascals, or by more than 500 megaPascals, for example ranging from 25 megaPascals to 800 megaPascals, from 50 megaPascals to 800 megaPascals, from 100 megaPascals to 800 megaPascals, from 200 megaPascals to 800 megaPascals, from 400 megaPascals to 800 megaPascals, from 25 megaPascals to 200 megaPascals, from 25 megaPascals to 100 megaPascals, or from 50 megaPascals to 200 megaPascals. Additionally, the dry-state storage modulus can range from 40 megaPascals to 800 megaPascals, from 100 megaPascals to 600 megaPascals, or from 200 megaPascals to 400 megaPascals, as characterized by the Storage Modulus Test. Additionally, the wet-state storage modulus can range from 0.003 megaPascals to 100 megaPascals, from 1 megaPascals to 60 megaPascals, or from 20 megaPascals to 40 megaPascals.

In addition to a reduction in storage modulus, the layered material (e.g., the hydrogel material in the externally facing layer) can also exhibit a reduction in its glass transition temperature from the dry state (when equilibrated at 0 percent relative humidity (RH) to the wet state (when equilibrated at 90 percent RH). While not wishing to be bound by theory, it is believed that the water taken up by the layered material plasticizes the layered material, which reduces its storage modulus and its glass transition temperature, rendering the layered material more compliant (e.g., compressible, expandable, and stretchable).

The layered material (e.g., the hydrogel material in the externally facing layer) can exhibit a reduction in glass transition temperature ($\Delta T_g$) from its dry-state (0 percent RH) glass transition temperature to its wet-state glass transition (90 percent RH) temperature of more than a 5 degree Celsius difference, more than a 6 degree Celsius difference, more than a 10 degree Celsius difference, or more than a 15 degree Celsius difference, as characterized by the Glass Transition Temperature Test with the Neat Film Sampling Process or the Neat Material Sampling Process. For instance, the reduction in glass transition temperature ($\Delta T_g$) can range from more than a 5 degree Celsius difference to a 40 degree Celsius difference, from more than a 6 degree Celsius difference to a 50 degree Celsius difference, form more than a 10 degree Celsius difference to a 30 degree Celsius difference, from more than a 30 degree Celsius difference to a 45 degree Celsius difference, or from a 15 degree Celsius difference to a 20 degree Celsius difference. The layered material can also exhibit a dry glass transition temperature ranging from −40 degree Celsius to −80 degree Celsius, or from −40 degree Celsius to −60 degree Celsius.

Alternatively (or additionally), the reduction in glass transition temperature ($\Delta T_g$) can range from a 5 degree Celsius difference to a 40 degree Celsius difference, form a 10 degree Celsius difference to a 30 degree Celsius difference, or from a 15 degree Celsius difference to a 20 degree Celsius difference. The layered material can also exhibit a dry glass transition temperature ranging from −40 degree Celsius to −80 degree Celsius, or from −40 degree Celsius to −60 degree Celsius.

The total amount of water that the layered material (e.g., the hydrogel material in the externally facing layer) can take up depends on a variety of factors, such as its composition (e.g., its hydrophilicity), its cross-linking density, its thickness, and the like. The water uptake capacity and the water uptake rate of the layered material are dependent on the size and shape of its geometry, and are typically based on the same factors. Conversely, the water uptake rate is transient and can be defined kinetically. The three primary factors for water uptake rate for layered material present given part geometry include time, thickness, and the exposed surface area available for taking up water.

Even though the layered material (e.g., the hydrogel material in the externally facing layer) can swell as it takes up water and transitions between the different material states with corresponding thicknesses, the saturated-state thickness of the layered material preferably remains less than the length of the traction element. This selection of the layered material and its corresponding dry and saturated thicknesses ensures that the traction elements can continue to provide ground-engaging traction during use of the footwear, even when the layered material is in a fully swollen state. For example, the average clearance difference between the lengths of the traction elements and the saturated-state thickness of the layered material is desirably at least 8 millimeters. For example, the average clearance distance can be at least 9 millimeters, 10 millimeters, or more.

As also mentioned above, in addition to swelling, the compliance of the layered material (e.g., the hydrogel material in the externally facing layer) can also increase from being relatively stiff (i.e., dry-state) to being increasingly stretchable, compressible, and malleable (i.e., wet-state). The increased compliance accordingly can allow the layered material to readily compress under an applied pressure (e.g., during a foot strike on the ground), and in some aspects, to quickly expel at least a portion of its retained water (depending on the extent of compression). While not wishing to be bound by theory, it is believed that this compressive compliance alone, water expulsion alone, or both in combination can disrupt the adhesion and/or cohesion of soil, which prevents or otherwise reduces the accumulation of soil.

In addition to quickly expelling water, in particular examples, the compressed layered material is capable of quickly re-absorbing water when the compression is released (e.g., liftoff from a foot strike during normal use). As such, during use in a wet or damp environment (e.g., a muddy or wet ground), the layered material can dynamically expel and repeatedly take up water over successive foot strikes, particularly from a wet surface. As such, the layered material can continue to prevent soil accumulation over extended periods of time (e.g., during an entire competitive match), particularly when there is ground water available for re-uptake.

In addition to being effective at preventing soil accumulation, the layered material (e.g., the hydrogel material in the externally facing layer) has also been found to be sufficiently durable for its intended use on the ground-contacting side of the article of footwear. The useful life of the layered material (and footwear containing it) is at least 10 hours, 20 hours, 50 hours, 100 hours, 120 hours, or 150 hours of wear.

As used herein, the terms "take up", "taking up", "uptake", "uptaking", and the like refer to the drawing of a liquid (e.g., water) from an external source into the layered material (e.g., the hydrogel material in the externally facing layer), such as by absorption, adsorption, or both. Furthermore, as briefly mentioned above, the term "water" refers to an aqueous liquid that can be pure water, or can be an aqueous carrier with lesser amounts of dissolved, dispersed or otherwise suspended materials (e.g., particulates, other liquids, and the like).

Now having described aspects of the present disclosure in general, additional details will be provided for the hydrogel material, the thermoplastic hot melt adhesive material, the elastomeric material, the tie material and the regrind material.

As described herein, the externally facing layer includes the first material. The first material comprises a hydrogel material. The hydrogel material can comprise a polymeric hydrogel. The polymeric hydrogel can comprise or consist essentially of a polyurethane hydrogel. Polyurethane hydrogels are prepared from one or more diisocyanate and one or more hydrophilic diol. The polymer may also include a hydrophobic diol in addition to the hydrophilic diol. The polymerization is normally carried out using roughly an equivalent amount of the diol and diisocyanate. Examples of hydrophilic diols are polyethylene glycols or copolymers of ethylene glycol and propylene glycol. The diisocyanate can be selected from a wide variety of aliphatic or aromatic diisocyanates. The hydrophobicity of the resulting polymer is determined by the amount and type of the hydrophilic diols, the type and amount of the hydrophobic diols, and the type and amount of the diisocyanates. Additional details regarding polyurethane are provided herein.

The polymeric hydrogel can comprise or consist essentially of a polyurea hydrogel. Polyurea hydrogels are prepared from one or more diisocyanate and one or more hydrophilic diamine. The polymer may also include a hydrophobic diamine in addition to the hydrophilic diamines. The polymerization is normally carried out using roughly an equivalent amount of the diamine and diisocyanate. Typical hydrophilic diamines are amine-terminated polyethylene oxides and amine-terminated copolymers of polyethylene oxide/polypropylene. Examples are Jeffamine® diamines sold by Huntsman (The Woodlands, TX, USA). The diisocyanate can be selected from a wide variety of aliphatic or aromatic diisocyanates. The hydrophobicity of the resulting polymer is determined by the amount and type of the hydrophilic diamine, the type and amount of the hydrophobic amine, and the type and amount of the diisocyanate. Additional details regarding polyurea are provided herein.

The polymeric hydrogel can comprise or consist essentially of a polyester hydrogel. Polyester hydrogels can be prepared from dicarboxylic acids (or dicarboxylic acid derivatives) and diols where part or all of the diol is a hydrophilic diol. Examples of hydrophilic diols are polyethylene glycols or copolymers of ethylene glycol and propylene glycol. A second hydrophobic diol can also be used to control the polarity of the final polymer. One or more diacid can be used which can be either aromatic or aliphatic. Of particular interest are block polyesters prepared from hydrophilic diols and lactones of hydroxyacids. The lactone is polymerized on the each end of the hydrophilic diol to produce a triblock polymer. In addition, these triblock segments can be linked together to produce a multiblock polymer by reaction with a dicarboxylic acid. Additional details regarding polyurea are provided herein.

The polymeric hydrogel can comprise or consist essentially of a polycarbonate hydrogel. Polycarbonates are typically prepared by reacting a diol with phosgene or a carbonate diester. A hydrophilic polycarbonate is produced when part or all of the diol is a hydrophilic diol. Examples of hydrophilic diols are hydroxyl terminated polyethers of ethylene glycol or polyethers of ethylene glycol with propylene glycol. A second hydrophobic diol can also be included to control the polarity of the final polymer. Additional details regarding polycarbonate are provided herein.

In an embodiment, the polymeric hydrogel can comprise or consist essentially of a polyetheramide hydrogel. Polyetheramides are prepared from dicarboxylic acids (or dicarboxylic acid derivatives) and polyether diamines (a polyether terminated on each end with an amino group). Hydrophilic amine-terminated polyethers produce hydrophilic polymers that will swell with water. Hydrophobic diamines can be used in conjunction with hydrophilic diamines to control the hydrophilicity of the final polymer. In addition, the type dicarboxylic acid segment can be selected to control the polarity of the polymer and the physical properties of the polymer. Typical hydrophilic diamines are amine-terminated polyethylene oxides and amine-terminated copolymers of polyethylene oxide/polypropylene. Examples are Jeffamine® diamines sold by Huntsman (The Woodlands, TX, USA). Additional details regarding polyetheramide are provided herein.

The polymeric hydrogel can comprise or consist essentially of a hydrogel formed of addition polymers of ethylenically unsaturated monomers. The addition polymers of ethylenically unsaturated monomers can be random polymers. Polymers prepared by free radical polymerization of one of more hydrophilic ethylenically unsaturated monomer and one or more hydrophobic ethylenically unsaturated monomers. Examples of hydrophilic monomers are acrylic acid, methacrylic acid, 2-acrylamido-2-methylpropane sulphonic acid, vinyl sulphonic acid, sodium p-styrene sulfonate, [3-(methacryloylamino)propyl]trimethylammonium chloride, 2-hydroxyethyl methacrylate, acrylamide, N,N-dimethylacrylamide, 2-vinylpyrrolidone, (meth)acrylate esters of polyethylene glycol, and (meth)acrylate esters of polyethylene glycol monomethyl ether. Examples of hydrophobic monomers are (meth)acrylate esters of C1 to C4 alcohols, polystyrene, polystyrene methacrylate macromonomer and mono(meth)acrylate esters of siloxanes. The water uptake and physical characteristics are tuned by selection of the monomer and the amounts of each monomer type. Additional details regarding ethylenically unsaturated monomers are provided herein.

The addition polymers of ethylenically unsaturated monomers can be comb polymers. Comb polymers are produced when one of the monomers is a macromer (an oligomer with an ethylenically unsaturated group one end). In one case the main chain is hydrophilic while the side chains are hydrophobic. Alternatively the comb backbone can be hydrophobic while the side chains are hydrophilic. An example is a backbone of a hydrophobic monomer such as styrene with the methacrylate monoester of polyethylene glycol.

The addition polymers of ethylenically unsaturated monomers can be block polymers. Block polymers of ethylenically unsaturated monomers can be prepared by methods such as anionic polymerization or controlled free radical polymerization. Hydrogels are produced when the polymer has both hydrophilic blocks and hydrophobic blocks. The polymer can be a diblock polymer (A-B) polymer, triblock polymer (A-B-A) or multiblock polymer. Triblock polymers with hydrophobic end blocks and a hydrophilic center block are most useful for this application. Block polymers can be prepared by other means as well. Partial hydrolysis of polyacrylonitrile polymers produces multiblock polymers with hydrophilic domains (hydrolyzed) separated by hydrophobic domains (unhydrolyzed) such that the partially hydrolyzed polymer acts as a hydrogel. The hydrolysis converts acrylonitrile units to hydrophilic acrylamide or acrylic acid units in a multiblock pattern.

The polymeric hydrogel can comprise or consist essentially of a hydrogel formed of copolymers. Copolymers combine two or more types of polymers within each polymer chain to achieve the desired set of properties. Of particular interest are polyurethane/polyurea copolymers, polyurethane/polyester copolymers, polyester/polycarbonate copolymers.

As described herein, the layered material includes the second material or layer comprising the thermoplastic hot melt adhesive layer. The thermoplastic hot melt adhesive can be a polymeric composition that can comprise one or more thermoplastic polymers. The thermoplastic polymers can include one or more polymers selected from the group consisting of polyesters, polyethers, polyamides, polyurethanes and polyolefins as well as copolymers of each or combinations thereof, such as those described herein. The thermoplastic polymers can include one or more polymers selected from the group consisting of polyesters, polyethers, polyamides, polyurethanes, and combinations thereof. Additional details regarding the thermoplastic polymers are provided herein.

The thermoplastic hot melt adhesive can be a low processing temperature polymeric composition including one or more polyesters. The low processing temperature polymeric composition can include one or more polymers selected from the group consisting of polyesters, polyethers, polyamides, polyurethanes and polyolefins as well as copolymers of each or combinations thereof, such as those described herein that have a low processing temperature. The thermoplastic polymers can include one or more polymers selected from the group consisting of polyesters, polyethers, polyamides, polyurethanes, and combinations thereof as well as copolymers of each or combinations thereof, such as those described herein that have a low processing temperature. Additional details regarding the thermoplastic polymers are provided herein.

The low processing temperature polymeric composition can comprises one or more thermoplastic polymers, and can exhibit a melting temperature $T_m$ (or melting point) that is below at least one of the heat deflection temperature $T_{hd}$, the Vicat softening temperature $T_{vs}$, the creep relaxation temperature $T_{cr}$, or the melting temperature $T_m$ of polymeric hydrogel. In the same or alternative aspects, the low processing temperature polymeric composition can exhibit one or more of a melting temperature $T_m$, a heat deflection temperature $T_{hd}$, a Vicat softening temperature $T_{vs}$, and a creep relaxation temperature $T_{cr}$ that is below one or more of the heat deflection temperature $T_{hd}$, the Vicat softening temperature $T_{vs}$, the creep relaxation temperature $T_{cr}$, or the melting temperature $T_m$ of the polymeric hydrogel. The "creep relaxation temperature $T_{cr}$", the "Vicat softening temperature $T_{vs}$", the "heat deflection temperature $T_{hd}$", and the "melting temperature $T_m$" as used herein refer to the respective testing methods described below in the Property Analysis And Characterization Procedures section.

The low processing temperature polymeric composition can exhibit a melting temperature $T_m$ (or melting point) that is about 135° Celsius or less. The low processing temperature polymeric composition can exhibit a melting temperature $T_m$ that is about 125° Celsius or less. In another aspect, the low processing temperature polymeric composition can exhibit a melting temperature $T_m$ that is about 120° Celsius or less. The low processing temperature polymeric composition can exhibit a melting temperature $T_m$ that is from about ° Celsius to about 135° Celsius. The low processing temperature polymeric composition can exhibit a melting temperature $T_m$ that is from about 90° Celsius to about 120° Celsius. The low processing temperature polymeric composition can exhibit a melting temperature $T_m$ that is from about 100° Celsius to about 120° Celsius.

The low processing temperature polymeric composition can exhibit a glass transition temperature $T_g$ of about 50° Celsius or less. The low processing temperature polymeric composition can exhibit a glass transition temperature $T_g$ of about 25° Celsius or less. The low processing temperature polymeric composition can exhibit a glass transition temperature $T_g$ of about 0° Celsius or less. In various aspects, the low processing temperature polymeric composition can exhibit a glass transition temperature $T_g$ of from about −55° Celsius to about ° Celsius. The low processing temperature polymeric composition can exhibit a glass transition temperature $T_g$ of from about −50° Celsius to about 0° Celsius. The low processing temperature polymeric composition can exhibit a glass transition temperature $T_g$ of from about −30° Celsius to about −5° Celsius. The term "glass transition temperature $T_g$" as used herein refers to a respective testing method described below in the Property Analysis And Characterization Procedures section.

The low processing temperature polymeric composition can exhibit a melt flow index, using a test weight of 2.16 kilograms, of from about 0.1 grams/10 minutes (min.) to about 60 grams/10 min. In certain aspects, the low processing temperature polymeric composition can exhibit a melt flow index, using a test weight of 2.16 kilograms, of from about 2 grams/10 min. to about 50 grams/10 min. The low processing temperature polymeric composition can exhibit a melt flow index, using a test weight of 2.16 kilograms, of from about 5 grams/10 min to about 40 grams/10 min. The low processing temperature polymeric composition can exhibit a melt flow index, using a test weight of 2.16 kilograms, of about 25 grams/10 min. The term "melt flow index" as used herein refers to a respective testing method described below in the Property Analysis And Characterization Procedures section.

The low processing temperature polymeric composition can exhibit an enthalpy of melting of at least 5 J/g or about 8 J/g to about 45 J/g. The low processing temperature polymeric composition can exhibit an enthalpy of melting of from about 10 J/g to about 30 J/g. The low processing temperature polymeric composition can exhibit an enthalpy of melting of from about 15 J/g to about 25 J/g. The term "enthalpy of melting" as used herein refers to a respective testing method described below in the Property Analysis And Characterization Procedures section.

A layered material or an article comprising the low processing temperature polymeric composition can exhibit a modulus of from about 1 megaPascals to about 500 megaPascals. The layered material or the article comprising the low processing temperature polymeric composition can exhibit a modulus of from about 5 Mpa to about 150 megaPascals. The layered material or the article comprising the low processing temperature polymeric composition can exhibit a modulus of from about 20 Mpa to about 130 megaPascals. The layered material or the article comprising the low processing temperature polymeric composition can exhibit a modulus of from about 30 megaPascals to about 120 megaPascals. The layered material or the article comprising the low processing temperature polymeric composition can exhibit a modulus of from about 40 megaPascals to about 110 megaPascals. The term "modulus" as used herein refers to a respective testing method described below in the Property Analysis And Characterization Procedures section.

When the layered material or the article comprising the low processing temperature polymeric composition is brought to a temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material can exhibit a modulus of from about 1 megaPascals to about 500 megaPascals. When the layered material or the article comprising the low processing temperature polymeric composition is brought to a temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material can exhibit a modulus of from about 5 megaPascals to about 150 megaPascals. The layered material or the article comprising the low processing temperature polymeric composition is brought to a temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material can exhibit a modulus of from about 20 Mpa to about 130 megaPascals. The layered material or the article comprising the low processing temperature polymeric composition is brought to a temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material can exhibit a modulus of from about 30 Mpa to about 120 megaPascals. The layered material comprising the low processing temperature polymeric composition is brought to a temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material can exhibit a modulus of from about 40 Mpa to about 110 megaPascals.

When the layered material or the article comprising the low processing temperature polymeric composition is present in a textile and has been brought to temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material exhibits a cold ross flex of from about 5000 cycles to about 500,000 cycles. When the layered material or the article comprising the low processing temperature polymeric composition is present in a textile and has been brought to temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material exhibits a cold ross flex of from about 10,000 cycles to about 300,000 cycles. When the layered material or the article comprising the low processing temperature polymeric composition is present in a textile and has been brought to temperature above the melting temperature $T_m$ of the low processing temperature polymeric composition and then brought to a temperature below the melting temperature $T_m$ of the low processing temperature polymeric composition, when tested at approximately 20 degree Celsius and 1 A $T_m$ of pressure, the resulting thermoformed material exhibits a cold ross flex of at least about 150,000 cycles. The term "cold Ross flex" as used herein refers to a respective testing method described below in the Property Analysis And Characterization Procedures section.

As described herein, the layered material can optionally include one or more inner layers, where one type of inner layer is the tie layer. The tie layer can comprise a tie material including at least one thermoplastic material. When present in a layered material, the tie layer joins together different layers that can be different from each other. The tie layer can be formed by extrusion, co-extrusion, solvent casting, pelletization, injection molding, lamination, spray coating, and the like. The materials of the layers joined by the tie layer can differ from each other based on the respective chemical structure of the polymers, the respective concentrations of the polymers, the respective number average molecular weights of the polymers, the respective average degrees of crosslinking of the polymers, the respective melting points of the polymers, and the like, including any combination thereof. The tie layer can comprise the material present in one or both of the layers that the tie material joins.

In some situations, the joined layers, without the tie layer, can delaminate from one another. The presence of the tie layer has been found to reduce delamination in situations where delamination was a concern. The tie layer can be a layer that assists in securing or binding the two or more layers to one another. In an aspect, the tie layer can be manufactured with one or more layers and can provide a good interfacial bond to the layers it joins, as discussed below.

The tie material can include one or more polymeric materials such as thermoplastic elastomers; thermoset polymers; elastomeric polymers; silicone polymers; natural and synthetic rubbers; composite materials including polymers reinforced with carbon fiber and/or glass; natural leather; metals such as aluminum, steel and the like; and combinations thereof.

The fie material can be a thermoplastic polymeric composition that can comprise one or more thermoplastic polymers. The thermoplastic polymers can include one or more polymers selected from the group consisting of polyesters, polyethers, polyamides, polyurethanes and polyolefins as well as copolymers of each or combinations thereof, such as those described herein. The thermoplastic polymers can include one or more polymers selected from the group consisting of polyesters, polyethers, polyamides, polyurethanes, and combinations thereof. Additional details regarding the thermoplastic polymers are provided herein. The tie material comprises or consists essentially of aliphatic thermoplastic polyurethane (TPU), such as those described herein. One example of this TPU is commercially available under the tradenames "Bio TPU" and "Pearlthane ECO TPU," such as Pearlthane™ ECO D12T80, Pearlthane™ ECO D12T80E, Pearlthane™ ECO D12T85, Pearlthane™ ECO D12T90, Pearlthane™ ECO D12T90E, Pearlthane™ ECO 12T95, and Pearlthane™ ECO D12T55D (Lubrizol, Countryside IL). The tie materials can also include an ethylene vinyl alcohol copolymer (EVOH).

As described herein, the layered material can optionally include one or more inner layers, where one type of inner layer is the elastomeric layer. The elastomeric layer can comprise an elastomer material. The elastomer material can be a thermoplastic polymeric composition that can comprise one or more thermoplastic polymers. The thermoplastic polymers can include one or more polymers selected from the group consisting of polyesters, polyethers, polyamides, polyurethanes and polyolefins as well as copolymers of each or combinations thereof, such as those described herein. The thermoplastic polymers can include one or more polymers selected from the group consisting of polyesters, polyethers, polyamides, polyurethanes, and combinations thereof. Additional details regarding the thermoplastic polymers are provided herein.

As described herein, the layered material can optionally include one or more inner layers, where one type of inner layer is the regrind layer. The regrind layer can be formed by obtaining recycled, ground, or reground scrap from one or more of the externally facing layer, the thermoplastic hot melt adhesive layer, the tie layer, or the elastomeric layer as well of scrap from other polymer sources such of scrap from preparing other portions of the article (e.g., shoe, clothing, athletic equipment, and the like).

The scrap can be pelletized, forming a pelletized material, and used to form the regrind layer. This step of pelletization can be conducted under conditions which minimize water uptake of the material. For example, the tradename "EREMA" pelletizer (EREMA, Engineering Recycling Maschinen and Anlagen Ges.m.b.H., Unterfeldstraße 3, 4052 Ansfelden, Austria) has been found to minimize water uptake during the pelletization process. Pelletizing can be performed under conditions such that the pelletized takes up less than about 50 percent by weight, as characterized by the Water Uptake Test with the Article Sampling Procedure discussed below. After pelletizing, the pelletized material may be extruded or coextruded to form regrind layer, or to form a co-extruded structure comprising one or more of the externally facing layer, the thermoplastic hot melt adhesive layer, the tie layer, or the elastomeric layer.

The regrind layer can be formed by grinding a composition containing a polymeric hydrogel under conditions such that the polymeric hydrogel is maintained at a grinding temperature being below its melting point, forming a ground material. Additionally or alternatively, the polymeric hydrogel can be maintained at the grinding temperature being below a softening point of the polymeric hydrogel.

Now having described aspects of the hydrogel material, the elastomer material, the thermoplastic hot melt adhesive, and the tie layer, additional details are provided regarding the thermoplastic polymer. The thermoplastic polymer can include polymers of the same or different types of monomers (e.g., homopolymers and copolymers, including terpolymers). The thermoplastic polymer can include different monomers randomly distributed in the polymer (e.g., a random co-polymer). The term "polymer" refers to a polymerized molecule having one or more monomer species that can be the same or different. When the monomer species are the same, the polymer can be termed homopolymer and when the monomers are different, the polymer can be referred to as a copolymer. The term "copolymer" is a polymer having two or more types of monomer species, and includes terpolymers (i.e., copolymers having three monomer species). The "monomer" can include different functional groups or segments, but for simplicity is generally referred to as a monomer.

For example, the thermoplastic polymer can be a polymer having repeating polymeric units of the same chemical structure (segments) which are relatively harder (hard segments), and repeating polymeric segments which are relatively softer (soft segments). The polymer has repeating hard segments and soft segments, physical crosslinks can be present within the segments or between the segments or both within and between the segments. Particular examples of hard segments include isocyanate segments. Particular examples of soft segments include an alkoxy group such as polyether segments and polyester segments. As used herein, the polymeric segment can be referred to as being a particular type of polymeric segment such as, for example, an isocyanate segment (e.g., diisocyante segment), an alkoky polyamide segment (e.g., a polyether segment, a polyester segment), and the like. It is understood that the chemical structure of the segment is derived from the described chemical structure. For example, an isocyanate segment is a polymerized unit including an isocyanate functional group. When referring to polymeric segments of a particular chemical structure, the polymer can contain up to 10 mol percent of segments of other chemical structures. For example, as used herein, a polyether segment is understood to include up to 10 mol percent of non-polyether segments.

The thermoplastic polymer can be a thermoplastic polyurethane (also referred to as "TPU"). The thermoplastic polyurethane can be a thermoplastic polyurethane polymer. The thermoplastic polyurethane polymer can include hard and soft segments. The hard segments can comprise or consist of isocyanate segments (e.g., diisocyanate segments). In the same or alternative aspects, the soft segments can comprise or consist of alkoxy segments (e.g., polyether segments, or polyester segments, or a combination of polyether segments and polyester segments). The thermoplastic material can comprise or consist essentially of an elastomeric thermoplastic polyurethane having repeating hard segments and repeating soft segments.

Thermoplastic Polyurethanes

One or more of the thermoplastic polyurethanes can be produced by polymerizing one or more isocyanates with one or more polyols to produce polymer chains having carbamate linkages (—N(CO)O—) as illustrated below in Formula 1, where the isocyanate(s) each preferably include two or more isocyanate (—NCO) groups per molecule, such as 2, 3, or 4 isocyanate groups per molecule (although, single-functional isocyanates can also be optionally included, e.g., as chain terminating units).

(Formula 1)

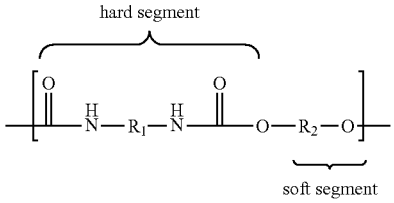

In these embodiments, each $R_1$ and $R_2$ independently is an aliphatic or aromatic segment. Optionally, each $R_2$ can be a hydrophilic segment.

Additionally, the isocyanates can also be chain extended with one or more chain extenders to bridge two or more isocyanates. This can produce polyurethane polymer chains as illustrated below in Formula 2, where $R_3$ includes the chain extender. As with each $R_1$ and $R_3$, each $R_3$ independently is an aliphatic or aromatic segment.

(Formula 2)

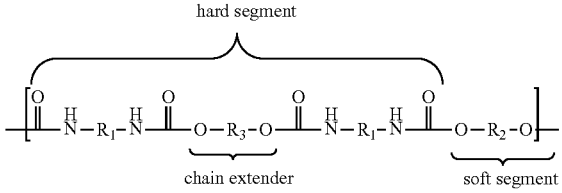

Each segment $R_1$, or the first segment, in Formulas 1 and 2 can independently include a linear or branched $C_{3-30}$ segment, based on the particular isocyanate(s) used, and can be aliphatic, aromatic, or include a combination of aliphatic portions(s) and aromatic portion(s). The term "aliphatic" refers to a saturated or unsaturated organic molecule that does not include a cyclically conjugated ring system having delocalized pi electrons. In comparison, the term "aromatic" refers to a cyclically conjugated ring system having delocalized pi electrons, which exhibits greater stability than a hypothetical ring system having localized pi electrons.

Each segment $R_1$ can be present in an amount of 5 percent to 85 percent by weight, from 5 percent to 70 percent by weight, or from 10 percent to 50 percent by weight, based on the total weight of the reactant monomers.

In aliphatic embodiments (from aliphatic isocyanate(s)), each segment $R_1$ can include a linear aliphatic group, a branched aliphatic group, a cycloaliphatic group, or combinations thereof. For instance, each segment $R_1$ can include a linear or branched $C_{3-20}$ alkylene segment (e.g., $C_{4-16}$ alkylene or $C_{6-10}$ alkylene), one or more $C_{3-8}$ cycloalkylene segments (e.g., cyclopropyl, cyclobutyl, cyclopentyl, cyclohexyl, cycloheptyl, or cyclooctyl), and combinations thereof.

Examples of suitable aliphatic diisocyanates for producing the polyurethane polymer chains include hexamethylene diisocyanate (HDI), isophorone diisocyanate (IPDI), butylenediisocyanate (BDI), bisisocyanatocyclohexylmethane (HMDI), 2,2,4-trimethylhexamethylene diisocyanate ($T_m$DI), bisisocyanatomethylcyclohexane, bisisocyanatomethyltricyclodecane, norbornane diisocyanate (NDI), cyclohexane diisocyanate (CHDI), 4,4'-dicyclohexylmethane diisocyanate (H12MDI), diisocyanatododecane, lysine diisocyanate, and combinations thereof.

The diisocyanate segments can include aliphatic diisocyanate segments. A majority of the diisocyanate segments comprise the aliphatic diisocyanate segments. At least 90 percent of the diisocyanate segments are aliphatic diisocyanate segments. The diisocyanate segments consist essentially of aliphatic diisocyanate segments. The aliphatic diisocyanate segments are substantially (e.g., about 50 percent or more, about 60 percent or more, about 70 percent or more, about 80 percent or more, about 90 percent or more) linear aliphatic diisocyanate segments. At least 80 percent of the aliphatic diisocyanate segments are aliphatic diisocyanate segments that are free of side chains. The aliphatic diisocyanate segments include $C_2$-$C_{10}$ linear aliphatic diisocyanate segments.

In aromatic embodiments (from aromatic isocyanate(s)), each segment $R_1$ can include one or more aromatic groups, such as phenyl, naphthyl, tetrahydronaphthyl, phenanthrenyl, biphenylenyl, indanyl, indenyl, anthracenyl, and fluorenyl. Unless otherwise indicated, an aromatic group can be an unsubstituted aromatic group or a substituted aromatic group, and can also include heteroaromatic groups. "Heteroaromatic" refers to monocyclic or polycyclic (e.g., fused bicyclic and fused tricyclic) aromatic ring systems, where one to four ring atoms are selected from oxygen, nitrogen, or sulfur, and the remaining ring atoms are carbon, and where the ring system is joined to the remainder of the molecule by any of the ring atoms. Examples of suitable heteroaryl groups include pyridyl, pyrazinyl, pyrimidinyl, pyrrolyl, pyrazolyl, imidazolyl, thiazolyl, tetrazolyl, oxazolyl, isooxazolyl, thiadiazolyl, oxadiazolyl, furanyl, quinolinyl, isoquinolinyl, benzoxazolyl, benzimidazolyl, and benzothiazolyl.

Examples of suitable aromatic diisocyanates for producing the polyurethane polymer chains include toluene diisocyanate (TDI), TDI adducts with trimethyloylpropane ($T_m$P), methylene diphenyl diisocyanate (MDI), xylene diisocyanate (XDI), tetramethylxylylene diisocyanate ($T_m$XDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the polymer chains are substantially free of aromatic groups.

The polyurethane polymer chains can be produced from diisocynates including HMDI, TDI, MDI, $H_{12}$ aliphatics, and combinations thereof. For example, the low processing temperature polymeric composition of the present disclosure can comprise one or more polyurethane polymer chains are produced from diisocynates including HMDI, TDI, MDI, $H_{12}$ aliphatics, and combinations thereof.

Polyurethane chains which are crosslinked (e.g., partially crosslinked polyurethane polymers which retain thermoplastic properties) or which can be crosslinked, can be used in accordance with the present disclosure. It is possible to produce crosslinked or crosslinkable polyurethane polymer chains using multi-functional isocyantes. Examples of suitable triisocyanates for producing the polyurethane polymer chains include TDI, HDI, and IPDI adducts with trimethyloylpropane ($T_m$P), uretdiones (i.e., dimerized isocyanates), polymeric MDI, and combinations thereof.

Segment $R_3$ in Formula 2 can include a linear or branched $C_2$-$C_{10}$ segment, based on the particular chain extender polyol used, and can be, for example, aliphatic, aromatic, or polyether. Examples of suitable chain extender polyols for producing the polyurethane polymer chains include ethylene glycol, lower oligomers of ethylene glycol (e.g., diethylene glycol, triethylene glycol, and tetraethylene glycol), 1,2-propylene glycol, 1,3-propylene glycol, lower oligomers of propylene glycol (e.g., dipropylene glycol, tripropylene glycol, and tetrapropylene glycol), 1,4-butylene glycol, 2,3-butylene glycol, 1,6-hexanediol, 1,8-octanediol, neopentyl glycol, 1,4-cyclohexanedimethanol, 2-ethyl-1,6-hexanediol, 1-methyl-1,3-propanediol, 2-methyl-1,3-propanediol, dihydroxyalkylated aromatic compounds (e.g., bis(2-hydroxyethyl) ethers of hydroquinone and resorcinol, xylene-a,a-diols, bis(2-hydroxyethyl) ethers of xylene-a,a-diols, and combinations thereof.

Segment $R_2$ in Formula 1 and 2 can include a polyether group, a polyester group, a polycarbonate group, an aliphatic group, or an aromatic group. Each segment $R_2$ can be present in an amount of 5 percent to 85 percent by weight, from 5 percent to 70 percent by weight, or from 10 percent to 50 percent by weight, based on the total weight of the reactant monomers.

In some examples, at least one $R_2$ segment of the thermoplastic polyurethane includes a polyether segment (i.e., a segment having one or more ether groups). Suitable polyethers include, but are not limited to, polyethylene oxide (PEO), polypropylene oxide (PPO), polytetrahydrofuran (PTHF), polytetramethylene oxide (P $T_m$O), and combinations thereof. The term "alkyl" as used herein refers to straight chained and branched saturated hydrocarbon groups containing one to thirty carbon atoms, for example, one to twenty carbon atoms, or one to ten carbon atoms. The term $C_n$ means the alkyl group has "n" carbon atoms. For example, $C_4$ alkyl refers to an alkyl group that has 4 carbon atoms. $C_{1-7}$ alkyl refers to an alkyl group having a number of carbon atoms encompassing the entire range (i.e., 1 to 7 carbon atoms), as well as all subgroups (e.g., 1-6, 2-7, 1-5, 3-6, 1, 2, 3, 4, 6, and 7 carbon atoms). Non-limiting examples of alkyl groups include, methyl, ethyl, n-propyl, isopropyl, n-butyl, sec-butyl (2-methylpropyl), t-butyl (1,1-dimethylethyl), 3,3-dimethylpentyl, and 2-ethylhexyl. Unless otherwise indicated, an alkyl group can be an unsubstituted alkyl group or a substituted alkyl group.

In some examples of the thermoplastic polyurethane, the at least one $R_2$ segment includes a polyester segment. The polyester segment can be derived from the polyesterification of one or more dihydric alcohols (e.g., ethylene glycol, 1,3-propylene glycol, 1,2-propylene glycol, 1,4-butanediol, 1,3-butanediol, 2-methylpentanediol-1,5,diethylene glycol, 1,5-pentanediol, 1,5-hexanediol, 1,2-dodecanediol, cyclohexanedimethanol, and combinations thereof) with one or more dicarboxylic acids (e.g., adipic acid, succinic acid, sebacic acid, suberic acid, methyladipic acid, glutaric acid, pimelic acid, azelaic acid, thiodipropionic acid and citraconic acid and combinations thereof). The polyester also can be derived from polycarbonate prepolymers, such as poly (hexamethylene carbonate) glycol, poly(propylene carbonate) glycol, poly(tetramethylene carbonate)glycol, and poly (nonanemethylene carbonate) glycol. Suitable polyesters can include, for example, polyethylene adipate (PEA), poly (1,4-butylene adipate), poly(tetramethylene adipate), poly (hexamethylene adipate), polycaprolactone, polyhexamethylene carbonate, poly(propylene carbonate), poly (tetramethylene carbonate), poly(nonanemethylene carbonate), and combinations thereof.

In various of the thermoplastic polyurethanes, at least one $R_2$ segment includes a polycarbonate segment. The polycarbonate segment can be derived from the reaction of one or more dihydric alcohols (e.g., ethylene glycol, 1,3-propylene glycol, 1,2-propylene glycol, 1,4-butanediol, 1,3-butanediol, 2-methylpentanediol-1,5, diethylene glycol, 1,5-pentanediol, 1,5-hexanediol, 1,2-dodecanediol, cyclohexanedimethanol, and combinations thereof) with ethylene carbonate.

In various examples, the aliphatic group is linear and can include, for example, a $C_{1-20}$ chain or a $C_{1-20}$ alkenylene chain (e.g., methylene, ethylene, propylene, butylene, pentylene, hexylene, heptylene, octylene, nonylene, decylene, undecylene, dodecylene, tridecylene, ethenylene, propenylene, butenylene, pentenylene, hexenylene, heptenylene, octenylene, nonenylene, decenylene, undecenylene, dodecenylene, tridecenylene). The term "alkylene" refers to a bivalent hydrocarbon. The term $C_n$ means the alkylene group has "n" carbon atoms. For example, $C_{1-6}$ alkylene refers to an alkylene group having, e.g., 1, 2, 3, 4, 5, or 6 carbon atoms. The term "alkenylene" refers to a bivalent hydrocarbon having at least one double bond.

The aliphatic and aromatic groups can be substituted with one or more pendant relatively hydrophilic and/or charged groups. The pendant hydrophilic group includes one or more (e.g., 2, 3, 4, 5, 6, 7, 8, 9, 10 or more) hydroxyl groups. The pendant hydrophilic group includes one or more (e.g., 2, 3, 4, 5, 6, 7, 8, 9, 10 or more) amino groups. In some cases, the pendant hydrophilic group includes one or more (e.g., 2, 3, 4, 5, 6, 7, 8, 9, 10 or more) carboxylate groups. For example, the aliphatic group can include one or more polyacrylic acid group. In some cases, the pendant hydrophilic group includes one or more (e.g., 2, 3, 4, 5, 6, 7, 8, 9, 10 or more) sulfonate groups. In some cases, the pendant hydrophilic group includes one or more (e.g., 2, 3, 4, 5, 6, 7, 8, 9, 10 or more) phosphate groups. In some examples, the pendant hydrophilic group includes one or more ammonium groups (e.g., tertiary and/or quaternary ammonium). In other examples, the pendant hydrophilic group includes one or more zwitterionic groups (e.g., a betaine, such as poly (carboxybetaine (pCB) and ammonium phosphonate groups such as a phosphatidylcholine group).

The $R_2$ segment can include charged groups that are capable of binding to a counterion to ionically crosslink the thermoplastic polymer and form ionomers. For example, $R_2$ is an aliphatic or aromatic group having pendant amino, carboxylate, sulfonate, phosphate, ammonium, or zwitterionic groups, or combinations thereof.

In various cases when a pendant hydrophilic group is present, the pendant "hydrophilic" group is at least one polyether group, such as two polyether groups. In other cases, the pendant hydrophilic group is at least one polyester. In various cases, the pendant hydrophilic group is polylactone group (e.g., polyvinylpyrrolidone). Each carbon atom of the pendant hydrophilic group can optionally be substituted with, e.g., a $C_{1-6}$ alkyl group. The aliphatic and aromatic groups can be graft polymeric groups, wherein the pendant groups are homopolymeric groups (e.g., polyether groups, polyester groups, polyvinylpyrrolidone groups).

The pendant hydrophilic group is a polyether group (e.g., a polyethylene oxide group, a polyethylene glycol group), a polyvinylpyrrolidone group, a polyacrylic acid group, or combinations thereof.

The pendant hydrophilic group can be bonded to the aliphatic group or aromatic group through a linker. The linker can be any bifunctional small molecule (e.g., $C_{1-20}$) capable of linking the pendant hydrophilic group to the aliphatic or aromatic group. For example, the linker can include a diisocyanate group, as previously described herein, which when linked to the pendant hydrophilic group and to the aliphatic or aromatic group forms a carbamate bond. The linker can be 4,4'-diphenylmethane diisocyanate (MDI), as shown below.

(Formula 3)

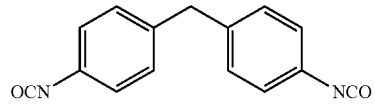

In some exemplary aspects, the pendant hydrophilic group is a polyethylene oxide group and the linking group is MDI, as shown below.

(Formula 4)

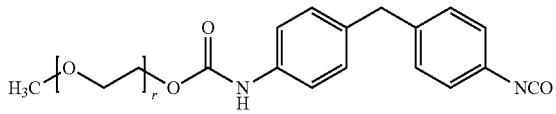

In some cases, the pendant hydrophilic group is functionalized to enable it to bond to the aliphatic or aromatic group, optionally through the linker. For example, when the pendant hydrophilic group includes an alkene group, which can undergo a Michael addition with a sulfhydryl-containing bifunctional molecule (i.e., a molecule having a second reactive group, such as a hydroxyl group or amino group), to result in a hydrophilic group that can react with the polymer backbone, optionally through the linker, using the second reactive group. For example, when the pendant hydrophilic group is a polyvinylpyrrolidone group, it can react with the sulfhydryl group on mercaptoethanol to result in hydroxyl-functionalized polyvinylpyrrolidone, as shown below.

(Formula 5)

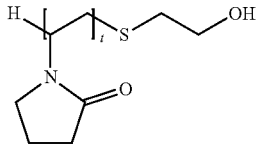

A least one $R_2$ segment includes a polytetramethylene oxide group. At least one $R_2$ segment can include an aliphatic polyol group functionalized with a polyethylene oxide group or polyvinylpyrrolidone group, such as the polyols described in E.P. Patent No. 2 462 908. For example, the $R_2$ segment can be derived from the reaction product of a polyol (e.g., pentaerythritol or 2,2,3-trihydroxypropanol) and either MDI-derivatized methoxypolyethylene glycol (to obtain compounds as shown in Formulas 6 or 7) or with MDI-derivatized polyvinylpyrrolidone (to obtain compounds as shown in Formulas 8 or 9) that had been previously been reacted with mercaptoethanol, as shown below.

(Formula 6)

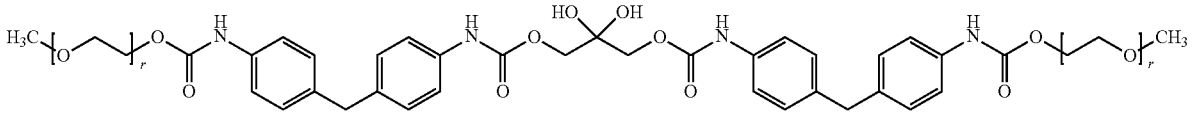

(Formula 7)

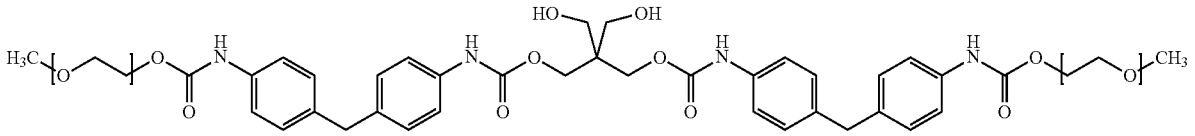

(Formula 8)

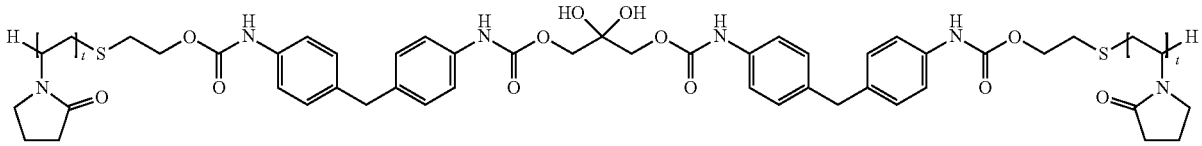

(Formula 9)

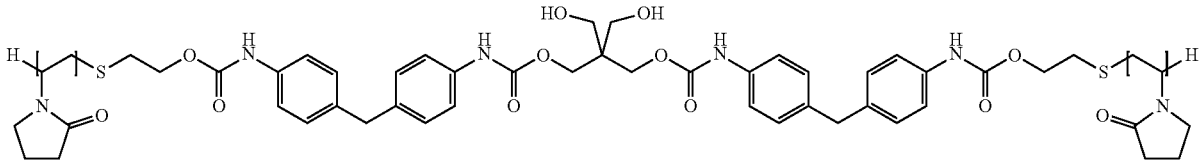

In various cases, at least one $R_2$ is a polysiloxane, In these cases, $R_2$ can be derived from a silicone monomer of Formula 10, such as a silicone monomer disclosed in U.S. Pat. No. 5,969,076, which is hereby incorporated by reference:

(Formula 10)

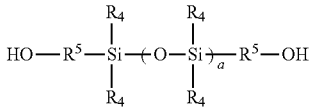

wherein: a is 1 to 10 or larger (e.g., 1, 2, 3, 4, 5, 6, 7, 8, 9, or 10); each $R_4$ independently is hydrogen, $C_{1-18}$ alkyl, $C_{2-18}$alkenyl, aryl, or polyether; and each $R_5$ independently is $C_{1-10}$ alkylene, polyether, or polyurethane.

Each $R_4$ independently can be a H, $C_{1-10}$ alkyl, $C_{2-10}$ alkenyl, $C_{1-6}$ aryl, polyethylene, polypropylene, or polybutylene group. For example, each $R_4$ can independently be selected from the group consisting of methyl, ethyl, n-propyl, isopropyl, n-butyl, isobutyl, s-butyl, t-butyl, ethenyl, propenyl, phenyl, and polyethylene groups.

Each $R^5$ can independently include a $C_{1-10}$ alkylene group (e.g., a methylene, ethylene, propylene, butylene, pentylene, hexylene, heptylene, octylene, nonylene, or decylene group). In other cases, each $R^5$ is a polyether group (e.g., a polyethylene, polypropylene, or polybutylene group). In various cases, each R5 is a polyurethane group.

Optionally, in some aspects, the polyurethane can include an at least partially crosslinked polymeric network that includes polymer chains that are derivatives of polyurethane. In such cases, it is understood that the level of crosslinking is such that the polyurethane retains thermoplastic properties (i.e., the crosslinked thermoplastic polyurethane can be softened or melted and re-solidified under the processing conditions described herein). This crosslinked polymeric network can be produced by polymerizing one or more isocyanates with one or more polyamino compounds, polysulfhydryl compounds, or combinations thereof, as shown in Formulas 11 and 12, below:

(Formula 11)

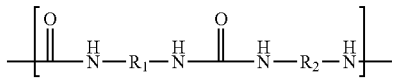

(Formula 12)

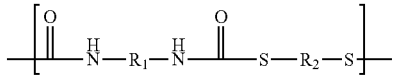

wherein the variables are as described above. Additionally, the isocyanates can also be chain extended with one or more polyamino or polythiol chain extenders to bridge two or more isocyanates, such as previously described for the polyurethanes of Formula 2.

As described herein, the thermoplastic polyurethane can be physically crosslinked through e.g., nonpolar or polar interactions between the urethane or carbamate groups on the polymers (the hard segments. Component $R_1$ in Formula 1, and components $R_1$ and $R_3$ in Formula 2, can form the portion of the polymer often referred to as the "hard segment", and component $R_2$ forms the portion of the polymer often referred to as the "soft segment". The soft segment can be covalently bonded to the hard segment. In some examples, the thermoplastic polyurethane having physically crosslinked hard and soft segments can be a hydrophilic thermoplastic polyurethane (i.e., a thermoplastic polyurethane including hydrophilic groups as disclosed herein).

Thermoplastic Polyamides

The thermoplastic polymer can comprise a thermoplastic polyamide. The thermoplastic polyamide can be a polyamide homopolymer having repeating polyamide segments of the same chemical structure. Alternatively, the polyamide can comprise a number of polyamide segments having different polyamide chemical structures (e.g., polyamide 6 segments, polyamide 11 segments, polyamide 12 segments, polyamide 66 segments, etc.). The polyamide segments having different chemical structure can be arranged randomly, or can be arranged as repeating blocks.

The thermoplastic polymers can be a block co-polyamide. For example, the block co-polyamide can have repeating hard segments, and repeating soft segments. The hard segments can comprise polyamide segments, and the soft segments can comprise non-polyamide segments. The thermoplastic polymers can be an elastomeric thermoplastic co-polyamide comprising or consisting of block co-polyamides having repeating hard segments and repeating soft segments. In block co-polymers, including block co-polymers having repeating hard segments and soft segments, physical crosslinks can be present within the segments or between the segments or both within and between the segments.

The thermoplastic polyamide can be a co-polyamide (i.e., a co-polymer including polyamide segments and non-polyamide segments). The polyamide segments of the co-polyamide can comprise or consist of polyamide 6 segments, polyamide 11 segments, polyamide 12 segments, polyamide 66 segments, or any combination thereof. The polyamide segments of the co-polyamide can be arranged randomly, or can be arranged as repeating segments. In a particular example, the polyamide segments can comprise or consist of polyamide 6 segments, or polyamide 12 segments, or both polyamide 6 segment and polyamide 12 segments. In the example where the polyamide segments of the co-polyamide include of polyamide 6 segments and polyamide 12 segments, the segments can be arranged randomly. The non-polyamide segments of the co-polyamide can comprise or consist of polyether segments, polyester segments, or both polyether segments and polyester segments. The co-polyamide can be a co-polyamide, or can be a random co-polyamide. The thermoplastic copolyamide can be formed from the polycodensation of a polyamide oligomer or pre-polymer with a second oligomer prepolymer to form a copolyamide (i.e., a co-polymer including polyamide segments. Optionally, the second prepolymer can be a hydrophilic prepolymer.

The thermoplastic polyamide itself, or the polyamide segment of the thermoplastic copolyamide can be derived from the condensation of polyamide prepolymers, such as lactams, amino acids, and/or diamino compounds with dicarboxylic acids, or activated forms thereof. The resulting polyamide segments include amide linkages (—(CO)NH—). The term "amino acid" refers to a molecule having at least one amino group and at least one carboxyl group. Each polyamide segment of the thermoplastic polyamide can be the same or different.

The thermoplastic polyamide or the polyamide segment of the thermoplastic copolyamide is derived from the polycondensation of lactams and/or amino acids, and includes an amide segment having a structure shown in Formula 13, below, wherein $R_6$ is the segment of the polyamide derived from the lactam or amino acid.

(Formula 13)

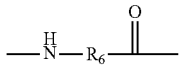

$R_6$ can be derived from a lactam. In some cases, $R_6$ is derived from a $C_{3-20}$ lactam, or a $C_{4-15}$ lactam, or a $C_{6-12}$ lactam. For example, $R_6$ can be derived from caprolactam or laurolactam. In some cases, $R_6$ is derived from one or more amino acids. In various cases, $R_6$ is derived from a $C_{4-25}$ amino acid, or a $C_{5-20}$ amino acid, or a $C_{8-15}$ amino acid. For example, $R_6$ can be derived from 12-aminolauric acid or 11-aminoundecanoic acid.

Optionally, in order to increase the relative degree of hydrophilicity of the thermoplastic copolyamide, Formula 13 can include a polyamide-polyether block copolymer segment, as shown below:

(Formula 14)

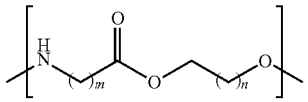

wherein m is 3-20, and n is 1-8. In some exemplary aspects, m is 4-15, or 6-12 (e.g., 6, 7, 8, 9, 10, 11, or 12), and n is 1, 2, or 3. For example, m can be 11 or 12, and n can be 1 or 3. The thermoplastic polyamide or the polyamide segment of the thermoplastic co-polyamide is derived from the condensation of diamino compounds with dicarboxylic acids, or activated forms thereof, and includes an amide segment having a structure shown in Formula 15, below, wherein $R_7$ is the segment of the polyamide derived from the diamino compound, $R_8$ is the segment derived from the dicarboxylic acid compound:

(Formula 15)

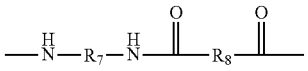

$R_7$ can be derived from a diamino compound that includes an aliphatic group having $C_{4-15}$ carbon atoms, or $C_{5-10}$ carbon atoms, or $C_{6-9}$ carbon atoms. The diamino compound can include an aromatic group, such as phenyl, naphthyl, xylyl, and tolyl. Suitable diamino compounds from which $R_7$ can be derived include, but are not limited to, hexamethylene diamine (HMD), tetramethylene diamine, trimethyl hexamethylene diamine ($T_mD$),m-xylylene diamine (MXD), and 1,5-pentamine diamine. $R_8$ can derived from a dicarboxylic acid or activated form thereof, includes an aliphatic group having $C_{4-15}$ carbon atoms, or $C_{5-12}$ carbon atoms, or $C_{6-10}$ carbon atoms. In some cases, the dicarboxylic acid or activated form thereof from which $R_8$ can be derived includes an aromatic group, such as phenyl, naphthyl, xylyl, and tolyl groups. Suitable carboxylic acids or activated forms thereof from which $R_8$ can be derived include, but are not limited to adipic acid, sebacic acid, terephthalic acid, and isophthalic acid. The polymer chains are substantially free of aromatic groups.

Each polyamide segment of the thermoplastic polyamide (including the thermoplastic copolyamide) can be independently derived from a polyamide prepolymer selected from the group consisting of 12-aminolauric acid, caprolactam, hexamethylene diamine and adipic acid.

The thermoplastic polyamide comprises or consists of a thermoplastic poly(ether-block-amide). The thermoplastic poly(ether-block-amide) can be formed from the polycondensation of a carboxylic acid terminated polyamide prepolymer and a hydroxyl terminated polyether prepolymer to form a thermoplastic poly(ether-block-amide), as shown in Formula 16:

(Formula 16)

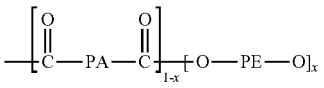

A disclosed poly(ether block amide) polymer is prepared by polycondensation of polyamide blocks containing reactive ends with polyether blocks containing reactive ends. Examples include, but are not limited to: 1) polyamide blocks containing diamine chain ends with polyoxyalkylene blocks containing carboxylic chain ends; 2) polyamide blocks containing dicarboxylic chain ends with polyoxyalkylene blocks containing diamine chain ends obtained by cyanoethylation and hydrogenation of aliphatic dihydroxylated alpha-omega polyoxyalkylenes known as polyether diols; 3) polyamide blocks containing dicarboxylic chain ends with polyether diols, the products obtained in this particular case being polyetheresteramides. The polyamide block of the thermoplastic poly(ether-block-amide) can be derived from lactams, amino acids, and/or diamino compounds with dicarboxylic acids as previously described. The polyether block can be derived from one or more polyethers selected from the group consisting of polyethylene oxide (PEO), polypropylene oxide (PPO), polytetrahydrofuran (PTHF), polytetramethylene oxide (PTMO), and combinations thereof.

Disclosed poly(ether block amide) polymers include those comprising polyamide blocks comprising dicarboxylic chain ends derived from the condensation of α,ω-aminocarboxylic acids, of lactams or of dicarboxylic acids and diamines in the presence of a chain-limiting dicarboxylic acid. In poly(ether block amide) polymers of this type, a α,ω-aminocarboxylic acid such as aminoundecanoic acid can be used; a lactam such as caprolactam or lauryllactam can be used; a dicarboxylic acid such as adipic acid, decanedioic acid or dodecanedioic acid can be used; and a diamine such as hexamethylenediamine can be used; or various combinations of any of the foregoing. The copolymer can comprise polyamide blocks comprising polyamide 12 or of polyamide 6.

Disclosed poly(ether block amide) polymers include those comprising polyamide blocks derived from the condensation of one or more α,ω-aminocarboxylic acids and/or of one or more lactams containing from 6 to 12 carbon atoms in the presence of a dicarboxylic acid containing from 4 to 12 carbon atoms, and are of low mass, i.e., they have an $M_n$ of from 400 to 1000. In poly(ether block amide) polymers of this type, a α,ω-aminocarboxylic acid such as aminoundecanoic acid or aminododecanoic acid can be used; a dicarboxylic acids such as adipic acid, sebacic acid, isophthalic acid, butanedioic acid, 1,4-cyclohexyldicarboxylic acid, terephthalic acid, the sodium or lithium salt of sulphoisophthalic acid, dimerized fatty acids (these dimerized fatty acids have a dimer content of at least 98 percent and are preferably hydrogenated) and dodecanedioic acid HOOC—$(CH_2)_{10}$—COOH can be used; and a lactam such as caprolactam and lauryllactam can be used; or various combinations of any of the foregoing. The copolymer comprises polyamide blocks obtained by condensation of lauryllactam in the presence of adipic acid or dodecanedioic acid and with a $M_n$ of 750 have a melting point of 127-130 degree Celsius. The various constituents of the polyamide block and their proportion can be chosen in order to obtain a melting point of less than 150 degree Celsius. and advantageously between 90 degree Celsius and 135 degree Celsius.

Disclosed poly(ether block amide) polymers include those comprising polyamide blocks derived from the condensation of at least one α,ω-aminocarboxylic acid (or a lactam), at least one diamine and at least one dicarboxylic acid. In copolymers of this type, a α,ω-aminocarboxylic acid, the lactam and the dicarboxylic acid can be chosen from those described herein above and the diamine such as an aliphatic diamine containing from 6 to 12 atoms and can be arylic and/or saturated cyclic such as, but not limited to, hexamethylenediamine, piperazine, 1-aminoethylpiperazine, bisaminopropylpiperazine, tetramethylenediamine, octamethylene-diamine, decamethylenediamine, dodecamethylenediamine, 1,5-diaminohexane, 2,2,4-trimethyl-1,6-diaminohexane, diamine polyols, isophoronediamine (IPD), methylpentamethylenediamine (MPDM), bis(aminocyclohexyl)methane (BACM) and bis(3-methyl-4-aminocyclohexyl)methane (BMACM) can be used.

The constituents of the polyamide block and their proportion can be chosen in order to obtain a melting point of less than 150 degree Celsius and advantageously between 90 degree Celsius and 135 degree Celsius. The various constituents of the polyamide block and their proportion can be chosen in order to obtain a melting point of less than 150 degree Celsius and advantageously between 90 degree Celsius and 135 degree Celsius.

The number average molar mass of the polyamide blocks can be from about 300 g/mol and about 15,000 g/mol, from about 500 g/mol and about 10,000 g/mol, from about 500 g/mol and about 6,000 g/mol, from about 500 g/mol to 5,000 g/mol, and from about 600 g/mol and about 5,000 g/mol. The number average molecular weight of the polyether block can range from about 100 g/mol to about 6,000 g/mol, from about 400 g/mol to 3000 g/mol and from about 200 g/mol to about 3,000 g/mol. The polyether (PE) content (x) of the poly(ether block amide) polymer can be from about 0.05 to about 0.8 (i.e., from about 5 mol percent to about 80 mol percent). The polyether blocks can be present from about 10 wt percent to about 50 wt percent, from about 20 wt percent to about 40 wt percent, and from about 30 wt percent to about 40 wt percent. The polyamide blocks can be present from about 50 wt percent to about 90 wt percent, from about 60 wt percent to about 80 wt percent, and from about 70 wt percent to about 90 wt percent.

The polyether blocks can contain units other than ethylene oxide units, such as, for example, propylene oxide or polytetrahydrofuran (which leads to polytetramethylene glycol sequences). It is also possible to use simultaneously PEG blocks, i.e. those consisting of ethylene oxide units, PPG blocks, i.e. those consisting of propylene oxide units, and P $T_m$G blocks, i.e. those consisting of tetramethylene glycol units, also known as polytetrahydrofuran. PPG or P $T_m$ G blocks are advantageously used. The amount of polyether blocks in these copolymers containing polyamide and polyether blocks can be from about 10 wt percent to about 50 wt percent of the copolymer and from about 35 wt percent to about 50 wt percent.

The copolymers containing polyamide blocks and polyether blocks can be prepared by any means for attaching the polyamide blocks and the polyether blocks. In practice, two processes are essentially used, one being a 2-step process and the other a one-step process.

In the two-step process, the polyamide blocks having dicarboxylic chain ends are prepared first, and then, in a second step, these polyamide blocks are linked to the polyether blocks. The polyamide blocks having dicarboxylic chain ends are derived from the condensation of polyamide precursors in the presence of a chain-stopper dicarboxylic acid. If the polyamide precursors are only lactams or α,ω-aminocarboxylic acids, a dicarboxylic acid is added. If the precursors already comprise a dicarboxylic acid, this is used in excess with respect to the stoichiometry of the diamines. The reaction usually takes place between 180 and 300 degree Celsius, preferably 200 to 290 degree Celsius, and the pressure in the reactor is set between 5 and 30 bar and maintained for approximately 2 to 3 hours. The pressure in the reactor is slowly reduced to atmospheric pressure and then the excess water is distilled off, for example for one or two hours.

Once the polyamide having carboxylic acid end groups has been prepared, the polyether, the polyol and a catalyst are then added. The total amount of polyether can be divided and added in one or more portions, as can the catalyst. The polyether is added first and the reaction of the OH end groups of the polyether and of the polyol with the COOH end groups of the polyamide starts, with the formation of ester linkages and the elimination of water. Water is removed as much as possible from the reaction mixture by distillation and then the catalyst is introduced in order to complete the linking of the polyamide blocks to the polyether blocks. This second step takes place with stirring, preferably under a vacuum of at least 50 mbar (5000 Pa) at a temperature such that the reactants and the copolymers obtained are in the molten state. By way of example, this temperature can be between 100 and 400 degree Celsius and usually between 200 and 250 degree Celsius. The reaction is monitored by measuring the torque exerted by the polymer melt on the stirrer or by measuring the electric power consumed by the stirrer. The end of the reaction is determined by the value of the torque or of the target power. The catalyst is defined as being any product which promotes the linking of the polyamide blocks to the polyether blocks by esterification. Advantageously, the catalyst is a derivative of a metal (M) chosen from the group formed by titanium, zirconium and hafnium. The derivative can be prepared from a tetraalkoxides consistent with the general formula $M(OR)_4$, in which M represents titanium, zirconium or hafnium and R, which can be identical or different, represents linear or branched alkyl radicals having from 1 to 24 carbon atoms.

The catalyst can comprise a salt of the metal (M), particularly the salt of (M) and of an organic acid and the complex salts of the oxide of (M) and/or the hydroxide of (M) and an organic acid. The organic acid can be formic acid, acetic acid, propionic acid, butyric acid, valeric acid, caproic acid, caprylic acid, lauric acid, myristic acid, palmitic acid, stearic acid, oleic acid, linoleic acid, linolenic acid, cyclohexanecarboxylic acid, phenylacetic acid, benzoic acid, salicylic acid, oxalic acid, malonic acid, succinic acid, glutaric acid, adipic acid, maleic acid, fumaric acid, phthalic acid and crotonic acid. Acetic and propionic acids are particularly preferred. M can be zirconium and such salts are called zirconyl salts, e.g., the commercially available product sold under the name zirconyl acetate.

The weight proportion of catalyst varies from about 0.01 to about 5 percent of the weight of the mixture of the dicarboxylic polyamide with the polyetherdiol and the polyol. The weight proportion of catalyst varies from about 0.05 to about 2 percent of the weight of the mixture of the dicarboxylic polyamide with the polyetherdiol and the polyol.

In the one-step process, the polyamide precursors, the chain stopper and the polyether are blended together; what is then obtained is a polymer having essentially polyether blocks and polyamide blocks of very variable length, but also the various reactants that have reacted randomly, which are distributed randomly along the polymer chain. They are the same reactants and the same catalyst as in the two-step process described above. If the polyamide precursors are only lactams, it is advantageous to add a little water. The copolymer has essentially the same polyether blocks and the same polyamide blocks, but also a small portion of the various reactants that have reacted randomly, which are distributed randomly along the polymer chain. As in the first step of the two-step process described above, the reactor is closed and heated, with stirring. The pressure established is between 5 and 30 bar. When the pressure no longer changes, the reactor is put under reduced pressure while still maintaining vigorous stirring of the molten reactants. The reaction is monitored as previously in the case of the two-step process.

The proper ratio of polyamide to polyether blocks can be found in a single poly(ether block amide), or a blend of two or more different composition poly(ether block amide)s can be used with the proper average composition. It can be useful to blend a block copolymer having a high level of polyamide groups with a block copolymer having a higher level of polyether blocks, to produce a blend having an average level of polyether blocks of about 20 to 40 wt percent of the total blend of poly(amid-block-ether) copolymers, and preferably about 30 to 35 wt percent. The copolymer comprises a blend of two different poly(ether-block-amide)s comprising at least one block copolymer having a level of polyether blocks below about 35 wt percent, and a second poly(ether-block-amide) having at least about 45 wt percent of polyether blocks.

The thermoplastic polymer is a polyamide or a poly(ether-block-amide) with a melting temperature ($T_m$) from about 90 degree Celsius to about 120 degree Celsius when determined in accordance with AS $T_m$ D3418-97 as described herein below. The thermoplastic polymer is a polyamide or a poly(ether-block-amide) with a melting temperature ($T_m$) from about 93 degree Celsius to about 99 degree Celsius when determined in accordance with AS $T_m$ D3418-97 as described herein below. The thermoplastic polymer can be a polyamide or a poly(ether-block-amide) with a melting temperature ($T_m$) from about 112 degree Celsius to about 118 degree Celsius when determined in accordance with AS $T_m$ D3418-97 as described herein below. The thermoplastic polymer can be a polyamide or a poly(ether-block-amide) with a melting temperature of about 90 degree Celsius, about 91 degree Celsius, about 92 degree Celsius, about 93 degree Celsius, about 94 degree Celsius, about 95 degree Celsius, about 96 degree Celsius, about 97 degree Celsius, about 98 degree Celsius, about 99 degree Celsius, about 100 degree Celsius, about 101 degree Celsius, about 102 degree Celsius, about 103 degree Celsius, about 104 degree Celsius, about 105 degree Celsius, about 106 degree Celsius, about 107 degree Celsius, about 108 degree Celsius, about 109 degree Celsius, about 110 degree Celsius, about 111 degree Celsius, about 112 degree Celsius, about 113 degree Celsius, about 114 degree Celsius, about 115 degree Celsius, about 116 degree Celsius, about 117 degree Celsius, about 118 degree Celsius, about 119 degree Celsius, about 120 degree Celsius, any range of melting temperature ($T_m$) values encompassed by any of the foregoing values, or any combination of the foregoing melting temperature ($T_m$) values, when determined in accordance with AS $T_m$ D3418-97 as described herein below.

The thermoplastic polymer is a polyamide or a poly(ether-block-amide) with a glass transition temperature ($T_g$) from about −20 degree Celsius to about 30 degree Celsius when determined in accordance with AS $T_m$ D3418-97 as described herein below. The thermoplastic polymer is a polyamide or a poly(ether-block-amide) with a glass transition temperature ($T_g$) from about −13 degree Celsius to about −7 degree Celsius when determined in accordance with AS $T_m$ D3418-97 as described herein below. The thermoplastic polymer is a polyamide or a poly(ether-block-amide) with a glass transition temperature ($T_g$) from about 17 degree Celsius to about 23 degree Celsius when determined in accordance with AS $T_m$D3418-97 as described herein below. The thermoplastic polymer can be a polyamide or a poly(ether-block-amide) with a glass transition temperature ($T_g$) of about −20 degree Celsius, about −19 degree Celsius, about −18 degree Celsius, about −17 degree Celsius, about −16 degree Celsius, about −15 degree Celsius, about −14 degree Celsius, about −13 degree Celsius, about −12 degree Celsius, about −10 degree Celsius, about −9 degree Celsius, about −8 degree Celsius, about −7 degree Celsius, about −6 degree Celsius, about −5 degree Celsius, about −4 degree Celsius, about −3 degree Celsius, about −2 degree Celsius, about −1 degree Celsius, about 0 degree Celsius, about 1 degree Celsius, about 2 degree Celsius, about 3 degree Celsius, about 4 degree Celsius, about 5 degree Celsius, about 6 degree Celsius, about 7 degree Celsius, about 8 degree Celsius, about 9 degree Celsius, about 10 degree Celsius, about 11 degree Celsius, about 12 degree Celsius, about 13 degree Celsius, about 14 degree Celsius, about 15 degree Celsius, about 16 degree Celsius, about 17 degree Celsius, about 18 degree Celsius, about 19 degree Celsius, about degree Celsius, any range of glass transition temperature values encompassed by any of the foregoing values, or any combination of the foregoing glass transition temperature values, when determined in accordance with AS $T_m$ D3418-97 as described herein below.

The thermoplastic polymer can be a polyamide or a poly(ether-block-amide) with a melt flow index from about 10 centimeter cubed/10 minute to about 30 centimeter cubed/10 minute when tested in accordance with AS $T_m$ D1238-13 as described herein below at 160 degree Celsius using a weight of 2.16 kg. The thermoplastic polymer can be a polyamide or a poly(ether-block-amide) with a melt flow index from about 22 centimeter cubed/10 minute to about 28 centimeter cubed/10 minute when tested in accordance with AS $T_m$D1238-13 as described herein below at 160 degree Celsius using a weight of 2.16 kg. The thermoplastic polymer is a polyamide or a poly(ether-block-amide) with a melt flow index of about 10 centimeter cubed/10 minute, about 11 centimeter cubed/10 minute, about 12 centimeter cubed/10 minute, about 13 centimeter cubed/10 minute, about 14 centimeter cubed/10 minute, about 15 centimeter cubed/10 minute, about 16 centimeter cubed/10 minute, about 17 centimeter cubed/10 minute, of about 18 centimeter cubed/10 minute, about 19 centimeter cubed/10 minute, of about 20 centimeter cubed/10 minute, about 21 centimeter cubed/10 minute, about 22 centimeter cubed/10 minute, about 23 centimeter cubed/10 minute, about 24 centimeter cubed/10 minute, about 25 centimeter cubed/10 minute, about 26 centimeter cubed/10 minute, about 27 centimeter cubed/10 minute, of about 28 centimeter cubed/10 minute, about 29 centimeter cubed/10 minute, of about 30 centimeter cubed/10 minute, any range of melt flow index values encompassed by any of the foregoing values, or any combination of the foregoing melt flow index values, when determined in accordance with AS $T_m$D1238-13 as described herein below at 160 degree Celsius using a weight of 2.16 kg.

The thermoplastic polymer is a polyamide or a poly(ether-block-amide) with a cold Ross flex test result of about 120,000 to about 180,000 when tested on a thermoformed plaque of the polyamide or the poly(ether-block-amide) in accordance with the cold Ross flex test as described herein below. The thermoplastic polymer is a polyamide or a poly(ether-block-amide) with a cold Ross flex test result of about 140,000 to about 160,000 when tested on a thermoformed plaque of the polyamide or the poly(ether-block-amide) in accordance with the cold Ross flex test as described herein below. The thermoplastic polymer is a polyamide or a poly(ether-block-amide) with a cold Ross flex test result of about 130,000 to about 170,000 when tested on a thermoformed plaque of the polyamide or the poly(ether-block-amide) in accordance with the cold Ross flex test as described herein below. The thermoplastic polymer is a polyamide or a poly(ether-block-amide) with a cold Ross flex test result of about 120,000, about 125,000, about 130,000, about 135,000, about 140,000, about 145,000, about 150,000, about 155,000, about 160,000, about 165,000, about 170,000, about 175,000, about 180,000, any range of cold Ross flex test values encompassed by any of the foregoing values, or any combination of the foregoing cold Ross flex test values, when tested on a thermoformed plaque of the polyamide or the poly(ether-block-amide) in accordance with the cold Ross flex test as described herein below.

The thermoplastic polymer is a polyamide or a poly(ether-block-amide) with a modulus from about 5 megaPascals to about 100 megaPascals when determined on a thermoformed plaque in accordance with AS $T_m$ D412-98 Standard Test Methods for Vulcanized Rubber and Thermoplastic Rubbers and Thermoplastic Elastomers-Tension with modifications described herein below. The thermoplastic polymer is a polyamide or a poly(ether-block-amide) with a modulus from about 20 megaPascals to about 80 megaPascals when determined on a thermoformed plaque in accordance with AS $T_m$D412-98 Standard Test Methods for Vulcanized Rubber and Thermoplastic Rubbers and Thermoplastic Elastomers-Tension with modifications described herein below. The thermoplastic polymer is a polyamide or a poly(ether-block-amide) with a modulus of about 5 megaPascals, about 10 megaPascals, about 15 megaPascals, about 20 megaPascals, about 25 megaPascals, about 30 megaPascals, about 35 megaPascals, about 40 megaPascals, about 45 megaPascals, about 50 megaPascals, about 55 megaPascals, about 60 megaPascals, about 65 megaPascals, about 70 megaPascals, about 75 megaPascals, about 80 megaPascals, about 85 megaPascals, about 90 megaPascals, about 95 megaPascals, about 100 megaPascals, any range of modulus values encompassed by any of the foregoing values, or any combination of the foregoing modulus values, when tested on a thermoformed plaque of the polyamide or the poly(ether-block-amide) in accordance with AS $T_m$D412-98 Standard Test Methods for Vulcanized Rubber and Thermoplastic Rubbers and Thermoplastic Elastomers-Tension with modifications described herein below.

The thermoplastic polymer is a polyamide or a poly(ether-block-amide) with a melting temperature ($T_m$) of about 115 degree Celsius when determined in accordance with AS $T_m$ D3418-97 as described herein below; a glass transition temperature ($T_g$) of about −10 degree Celsius when determined in accordance with AS $T_m$ D3418-97 as described herein below; a melt flow index of about 25 centimeter cubed/10 min when tested in accordance with AS $T_m$ D1238-13 as described herein below at 160 degree Celsius using a weight of 2.16 kg; a cold Ross flex test result of about 150,000 when tested on a thermoformed plaque in accordance with the cold Ross flex test as described herein below; and a modulus from about 25 megaPascals to about 70 megaPascals when determined on a thermoformed plaque in accordance with AS $T_m$ D412-98 Standard Test Methods for Vulcanized Rubber and Thermoplastic Rubbers and Thermoplastic Elastomers-Tension with modifications described herein below.

The thermoplastic polymer is a polyamide or a poly(ether-block-amide) with a melting temperature ($T_m$) of about 96 degree Celsius when determined in accordance with AS $T_m$ D3418-97 as described herein below; a glass transition temperature ($T_g$) of about 20 degree Celsius when determined in accordance with AS $T_m$D3418-97 as described herein below; a cold Ross flex test result of about 150,000 when tested on a thermoformed plaque in accordance with the cold Ross flex test as described herein below; and a modulus of less than or equal to about 10 megaPascals a when determined on a thermoformed plaque in accordance with AS $T_m$D412-98 Standard Test Methods for Vulcanized Rubber and Thermoplastic Rubbers and Thermoplastic Elastomers-Tension with modifications described herein below.

The thermoplastic polymer is a polyamide or a poly(ether-block-amide) is a mixture of a first polyamide or a poly (ether-block-amide) with a melting temperature ($T_m$) of about 115 degree Celsius when determined in accordance with AS $T_m$D3418-97 as described herein below; a glass transition temperature ($T_g$) of about −10 degree Celsius when determined in accordance with AS $T_m$D3418-97 as described herein below; a melt flow index of about 25 centimeter cubed/10 min when tested in accordance with AS $T_m$D1238-13 as described herein below at 160 degree Celsius using a weight of 2.16 kg; a cold Ross flex test result of about 150,000 when tested on a thermoformed plaque in accordance with the cold Ross flex test as described herein below; and a modulus from about 25 megaPascals to about 70 megaPascals when determined on a thermoformed plaque in accordance with AS $T_m$D412-98 Standard Test Methods for Vulcanized Rubber and Thermoplastic Rubbers and Thermoplastic Elastomers-Tension with modifications described herein below; and a second polyamide or a poly(ether-block-amide) with a melting temperature ($T_m$) of about 96 degree Celsius when determined in accordance with AS $T_m$D3418-97 as described herein below; a glass transition temperature ($T_g$) of about 20 degree Celsius when determined in accordance with AS $T_m$D3418-97 as described herein below; a cold Ross flex test result of about 150,000 when tested on a thermoformed plaque in accordance with the cold Ross flex test as described herein below; and a modulus of less than or equal to about 10 megaPascals a when determined on a thermoformed plaque in accordance with AS $T_m$ D412-98 Standard Test Methods for Vulcanized Rubber and Thermoplastic Rubbers and Thermoplastic Elastomers-Tension with modifications described herein below.

Exemplary commercially available copolymers include, but are not limited to, those available under the tradenames of VESTAMID® (Evonik Industries); PLATAMID® (Arkema), e.g., product code H2694; PEBAX® (Arkema), e.g., product code "PEBAX MH1657" and "PEBAX MV1074"; PEBAX® RNEW (Arkema); GRILAMID® (EMS-Chemie AG), or also to other similar materials produced by various other suppliers.

In some examples, the thermoplastic polyamide is physically crosslinked through, e.g., nonpolar or polar interactions between the polyamide groups of the polymers. In examples where the thermoplastic polyamide is a thermoplastic copolyamide, the thermoplastic copolyamide can be physically crosslinked through interactions between the polyamide groups, an optionally by interactions between the copolymer groups. When the thermoplastic copolyamide is physically crosslinked thorough interactions between the polyamide groups, the polyamide segments can form the portion of the polymer referred to as the "hard segment", and copolymer segments can form the portion of the polymer referred to as the "soft segment". For example, when the thermoplastic copolyamide is a thermoplastic poly(ether-block-amide), the polyamide segments form the hard segment portion of the polymer, and polyether segments can form the soft segment portion of the polymer. Therefore, in some examples, the thermoplastic polymer can include a physically crosslinked polymeric network having one or more polymer chains with amide linkages.

The polyamide segment of the thermoplastic co-polyamide includes polyamide-11 or polyamide-12 and the polyether segment is a segment selected from the group consisting of polyethylene oxide, polypropylene oxide, and polytetramethylene oxide segments, and combinations thereof.

Optionally, the thermoplastic polyamide can be partially covalently crosslinked, as previously described herein. In such cases, it is to be understood that the degree of crosslinking present in the thermoplastic polyamide is such that, when it is thermally processed in the form of a yarn or fiber to form the articles of footwear of the present disclosure, the partially covalently crosslinked thermoplastic polyamide retains sufficient thermoplastic character that the partially covalently crosslinked thermoplastic polyamide is softened or melted during the processing and re-solidifies.

Thermoplastic Polyesters

The thermoplastic polymers can comprise a thermoplastic polyester. The thermoplastic polyester can be formed by reaction of one or more carboxylic acids, or its ester-forming derivatives, with one or more bivalent or multivalent aliphatic, alicyclic, aromatic or araliphatic alcohols or a bisphenol. The thermoplastic polyester can be a polyester homopolymer having repeating polyester segments of the same chemical structure. Alternatively, the polyester can comprise a number of polyester segments having different polyester chemical structures (e.g., polyglycolic acid segments, polylactic acid segments, polycaprolactone segments, polyhydroxyalkanoate segments, polyhydroxybutyrate segments, etc.). The polyester segments having different chemical structure can be arranged randomly, or can be arranged as repeating blocks.

Exemplary carboxylic acids that that can be used to prepare a thermoplastic polyester include, but are not limited to, adipic acid, pimelic acid, suberic acid, azelaic acid, sebacic acid, nonane dicarboxylic acid, decane dicarboxylic acid, undecane dicarboxylic acid, terephthalic acid, isophthalic acid, alkyl-substituted or halogenated terephthalic acid, alkyl-substituted or halogenated isophthalic acid, nitroterephthalic acid, 4,4'-diphenyl ether dicarboxylic acid, 4,4'-diphenyl thioether dicarboxylic acid, 4,4'-diphenyl sulfonedicarboxylic acid, 4,4'-diphenyl alkylenedicarboxylic acid, naphthalene-2,6-dicarboxylic acid, cyclohexane-1,4-dicarboxylic acid and cyclohexane-1,3-dicarboxylic acid. Exemplary diols or phenols suitable for the preparation of the thermoplastic polyester include, but are not limited to, ethylene glycol, diethylene glycol, 1,3-propanediol, 1,4-butanediol, 1,6-hexanediol, 1,8-octanediol, 1,10-decanediol, 1,2-propanediol, 2,2-dimethyl-1,3-propanediol, 2,2,4-trimethylhexanediol, p-xylenediol, 1,4-cyclohexanediol, 1,4-cyclohexane dimethanol, and bisphenol A.

The thermoplastic polyester is a polybutylene terephthalate (PBT), a polytrimethylene terephthalate, a polyhexamethylene terephthalate, a poly-1,4-dimethylcyclohexane terephthalate, a polyethylene terephthalate (PET), a polyethylene isophthalate (PEI), a polyarylate (PAR), a polybutylene naphthalate (PBN), a liquid crystal polyester, or a blend or mixture of two or more of the foregoing.

The thermoplastic polyester can be a co-polyester (i.e., a co-polymer including polyester segments and non-polyester segments). The co-polyester can be an aliphatic co-polyester (i.e., a co-polyester in which both the polyester segments and the non-polyester segments are aliphatic). Alternatively, the co-polyester can include aromatic segments. The polyester segments of the co-polyester can comprise or consist of polyglycolic acid segments, polylactic acid segments, polycaprolactone segments, polyhydroxyalkanoate segments, polyhydroxybutyrate segments, or any combination thereof. The polyester segments of the co-polyester can be arranged randomly, or can be arranged as repeating blocks.

For example, the thermoplastic polyester can be a block co-polyester having repeating blocks of polymeric units of the same chemical structure (segments) which are relatively harder (hard segments), and repeating blocks of polymeric segments which are relatively softer (soft segments). In block co-polyesters, including block co-polyesters having repeating hard segments and soft segments, physical cross-links can be present within the blocks or between the blocks or both within and between the blocks. In a particular example, the thermoplastic material can comprise or consist essentially of an elastomeric thermoplastic co-polyester having repeating blocks of hard segments and repeating blocks of soft segments.

The non-polyester segments of the co-polyester can comprise or consist of polyether segments, polyamide segments, or both polyether segments and polyamide segments. The co-polyester can be a block co-polyester, or can be a random co-polyester. The thermoplastic co-polyester can be formed from the polycodensation of a polyester oligomer or prepolymer with a second oligomer prepolymer to form a block copolyester. Optionally, the second prepolymer can be a hydrophilic prepolymer. For example, the co-polyester can be formed from the polycondensation of terephthalic acid or naphthalene dicarboxylic acid with ethylene glycol, 1,4-butanediol, or 1-3 propanediol. Examples of co-polyesters include polyethelene adipate, polybutylene succinate, poly (3-hydroxbutyrate-co-3-hydroxyvalerate), polyethylene terephthalate, polybutylene terephthalate, polytrimethylene terephthalate, polyethylene napthalate, and combinations thereof. In a particular example, the co-polyamide can comprise or consist of polyethylene terephthalate.

The thermoplastic polyester is a block copolymer comprising segments of one or more of polybutylene terephthalate (PBT), a polytrimethylene terephthalate, a polyhexamethylene terephthalate, a poly-1,4-dimethylcyclohexane terephthalate, a polyethylene terephthalate (PET), a polyethylene isophthalate (PEI), a polyarylate (PAR), a polybutylene naphthalate (PBN), and a liquid crystal polyester. For example, a suitable thermoplastic polyester that is a block copolymer can be a PET/PEI copolymer, a polybutylene terephthalate/tetraethylene glycol copolymer, a polyoxyalkylenediimide diacid/polybutylene terephthalate copolymer, or a blend or mixture of any of the foregoing.

The thermoplastic polyester is a biodegradable resin, for example, a copolymerized polyester in which poly(α-hydroxy acid) such as polyglycolic acid or polylactic acid is contained as principal repeating units.

The disclosed thermoplastic polyesters can be prepared by a variety of polycondensation methods known to the skilled artisan, such as a solvent polymerization or a melt polymerization process.

Thermoplastic Polyolefins

The thermoplastic polymers can comprise or consist essentially of a thermoplastic polyolefin. Exemplary of thermoplastic polyolefins useful can include, but are not limited to, polyethylene, polypropylene, and thermoplastic olefin elastomers (e.g., metallocene-catalyzed block copolymers of ethylene and α-olefins having 4 to about 8 carbon atoms). The thermoplastic polyolefin is a polymer comprising a polyethylene, an ethylene-α-olefin copolymer, an ethylene-propylene rubber (EPDM), a polybutene, a polyisobutylene, a poly-4-methylpent-1-ene, a polyisoprene, a polybutadiene, a ethylene-methacrylic acid copolymer, and an olefin elastomer such as a dynamically cross-linked polymer obtained from polypropylene (PP) and an ethylene-propylene rubber (EPDM), and blends or mixtures of the foregoing. Further exemplary thermoplastic polyolefins useful in the disclosed compositions, yarns, and fibers are polymers of cycloolefins such as cyclopentene or norbornene.

It is to be understood that polyethylene, which optionally can be crosslinked, is inclusive a variety of polyethylenes, including, but not limited to, low density polyethylene (LDPE), linear low density polyethylene (LLDPE), (VLDPE) and (ULDPE), medium density polyethylene (MDPE), high density polyethylene (HDPE), high density and high molecular weight polyethylene (HDPE-HMW), high density and ultrahigh molecular weight polyethylene (HDPE-UHMW), and blends or mixtures of any the foregoing polyethylenes. A polyethylene can also be a polyethylene copolymer derived from monomers of monolefins and diolefins copolymerized with a vinyl, acrylic acid, methacrylic acid, ethyl acrylate, vinyl alcohol, and/or vinyl acetate. Polyolefin copolymers comprising vinyl acetate-derived units can be a high vinyl acetate content copolymer, e.g., greater than about 50 wt percent vinyl acetate-derived composition.

The thermoplastic polyolefin, as disclosed herein, can be formed through free radical, cationic, and/or anionic polymerization by methods well known to those skilled in the art (e.g., using a peroxide initiator, heat, and/or light). The disclosed thermoplastic polyolefin can be prepared by radical polymerization under high pressure and at elevated temperature. Alternatively, the thermoplastic polyolefin can be prepared by catalytic polymerization using a catalyst that normally contains one or more metals from group IVb, Vb, VIb or VIII metals. The catalyst usually has one or more than one ligand, typically oxides, halides, alcoholates, esters, ethers, amines, alkyls, alkenyls and/or aryls that can be either p- or s-coordinated complexed with the group IVb, Vb, VIb or VIII metal. The metal complexes can be in the free form or fixed on substrates, typically on activated magnesium chloride, titanium(III) chloride, alumina or silicon oxide. It is understood that the metal catalysts can be soluble or insoluble in the polymerization medium. The catalysts can be used by themselves in the polymerization or further activators can be used, typically a group Ia, IIa and/or IIIa metal alkyls, metal hydrides, metal alkyl halides, metal alkyl oxides or metal alkyloxanes. The activators can be modified conveniently with further ester, ether, amine or silyl ether groups.

Suitable thermoplastic polyolefins can be prepared by polymerization of monomers of monolefins and diolefins as described herein. Exemplary monomers that can be used to prepare disclosed thermoplastic polyolefin include, but are not limited to, ethylene, propylene, 1-butene, 1-pentene, 1-hexene, 2-methyl-1-propene, 3-methyl-1-pentene, 4-methyl-1-pentene, 5-methyl-1-hexene and mixtures thereof.

Suitable ethylene-α-olefin copolymers can be obtained by copolymerization of ethylene with an α-olefin such as propylene, butene-1, hexene-1, octene-1,4-methyl-1-pentene or the like having carbon numbers of 3 to 12.

Suitable dynamically cross-linked polymers can be obtained by cross-linking a rubber component as a soft segment while at the same time physically dispersing a hard segment such as PP and a soft segment such as EPDM by using a kneading machine such as a Banbbury mixer and a biaxial extruder.

The thermoplastic polyolefin can be a mixture of thermoplastic polyolefins, such as a mixture of two or more polyolefins disclosed herein above. For example, a suitable mixture of thermoplastic polyolefins can be a mixture of polypropylene with polyisobutylene, polypropylene with polyethylene (for example PP/HDPE, PP/LDPE) or mixtures of different types of polyethylene (for example LDPE/HDPE).

The thermoplastic polyolefin can be a copolymer of suitable monolefin monomers or a copolymer of a suitable monolefin monomer and a vinyl monomer. Exemplary thermoplastic polyolefin copolymers include, but are not limited to, ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethylene/heptene copolymers, ethylene/octene copolymers, propylene/butadiene copolymers, isobutylene/isoprene copolymers, ethylene/alkyl acrylate copolymers, ethylene/alkyl methacrylate copolymers, ethylene/vinyl acetate copolymers and their copolymers with carbon monoxide or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned in 1) above, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

The thermoplastic polyolefin can be a polypropylene homopolymer, a polypropylene copolymers, a polypropylene random copolymer, a polypropylene block copolymer, a polyethylene homopolymer, a polyethylene random copolymer, a polyethylene block copolymer, a low density polyethylene (LDPE), a linear low density polyethylene (LLDPE), a medium density polyethylene, a high density polyethylene (HDPE), or blends or mixtures of one or more of the preceding polymers.

The polyolefin can be a polypropylene. The term "polypropylene," as used herein, is intended to encompass any polymeric composition comprising propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as atactic, syndiotactic, isotactic, and the like). Thus, the term as applied to fibers is intended to encompass actual long strands, tapes, threads, and the like, of drawn polymer. The polypropylene can be of any standard melt flow (by testing); however, standard fiber grade polypropylene resins possess ranges of Melt Flow Indices between about 1 and 1000.

The polyolefin can be a polyethylene. The term "polyethylene," as used herein, is intended to encompass any polymeric composition comprising ethylene monomers, either alone or in mixture or copolymer with other randomly selected and oriented polyolefins, dienes, or other monomers (such as propylene, butylene, and the like). Such a term also encompasses any different configuration and arrangement of the constituent monomers (such as atactic, syndiotactic, isotactic, and the like). Thus, the term as applied to fibers is intended to encompass actual long strands, tapes, threads, and the like, of drawn polymer. The polyethylene can be of any standard melt flow (by testing); however, standard fiber grade polyethylene resins possess ranges of Melt Flow Indices between about 1 and 1000.

The hydrogel material, the thermoplastic hot melt adhesive, the tie material, the elastomeric material, and/or the regrind material, may further comprise, consist of, or consist essentially of one or more processing aids. These processing aids may be independently selected from the group including, but not limited to, curing agents, initiators, plasticizers, mold release agents, lubricants, antioxidants, flame retardants, dyes, pigments, reinforcing and non-reinforcing fillers, fiber reinforcements, and light stabilizers.

Now having described various aspects of the present disclosure, additional detail regarding methods of making and using the layered material are provided. A method of making an article (e.g., an article of footwear, an article of apparel, or an article of sporting equipment, or component of each) can include affixing a first component and the layered material as described herein to one another, thereby forming the article.

In regard to an article of footwear, the first component can be an upper component for an article of footwear and/or an outsole component for an article of footwear. For example, the step of affixing can include affixing the outsole component and the layered material such that the externally facing layer of the layered material forms at least a portion of a side of the outsole component which is configured to be ground facing. The footwear can include traction elements, where the layered material is positioned between or among the traction elements and optionally on the sides of the traction elements, but not on the side(s) touching the ground or surface. In addition, the layered material can be positioned between traction elements located in the toe region (e.g., toe plate) and the heel region (e.g., heel plate) in the midfoot region (e.g., midfoot plate). Alternatively, the layered material can be positioned between the toe region (e.g., toe plate) and the heel region (e.g., heel plate) in the midfoot region (e.g., midfoot plate), where the traction elements are positioned in the toe region, the heel region, or both.

A process for manufacturing an article can include placing a first element on a molding surface and then placing the thermoplastic hot melt adhesive layer in contact with at least a portion of the first element on the molding surface. While the thermoplastic hot melt adhesive layer is in contact with the component on the molding surface, increasing a temperature of the thermoplastic hot melt adhesive layer to a temperature that is at or above an activation temperature of the thermoplastic hot melt adhesive. Subsequent to the increasing the temperature of the thermoplastic hot melt adhesive, while the thermoplastic hot melt adhesive layer remains in contact with the component on the molding surface, decreasing the temperature of the thermoplastic hot melt adhesive to a temperature below the melting temperature $T_m$ of the thermoplastic hot melt adhesive. As a result, the layered material is bonded to the component forming a bonded component.

The first element can be a first shaped component, a first film, a first textile, a first yarn, and a first fiber. The first element comprises a first element material. Increasing the temperature of the thermoplastic hot melt adhesive to the temperature at or above its activation temperature includes increasing a temperature of the first element to a temperature above the melting temperature $T_m$ of the first element material.

The activation temperature of the thermoplastic hot melt adhesive can be a temperature at or above the Vicat softening temperature $T_{vs}$ or the melting temperature $T_m$ of the thermoplastic hot melt adhesive. The activation temperature of the thermoplastic hot melt adhesive can be a temperature below at least one of: 1) the creep relaxation temperature $T_{cr}$; 2) the heat deflection temperature $T_{hd}$; or 3) the Vicat softening temperature $T_{vs}$ of the hydrogel material of the layered material.

A method can include the manufacturing of a component (e.g., an article of footwear, a component of an article of footwear, an article of apparel, a component of an article of apparel, an article of sporting equipment, or a component of an article of sporting equipment) by placing the layered material including an external perimeter into a mold so that a portion of the layered material (e.g., externally facing layer) contacts a portion of the molding surface. The portion of the externally facing layer can be restrained against the portion of the molding surface while flowing a second polymeric material into the mold. During the flowing, a temperature of the second polymeric material is at or above an activation temperature of the thermoplastic hot melt adhesive of the layered material. During the restraining, a temperature of the thermoplastic hot melt adhesive of the layered material is at or above an activation temperature of the thermoplastic hot melt adhesive. During the restraining and flowing, a temperature of the layered material remains at a temperature below at least one of: 1) the creep relaxation temperature $T_{cr}$; 2) the heat deflection temperature $T_{hd}$; or 3) the Vicat softening temperature $T_{vs}$ of the hydrogel material of the layered material.

The layered material may be restrained or held against the molding surface using a holding mechanism that may include, but not be limited to, vacuum, one or more retractable pins, or a combination thereof. The restraining of the layered material to the mold can cause that portion of the layered material to assume the shape of the mold. The restraining can be applied to the external perimeter of the layered material.

Next, the second polymeric material in the mold is solidified thereby bonding the second polymeric material to the thermoplastic hot melt adhesive layer and the external perimeter of the layered material thereby producing the component with the portion of the layered material forming an outermost layer of the component. Subsequently, the component can be removed from the mold.

The activation temperature of the thermoplastic hot melt adhesive can be a temperature at or above the Vicat softening temperature $T_{vs}$ or the melting temperature $T_m$ of the thermoplastic hot melt adhesive.

The activation temperature of the thermoplastic hot melt adhesive is a temperature below at least one of: 1) the creep relaxation temperature $T_{cr}$; 2) the heat deflection temperature $T_{hd}$; or 3) the Vicat softening temperature $T_{vs}$ of the hydrogel material of the layered material.

The component (e.g., footwear) can include the layered material, the layered material having an external perimeter, where the externally facing layer of the layered material is present on at least a portion of a side of the component and a second polymeric material affixed to the thermoplastic hot melt adhesive layer and to the external perimeter of the layered material.

In an aspect, the method of making an article of footwear can include affixing an outsole component and a layered material to one another, thereby forming the article. The layered material comprises an externally facing layer and a second layer opposite the externally facing layer. The externally facing layer comprises a hydrogel material and the second layer comprises a thermoplastic hot melt adhesive material. The article of footwear comprises one or more of the traction elements on the side of the article of footwear configured to be ground facing. The step of affixing includes affixing the outsole component and the layered material to each other such that an externally facing layer forms at least a portion of a side of the outsole component which is configured to be ground facing.

Property Analysis and Characterization Procedures

Evaluation of various properties and characteristics of the part and support materials described herein are by various testing procedures as described herein below.

Method to Determine the Creep Relation Temperature $T_{cr}$.

The creep relation temperature $T_{cr}$ is determined according to the exemplary techniques described in U.S. Pat. No. 5,866,058. The creep relaxation temperature $T_{cr}$ is calculated to be the temperature at which the stress relaxation modulus of the tested material is 10 percent relative to the stress relaxation modulus of the tested material at the solidification temperature of the material, where the stress relaxation modulus is measured according to AS $T_m$ E328-02. The solidification temperature is defined as the temperature at which there is little to no change in the stress relaxation modulus or little to no creep about 300 seconds after a stress is applied to a test material, which can be observed by plotting the stress relaxation modulus (in Pa) as a function of temperature (in degree Celsius).

Method to Determine the Vicat Softening Temperature $T_{vs}$.

The Vicat softening temperature $T_{vs}$ is be determined according to the test method detailed in AS $T_m$ D1525-09 Standard Test Method for Vicat Softening Temperature of Plastics, preferably using Load A and Rate A. Briefly, the Vicat softening temperature is the temperature at which a flat-ended needle penetrates the specimen to the depth of 1 mm under a specific load. The temperature reflects the point of softening expected when a material is used in an elevated temperature application. It is taken as the temperature at which the specimen is penetrated to a depth of 1 mm by a flat-ended needle with a 1 millimeter squared circular or square cross-section. For the Vicat A test, a load of 10 N is used, whereas for the Vicat B test, the load is 50 N. The test involves placing a test specimen in the testing apparatus so that the penetrating needle rests on its surface at least 1 mm from the edge. A load is applied to the specimen per the requirements of the Vicat A or Vicate B test. The specimen is then lowered into an oil bath at 23 degree Celsius. The bath is raised at a rate of 50 degree Celsius or 120 degree Celsius per hour until the needle penetrates 1 mm. The test specimen must be between 3 and 6.5 mm thick and at least 10 mm in width and length. No more than three layers can be stacked to achieve minimum thickness.

Method to Determine the Heat Deflection Temperature $T_{hd}$,

The heat deflection temperature $T_{hd}$ is be determined according to the test method detailed in AS $T_m$ D648-16 Standard Test Method for Deflection Temperature of Plastics Under Flexural Load in the Edgewise Position, using a 0.455 megaPascals applied stress. Briefly, the heat deflection temperature is the temperature at which a polymer or plastic sample deforms under a specified load. This property of a given plastic material is applied in many aspects of product design, engineering, and manufacture of products using thermoplastic components. In the test method, the bars are placed under the deflection measuring device and a load (0.455 megaPascals) of is placed on each specimen. The specimens are then lowered into a silicone oil bath where the temperature is raised at 2 degree Celsius per minute until they deflect 0.25 mm per AS $T_m$D648-16. AS $T_m$ uses a standard bar 5"×½"×¼". ISO edgewise testing uses a bar 120 mm×10 mm×4 mm. ISO flatwise testing uses a bar 80 mm×10 mm×4 mm.

Method to Determine the Melting Temperature, $T_m$, and Glass Transition Temperature, $T_g$ The melting temperature $T_m$ and glass transition temperature $T_g$ are determined using a commercially available Differential Scanning calorimeter ("DSC") in accordance with AS $T_m$D3418-97. Briefly, a 10-15 gram sample is placed into an aluminum DSC pan and then the lead was sealed with the crimper press. The DSC is configured to scan from −100 degree Celsius to 225 degree Celsius with a 20 degree Celsius/minute heating rate, hold at 225 degree Celsius for 2 minutes, and then cool down to 25 degree Celsius at a rate of −10 degree Celsius/minute. The DSC curve created from this scan is then analyzed using standard techniques to determine the glass transition temperature $T_g$ and the melting temperature $T_m$.

Method to Determine the Melt Flow Index.

The melt flow index is determined according to the test method detailed in AS $T_m$ D1238-13 Standard Test Method for Melt Flow Rates of Thermoplastics by Extrusion Plastometer, using Procedure A described therein. Briefly, the melt flow index measures the rate of extrusion of thermoplastics through an orifice at a prescribed temperature and load. In the test method, approximately 7 grams of the material is loaded into the barrel of the melt flow apparatus, which has been heated to a temperature specified for the material. A weight specified for the material is applied to a plunger and the molten material is forced through the die. A timed extrudate is collected and weighed. Melt flow rate values are calculated in g/10 min.

Method to Determine the Cold Ross Flex.

The cold Ross flex test is determined according the following test method. The purpose of this test is to evaluate the resistance to cracking of a sample under repeated flexing to 60 degrees in a cold environment. A thermoformed plaque of the material for testing is sized to fit inside the flex tester machine. Each material is tested as five separate samples. The flex tester machine is capable of flexing samples to 60 degrees at a rate of 100+/−5 cycles per minute. The mandrel diameter of the machine is 10 millimeters. Suitable machines for this test are the Emerson AR-6, the Satra S $T_m$ 141F, the Gotech GT-7006, and the Shin II Scientific SI-LTCO (DaeSung Scientific). The sample(s) are inserted into the machine according to the specific parameters of the flex machine used. The machine is placed in a freezer set to −6 degree Celsius for the test. The motor is turned on to begin flexing with the flexing cycles counted until the sample cracks. Cracking of the sample means that the surface of the material is physically split. Visible creases of lines that do not actually penetrate the surface are not cracks. The sample is measured to a point where it has cracked but not yet broken in two.

Method to Determine the Modulus (Plaque).

The modulus for a thermoformed plaque of material is determined according to the test method detailed in AS $T_m$ D412-98 Standard Test Methods for Vulcanized Rubber and Thermoplastic Rubbers and Thermoplastic Elastomers-Tension, with the following modifications. The sample dimension is the AS $T_m$D412-98 Die C, and the sample thickness used is 2.0 millimeters+/−0.5 millimeters. The grip type used is a pneumatic grip with a metal serrated grip face. The grip distance used is 75 millimeters. The loading rate used is 500 millimeters/minute. The modulus (initial) is calculated by taking the slope of the stress (megaPascals) versus the strain in the initial linear region.

Method to Determine the Modulus (Yarn).

The modulus for a yarn is determined according to the test method detailed in EN ISO 2062 (Textiles-Yarns from Packages)—Determination of Single-End Breaking Force and Elongation at Break Using Constant Rate of Extension (CRE) Tester, with the following modifications. The sample length used is 600 millimeters. The equipment used is an Instron and Gotech Fixture. The grip distance used is 250 millimeters. The pre-loading is set to 5 grams and the loading rate used is 250 millimeters/minute. The first meter of yarn is thrown away to avoid using damaged yarn. The modulus (initial) is calculated by taking the slope of the stress (megaPascals) versus the strain in the initial linear region.

Method to Determine Tenacity and Elongation.

The tenacity and elongation of yarn can be determined according to the test method detailed in EN ISO 2062 Determination of single end breaking force and elongation at break using constant rate of extension tester with the pre-load set to 5 grams.

Method to Determine Shrinkage.

The free-standing shrinkage of fibers and/or yarns can be determined by the following method. A sample fiber or yarn is cut to a length of approximately 30 millimeters with minimal tension at approximately room temperature (e.g., 20 degree Celsius). The cut sample is placed in a 50 degree Celsius or 70 degree Celsius oven for 90 seconds. The sample is removed from the oven and measured. The percentage of shrink is calculated using the pre- and post-oven measurements of the sample, by dividing the post-oven measurement by the pre-oven measurement, and multiplying by 100.

Method to Determine Enthalpy of Melting.

The enthalpy of melting is determined by the following method. A 5-10 mg sample of fibers or yarn is weighed to determine the sample mass, is placed into an aluminum DSC pan, and then the lid of the DSC pan is sealed using a crimper press. The DSC is configured to scan from −100 degree Celsius to 225 degree Celsius with a 20 degree Celsius/minute heating rate, hold at 225 degree Celsius for 2 minutes, and then cool down to room temperature (e.g., 25 degree Celsius) at a rate of −10 degree Celsius/minute. The enthalpy of melting is calculated by integrating the area of the melting endotherm peak and normalizing by the sample mass.

Water Uptake Capacity Test Protocol

This test measures the water uptake capacity of the layered material after a predetermined soaking duration for a sample (e.g., taken with the above-discussed Footwear Sampling Procedure). The sample is initially dried at 60 degree Celsius until there is no weight change for consecutive measurement intervals of at least 30 minutes apart (e.g., a 24-hour drying period at 60 degree Celsius is typically a suitable duration). The total weight of the dried sample ($Wt_{,sample\ dry}$) is then measured in grams. The dried sample is allowed to cool down to 25 degree Celsius, and is fully immersed in a deionized water bath maintained at 25 degree Celsius. After a given soaking duration, the sample is removed from the deionized water bath, blotted with a cloth to remove surface water, and the total weight of the soaked sample ($Wt_{,sample\ wet}$) is measured in grams.

Any suitable soaking duration can be used, where a 24-hour soaking duration is believed to simulate saturation conditions for the layered material of the present disclosure (i.e., the hydrophilic resin will be in its saturated state). Accordingly, as used herein, the expression "having a water uptake capacity at 5 minutes" refers to a soaking duration of 5 minutes, the expression "having a water uptake capacity at 1 hour" refers to a soaking duration of 1 hour, the expression "having a water uptake capacity at 24 hours" refers to a soaking duration of 24 hours, and the like. If no time duration is indicated after a water uptake capacity value, the soaking duration corresponds to a period of 24 hours.

As can be appreciated, the total weight of a sample taken pursuant to the Footwear Sampling Procedure includes the weight of the material as dried or soaked ($Wt_{,sample\ dry}$ or $Wt_{,sample\ wet}$) and the weight of the substrate ($Wt_{,substrate}$) needs to be subtracted from the sample measurements.

The weight of the substrate ($Wt_{,substrate}$) is calculated using the sample surface area (e.g., 4.0 centimeter squared), an average measured thickness of the layered material, and the average density of the layered material. Alternatively, if the density of the material for the substrate is not known or obtainable, the weight of the substrate ($Wt_{,substrate}$) is determined by taking a second sample using the same sampling procedure as used for the primary sample, and having the same dimensions (surface area and film/substrate thicknesses) as the primary sample. The material of the second sample is then cut apart from the substrate of the second sample with a blade to provide an isolated substrate. The isolated substrate is then dried at 60 degree Celsius for 24 hours, which can be performed at the same time as the primary sample drying. The weight of the isolated substrate ($Wt_{,substrate}$) is then measured in grams.

The resulting substrate weight ($Wt_{,substrate}$) is then subtracted from the weights of the dried and soaked primary sample ($Wt_{,sample\ dry}$ or $Wt_{,sample\ wet}$) to provide the weights of the material as dried and soaked ($Wt_{,component\ dry}$ or $Wt_{,component\ wet}$) as depicted by Equations 1 and 2.

$$Wt_{,component\ dry} = Wt_{,,sample\ dry} - Wt_{,substrate} \quad \text{(Eq. 1)}$$

$$Wt_{component\ wet} = Wt_{,,sample\ wet} - Wt_{,substrate} \quad \text{(Eq. 2)}$$

The weight of the dried component ($Wt_{,component\ dry}$) is then subtracted from the weight of the soaked component ($Wt_{component\ wet}$) to provide the weight of water that was taken up by the component, which is then divided by the weight of the dried component ($Wt_{,component\ dry}$) to provide the water uptake capacity for the given soaking duration as a percentage, as depicted below by Equation 3.

$$\text{Water Uptake Capacity} = \frac{Wt_{component\ wet} - Wt_{,component\ dry}}{Wt_{,component\ dry}}(100\ \text{percent}) \quad \text{(Eq. 3)}$$

For example, a water uptake capacity of 50 percent at 1 hour means that the soaked component weighed 1.5 times more than its dry-state weight after soaking for 1 hour. Similarly, a water uptake capacity of 500 percent at 24 hours means that the soaked component weighed 5 times more than its dry-state weight after soaking for 24 hours.

Water Uptake Rate Test Protocol

This test measures the water uptake rate of the layered material by modeling weight gain as a function of soaking time for a sample with a one-dimensional diffusion model. The sample can be taken with any of the above-discussed sampling procedures, including the Footwear Sampling Procedure. The sample is dried at 60 degree Celsius until there is no weight change for consecutive measurement intervals of at least 30 minutes apart (a 24-hour drying period at 60 degree Celsius is typically a suitable duration). The total weight of the dried sample ($Wt_{,sample\ dry}$) is then measured in grams. Additionally, the average thickness of the component for the dried sample is measured for use in calculating the water uptake rate, as explained below.

The dried sample is allowed to cool down to 25 degree Celsius, and is fully immersed in a deionized water bath maintained at 25 degree Celsius. Between soaking durations of 1, 2, 4, 9, 16, and 25 minutes, the sample is removed from the deionized water bath, blotted with a cloth to remove surface water, and the total weight of the soaked sample ($Wt_{,,sample\ wet}$) is measured, where "t" refers to the particular soaking-duration data point (e.g., 1, 2, 4, 9, 16, or 25 minutes).

The exposed surface area of the soaked sample is also measured with calipers for determining the specific weight gain, as explained below. The exposed surface area refers to the surface area that comes into contact with the deionized water when fully immersed in the bath. For samples obtained using the Footwear Sampling Procedure, the samples only have one major surface exposed. For convenience, the surface areas of the peripheral edges of the sample are ignored due to their relatively small dimensions.

The measured sample is fully immersed back in the deionized water bath between measurements. The 1, 2, 4, 9, 16, and 25 minute durations refer to cumulative soaking durations while the sample is fully immersed in the deionized water bath (i.e., after the first minute of soaking and first measurement, the sample is returned to the bath for one more minute of soaking before measuring at the 2-minute mark).

As discussed above in the Water Uptake Capacity Test, the total weight of a sample taken pursuant to the Footwear Sampling Procedure includes the weight of the material as dried or soaked ($Wt_{component\ wet}$ or $Wt_{,component\ dry}$) and the weight of the article or backing substrate ($Wt_{,substrate}$). In order to determine a weight change of the material due to water uptake, the weight of the substrate ($Wt_{,substrate}$) needs to be subtracted from the sample weight measurements. This can be accomplished using the same steps discussed above in the Water Uptake Capacity Test to provide the resulting material weights $Wt_{,component\ wet}$ and $Wt_{,component\ dry}$ for each soaking-duration measurement.

The specific weight gain ($Ws_t$) from water uptake for each soaked sample is then calculated as the difference between the weight of the soaked sample ($Wt_{component\ wet}$) and the weight of the initial dried sample ($Wt_{,component\ dry}$) where the resulting difference is then divided by the exposed surface area of the soaked sample ($A_t$) as depicted in Equation 4.

$$(Ws_t) = \frac{Wt_{component\ wet} - Wt_{,component\ dry}}{(A_t)} \quad \text{(Eq. 4)}$$

where t refers to the particular soaking-duration data point (e.g., 1, 2, 4, 9, 16, or 25 minutes), as mentioned above.

The water uptake rate for the elastomeric material is then determined as the slope of the specific weight gains ($Ws_t$) versus the square root of time (in minutes), as determined by a least squares linear regression of the data points. For the elastomeric material of the present disclosure, the plot of the specific weight gains ($Ws_t$) versus the square root of time (in minutes) provides an initial slope that is substantially linear (to provide the water uptake rate by the linear regression analysis). However, after a period of time depending on the thickness of the component, the specific weight gains will slow down, indicating a reduction in the water uptake rate, until the saturated state is reached. This is believed to be due to the water being sufficiently diffused throughout the elastomeric material as the water uptake approaches saturation, and will vary depending on component thickness.

As such, for the component having an average thickness (as measured above) less than 0.3 millimeters, only the specific weight gain data points at 1, 2, 4, and 9 minutes are used in the linear regression analysis. In these cases, the data points at 16 and 25 minutes can begin to significantly diverge from the linear slope due to the water uptake approaching saturation, and are omitted from the linear regression analysis. In comparison, for the component having an average dried thickness (as measured above) of 0.3 millimeters or more, the specific weight gain data points at 1, 2, 4, 9, 16, and 25 minutes are used in the linear regression analysis. The resulting slope defining the water uptake rate for the sample has units of weight/(surface area-square root of time), such as grams/(meter$^2$-minutes$^{1/2}$) or gram/meter squared/√minute.

Furthermore, some component surfaces can create surface phenomenon that quickly attract and retain water molecules (e.g., via surface hydrogen bonding or capillary action) without actually drawing the water molecules into the film or substrate. Thus, samples of these films or substrates can show rapid specific weight gains for the 1-minute sample, and possibly for the 2-minute sample. After that, however, further weight gain is negligible. As such, the linear regression analysis is only applied if the specific weight gain in data points at 1, 2, and 4 minutes continue to show an increase in water uptake. If not, the water uptake rate under this test methodology is considered to be about zero gram/meter squared/√minute.

Swelling Capacity Test Protocol

This test measures the swelling capacity of the component in terms of increases in thickness and volume after a given soaking duration for a sample (e.g., taken with the above-discussed Footwear Sampling Procedure). The sample is initially dried at 60 degree Celsius until there is no weight change for consecutive measurement intervals of at least 30 minutes apart (a 24-hour drying period is typically a suitable duration). The dimensions of the dried sample are then measured (e.g., thickness, length, and width for a rectangular sample; thickness and diameter for a circular sample, etc.). The dried sample is then fully immersed in a deionized water bath maintained at 25 degree Celsius. After a given soaking duration, the sample is removed from the deionized water bath, blotted with a cloth to remove surface water, and the same dimensions for the soaked sample are re-measured.

Any suitable soaking duration can be used. Accordingly, as used herein, the expression "having a swelling thickness (or volume) increase at 5 minutes of." refers to a soaking duration of 5 minutes, the expression "having a swelling thickness (or volume) increase at 1 hour of" refers to a test duration of 1 hour, the expression "having a swelling thickness (or volume) increase at 24 hours of" refers to a test duration of 24 hours, and the like.

The swelling of the component is determined by (1) an increase in the thickness between the dried and soaked component, by (2) an increase in the volume between the dried and soaked component, or (3) both. The increase in thickness between the dried and soaked components is calculated by subtracting the measured thickness of the initial dried component from the measured thickness of the soaked component. Similarly, the increase in volume between the dried and soaked components is calculated by subtracting the measured volume of the initial dried component from the measured volume of the soaked component. The increases in the thickness and volume can also be represented as percentage increases relative to the dry thickness or volume, respectively.

Contact Angle Test

This test measures the contact angle of the layered material based on a static sessile drop contact angle measurement for a sample (e.g., taken with the above-discussed Footwear Sampling Procedure or Co-extruded Film Sampling Procedure). The contact angle refers to the angle at which a liquid interface meets a solid surface, and is an indicator of how hydrophilic the surface is.

For a dry test (i.e., to determine a dry-state contact angle), the sample is initially equilibrated at 25 degree Celsius and 20 percent humidity for 24 hours. For a wet test (i.e., to determine a wet-state contact angle), the sample is fully immersed in a deionized water bath maintained at 25 degree Celsius for 24 hours. After that, the sample is removed from the bath and blotted with a cloth to remove surface water, and clipped to a glass slide if needed to prevent curling.

The dry or wet sample is then placed on a moveable stage of a contact angle goniometer commercially available under the tradename "RAME-HART F290" from Rame-Hart Instrument Co., Succasunna, N.J. A 10-microliter droplet of deionized water is then placed on the sample using a syringe and automated pump. An image is then immediately taken of the droplet (before film can take up the droplet), and the contact angle of both edges of the water droplet are measured from the image. The decrease in contact angle between the dried and wet samples is calculated by subtracting the measured contact angle of the wet layered material from the measured contact angle of the dry layered material.

Coefficient of Friction Test

This test measures the coefficient of friction of the Coefficient of Friction Test for a sample (e.g., taken with the above-discussed Footwear Sampling Procedure, Co-extruded Film Sampling Procedure, or the Neat Film Sampling Procedure). For a dry test (i.e., to determine a dry-state coefficient of friction), the sample is initially equilibrated at 25 degree Celsius and 20 percent humidity for 24 hours. For a wet test (i.e., to determine a wet-state coefficient of friction), the sample is fully immersed in a deionized water bath maintained at 25 degree Celsius for 24 hours. After that, the sample is removed from the bath and blotted with a cloth to remove surface water.

The measurement is performed with an aluminum sled mounted on an aluminum test track, which is used to perform a sliding friction test for test sample on an aluminum surface of the test track. The test track measures 127 millimeters wide by 610 millimeters long. The aluminum sled measures 76.2 millimeters.times.76.2 millimeters, with a 9.5 millimeter radius cut into the leading edge. The contact area of the aluminum sled with the track is 76.2 millimeters× 66.6 millimeters, or 5,100 square millimeters).

The dry or wet sample is attached to the bottom of the sled using a room temperature-curing two-part epoxy adhesive commercially available under the tradename "LOCTITE 608" from Henkel, Dusseldorf, Germany. The adhesive is used to maintain the planarity of the wet sample, which can curl when saturated. A polystyrene foam having a thickness of about 25.4 millimeters is attached to the top surface of the sled (opposite of the test sample) for structural support.

The sliding friction test is conducted using a screw-driven load frame. A tow cable is attached to the sled with a mount supported in the polystyrene foam structural support, and is wrapped around a pulley to drag the sled across the aluminum test track. The sliding or frictional force is measured using a load transducer with a capacity of 2,000 Newtons. The normal force is controlled by placing weights on top of the aluminum sled, supported by the polystyrene foam structural support, for a total sled weight of 20.9 kilograms (205 Newtons). The crosshead of the test frame is increased at a rate of 5 millimeters/second, and the total test displacement is 250 millimeters. The coefficient of friction is calculated based on the steady-state force parallel to the direction of movement required to pull the sled at constant velocity. The coefficient of friction itself is found by dividing the steady-state pull force by the applied normal force. Any transient value relating static coefficient of friction at the start of the test is ignored.

Storage Modulus Test

This test measures the resistance of the layered material to being deformed (ratio of stress to strain) when a vibratory or oscillating force is applied to it, and is a good indicator of film compliance in the dry and wet states. For this test, a sample is provided in neat form using the Neat Film Sampling Procedure, which is modified such that the surface area of the test sample is rectangular with dimensions of 5.35 millimeters wide and 10 millimeters long. The layered material thickness can range from 0.1 millimeters to 2 millimeters, and the specific range is not particularly limited as the end modulus result is normalized according to layered material thickness.

The storage modulus (E') with units of megaPascals of the sample is determined by dynamic mechanical analysis (DMA) using a DMA analyzer commercially available under the tradename "Q800 DMA ANALYZER" from TA Instruments, New Castle, Del., which is equipped with a relative humidity accessory to maintain the sample at constant temperature and relative humidity during the analysis.

Initially, the thickness of the test sample is measured using calipers (for use in the modulus calculations). The test sample is then clamped into the DMA analyzer, which is operated at the following stress/strain conditions during the analysis: isothermal temperature of 25 degree Celsius, frequency of 1 Hertz, strain amplitude of 10 micrometers, preload of 1 Newton, and force track of 125 percent. The DMA analysis is performed at a constant 25 degree Celsius temperature according to the following time/relative humidity (RH) profile: (i) percent RH for 300 minutes (representing the dry state for storage modulus determination), (ii) 50 percent RH for 600 minutes, (iii) 90 percent RH for 600 minutes (representing the wet state for storage modulus determination), and (iv) 0 percent RH for 600 minutes.

The E' value (in megaPascals) is determined from the DMA curve according to standard DMA techniques at the end of each time segment with a constant RH value. Namely, the E' value at 0 percent RH (i.e., the dry-state storage modulus) is the value at the end of step (i), the E' value at 50 percent RH is the value at the end of step (ii), and the E' value at 90 percent RH (i.e., the wet-state storage modulus) is the value at the end of step (iii) in the specified time/relative humidity profile.

The layered material can be characterized by its dry-state storage modulus, its wet-state storage modulus, or the reduction in storage modulus between the dry-state and wet-state layered materials, where wet-state storage modulus is less than the dry-state storage modulus. This reduction in storage modulus can be listed as a difference between the dry-state storage modulus and the wet-state storage modulus, or as a percentage change relative to the dry-state storage modulus.

Glass Transition Temperature Test

This test measures the glass transition temperature ($T_g$) of the outsole component film for a sample, where the outsole component film is provided in neat form, such as with the Neat Film Sampling Procedure or the Neat Material Sampling Procedure, with a 10-milligram sample weight. The sample is measured in both a dry state and a wet state (i.e., after exposure to a humid environment as described herein).

The glass transition temperature is determined with DMA using a DMA analyzer commercially available under the tradename "Q2000 DMA ANALYZER" from TA Instruments, New Castle, Del., which is equipped with aluminum hermetic pans with pinhole lids, and the sample chamber is purged with 50 milliliters/minute of nitrogen gas during analysis. Samples in the dry state are prepared by holding at 0 percent RH until constant weight (less than 0.01 percent weight change over 120 minute period). Samples in the wet state are prepared by conditioning at a constant 25 degree Celsius according to the following time/relative humidity (RH) profile: (i) 250 minutes at 0 percent RH, (ii) 250 minutes at 50 percent RH, and (iii) 1,440 minutes at 90 percent RH. Step (iii) of the conditioning program can be terminated early if sample weight is measured during conditioning and is measured to be substantially constant within 0.05 percent during an interval of 100 minutes.

After the sample is prepared in either the dry or wet state, it is analyzed by DSC to provide a heat flow versus temperature curve. The DSC analysis is performed with the following time/temperature profile: (i) equilibrate at −90 degree Celsius for 2 minutes, (ii) ramp at +10 degree Celsius/minute to 250 degree Celsius, (iii) ramp at −50 degree Celsius/minute to −90 degree Celsius, and (iv) ramp at +10 degree Celsius/minute to 250 degree Celsius. The glass transition temperature value (in Celsius) is determined from the DSC curve according to standard DSC techniques.

The present disclosure is also described in the following clauses.

Clause 1. A layered material, comprising: an externally facing layer of a first material comprising a hydrogel material, and a second layer comprising a thermoplastic hot melt adhesive layer.

Clause 2. The layered material of any of the preceding clauses, further comprising one or more inner layers between the externally facing layer and the thermoplastic hot melt adhesive layer.

Clause 3. The layered material of any of the preceding clauses, wherein one of the one or more inner layers is a tie layer comprising a tie material.

Clause 4. The layered material of any of the preceding clauses, wherein one of the one or more inner layers is an elastomeric layer comprising an elastomer material.

Clause 5. The layered material of any of the preceding clauses, wherein the elastomer material is a thermoplastic polymer.

Clause 6. The layered material of any of the preceding clauses, wherein the thermoplastic polymer comprises a polyurethane.

Clause 7. The layered material of any of the preceding clauses, wherein the polyurethane is a thermoplastic polyurethane (TPU).

Clause 8. The layered material of any of the preceding clauses, wherein one of the one or more inner layers is a regrind layer comprising a regrind material.

Clause 9. The layered material of any of the preceding clauses, wherein two or more inner layers are disposed between the externally facing layer and the thermoplastic hot melt adhesive layer, wherein the inner layers are selected from the tie layer, the regrind layer, and the elastomer layer.

Clause 10. The layered material of any of the preceding clauses, wherein three or more inner layers are disposed between the externally facing layer and the thermoplastic hot melt adhesive layer, wherein the inner layers are selected from the tie layer, the regrind layer, and the elastomer layer.

Clause 11. The layered material of any of the preceding clauses, wherein the hydrogel material comprises a polyurethane hydrogel.

Clause 12. The layered material of any of the preceding clauses, wherein the polyurethane hydrogel is a reaction polymer of a diisocyanate with a polyol.

Clause 13. The layered material of any of the preceding clauses, wherein the hydrogel material comprises a polyamide hydrogel.

Clause 14. The layered material of any of the preceding clauses, wherein the polyamide hydrogel is a reaction polymer of a condensation of diamino compounds with dicarboxylic acids.

Clause 15. The layered material of any of the preceding clauses, wherein the hydrogel material comprises a polyurea hydrogel.

Clause 16. The layered material of any of the preceding clauses, wherein the polyurea hydrogel is a reaction polymer of a diisocyanate with a diamine.

Clause 17. The layered material of any of the preceding clauses, wherein the hydrogel material comprises a polyester hydrogel.

Clause 18. The layered material of any of the preceding clauses, wherein the polyester hydrogel is a reaction polymer of a dicarboxylic acid with a diol.

Clause 19. The layered material of any of the preceding clauses, wherein the hydrogel material comprises a polycarbonate hydrogel.

Clause 20. The layered material of any of the preceding clauses, wherein the polycarbonate hydrogel is a reaction polymer of a diol with phosgene or a carbonate diester Clause 21. The layered material of any of the preceding clauses, wherein the hydrogel material comprises a polyetheramide hydrogel.

Clause 22. The layered material of any of the preceding clauses, wherein the polyetheramide hydrogel is a reaction polymer of dicarboxylic acid and polyether diamine.

Clause 23. The layered material of any of the preceding clauses, wherein the hydrogel material comprises a hydrogel formed of addition polymers of ethylenically unsaturated monomers.

Clause 24. The layered material of any of the preceding clauses, wherein the hydrogel material comprises a hydrogel formed of a copolymer, wherein the copolymer is a combination of two or more types of polymers within each polymer chain.

Clause 25. The layered material of any of the preceding clauses, wherein the copolymer is selected from the group consisting of: a polyurethane/polyurea copolymer, a polyurethane/polyester copolymer, and a polyester/polycarbonate copolymer.

Clause 26. The layered material of any of the preceding clauses, wherein the thermoplastic hot melt adhesive material comprises one or more thermoplastic polymers selected from the group consisting of polyesters, polyethers, polyamides, polyurethanes and polyolefins.

Clause 27. The layered material of any of the preceding clauses, wherein the one or more thermoplastic polymers comprises one or more thermoplastic polyesters.

Clause 28. The layered material of any of the preceding clauses, wherein the one or more thermoplastic polyesters comprises polyethylene terephthalate (PET).

Clause 29. The layered material of any of the preceding clauses, wherein the one or more thermoplastic polymers comprises one or more thermoplastic polyamides.

Clause 30. The layered material of any of the preceding clauses, wherein the one or more thermoplastic polyamides comprises nylon 6,6, nylon 6, nylon 12, and combinations thereof.

Clause 31. The layered material of any of the preceding clauses, wherein the one or more thermoplastic polymers comprises one or more thermoplastic polyurethanes.

Clause 32. The layered material of any of the preceding clauses, wherein the one or more thermoplastic polymers comprise one or more thermoplastic copolymers.

Clause 33. The layered material of any of the preceding clauses, wherein the one or more thermoplastic copolymers comprises thermoplastic copolymers selected from the group consisting of thermoplastic co-polyesters, thermoplastic co-polyethers, thermoplastic co-polyamides, thermoplastic co-polyurethanes, and combinations thereof.

Clause 34. The layered material of any of the preceding clauses, wherein the one or more thermoplastic copolymers comprise thermoplastic co-polyesters.

Clause 35. The layered material of any of the preceding clauses, wherein the one or more thermoplastic copolymers comprise thermoplastic co-polyethers.

Clause 36. The layered material of any of the preceding clauses, wherein the one or more thermoplastic copolymers comprise thermoplastic co-polyamides.

Clause 37. The layered material of any of the preceding clauses, wherein the one or more thermoplastic copolymers comprise thermoplastic co-polyurethanes.

Clause 38. The layered material of any of the preceding clauses, wherein the one or more thermoplastic polymers comprise one or more thermoplastic polyether amide (PEBA) polymers.

Clause 39. The layered material of any of the preceding clauses, wherein the thermoplastic hot melt adhesive material comprises a low processing temperature polymeric composition.

Clause 40. The layered material of any of the preceding clauses, wherein a melting temperature $T_m$ of the low processing temperature polymeric composition is less than 135 degree Celsius.

Clause 41. The layered material of any of the preceding clauses, wherein the low processing temperature polymeric composition exhibits a melting temperature of from about 80 degree Celsius to about 135 degree Celsius.

Clause 42. The layered material of any of the preceding clauses, wherein the low processing temperature polymeric composition exhibits a glass transition temperature $T_g$ of about 50 degree Celsius or less.

Clause 43. The layered material of any of the preceding clauses, wherein the low processing temperature polymeric composition exhibits a glass transition temperature $T_g$ of about 25 degree Celsius or less.

Clause 44. The layered material of any of the preceding clauses, wherein the low processing temperature polymeric composition exhibits a melt flow index of about 0.1 g/10 min to about 60 g/10 min at 160 degree Celsius using a test weight of 2.16 kg.

Clause 45. The layered material of any of the preceding clauses, wherein the low processing temperature polymeric composition exhibits a melt flow index of about 2 g/10 min to about 50 g/10 min at 160 degree Celsius using a test weight of 2.16 kg.

Clause 46. The layered material of any of the preceding clauses, wherein the low processing temperature polymeric composition exhibits an enthalpy of melting of at least about 5 J/g.

Clause 47. The layered material of any of the preceding clauses, wherein the low processing temperature polymeric composition exhibits an enthalpy of melting of melting of from about 8 J/g to about 45 J/g.

Clause 48. The layered material of any of the preceding clauses, wherein the low processing temperature polymeric composition exhibits a modulus of about 1 megaPascals to about 500 megaPascals.

Clause 49. The layered material of any of the preceding clauses, wherein the low processing temperature polymeric composition exhibits a modulus of about 40 megaPascals to about 110 megaPascals.

Clause 50. The layered material of any of the preceding clauses, wherein the low processing temperature polymeric composition withstands 5,000 cycles or more in the Cold Ross Flex test without exhibiting visible cracking or stress whitening.

Clause 51. The layered material of any of the preceding clauses, wherein the low processing temperature polymeric composition withstands 150,000 cycles in the Cold Ross Flex test without exhibiting visible cracking or stress whitening.

Clause 52. The layered material of any of the preceding clauses, wherein the tie material comprises a thermoplastic polymer.

Clause 53. The layered material of any of the preceding clauses, wherein the thermoplastic polymer is selected from the group consisting of polyesters, polyethers, polyamides, polyurethanes, polyolefins, and a combination thereof.

Clause 54. The layered material of any of the preceding clauses, wherein the tie material comprises one or more polymers selected from the group consisting of an aliphatic thermoplastic polyurethane, an aliphatic polyamide, and combinations thereof.

Clause 55. The layered material of any of the preceding clauses, wherein the aliphatic polyamide comprises a caprolactam functional group.

Clause 56. The layered material of any of the preceding clauses, wherein the aliphatic polyamide is a nylon.

Clause 57. The layered material of any of the preceding clauses, wherein the one or more thermoplastic polyamides comprises nylon 6,6, nylon 6, nylon 12, and combinations thereof.

Clause 58. The layered material of any of the preceding clauses, wherein the tie layer comprises an ethylene vinyl alcohol copolymer.

Clause 59. The layered material of any of the preceding clauses, wherein the thermoplastic polyurethane (TPU) includes a plurality of alkoxy segments and a plurality of diisocyanate segments, wherein the plurality of diisocyanate segments are linked to each other by chain extending segments.

Clause 60. The layered material of any of the preceding clauses, wherein the TPU is a reaction polymer of a diisocyanate with a polyol.

Clause 61. The layered material of any of the preceding clauses, wherein the diisocyanate segments comprise an aliphatic diisocyanate segment, an aromatic diisocyanate segment, or both.

Clause 62. The layered material of any of the preceding clauses, wherein the diisocyanate segments comprise aliphatic diisocyanate segments.

Clause 63. The layered material of any of the preceding clauses, wherein the aliphatic diisocyanate segments include hexamethylene diisocyanate (HDI) segments.

Clause 64. The layered material of any of the preceding clauses, wherein a majority of the diisocyanate segments are HDI segments.

Clause 65. The layered material of any of the preceding clauses, wherein the aliphatic diisocyanate segments include isophorone diisocyanate (IPDI) segments.

Clause 66. The layered material of any of the preceding clauses, wherein the diisocyanate segments includes aromatic diisocyanate segments.

Clause 67. The layered material of any of the preceding clauses, wherein the aromatic diisocyanate segments include diphenylmethane diisocyanate (MDI) segments.

Clause 68. The layered material of any of the preceding clauses, wherein the aromatic diisocyanate segments include toluene diisocyanate (TDI) segments.

Clause 69. The layered material of any of the preceding clauses, wherein the alkoxy segments include ester segments and ether segments.

Clause 70. The layered material of any of the preceding clauses, wherein the alkoxy segments include ester segments.

Clause 71. The layered material of any of the preceding clauses, wherein the alkoxy segments include ether segments.

Clause 72. The layered material of any of the preceding clauses, wherein the regrind material comprises two or more of the following: the hydrogel material, the thermoplastic hot melt adhesive material, the elastomer material, and the tie material.

Clause 73. A structure, comprising the layered material of any one of clauses 1-72.

Clause 74. The structure of any of the preceding clauses, wherein the structure is an article of footwear, a component of footwear, an article of apparel, a component of apparel, an article of sporting equipment, or a component of sporting equipment.

Clause 75. The structure of any of the preceding clauses, wherein the structure is an article of footwear.

Clause 76. The structure of any of the preceding clauses, wherein the layered material is affixed to an outsole component of the article of footwear.

Clause 77. The structure of any of the preceding clauses, wherein a side of the article of footwear configured to be ground facing includes the layered material, and the externally facing layer forms at least a portion of an outer surface of the side.

Clause 78. The structure of any of the preceding clauses, wherein an upper of the article of footwear includes the layered material, and the externally facing layer forms at least a portion of an outer surface of the upper.

Clause 79. The structure of any of the preceding clauses, wherein the article of footwear comprises one or more of the traction elements, wherein the traction elements are on the side of the article of footwear configured to be ground facing.

Clause 80. The structure of any of the preceding clauses, wherein the traction elements are selected from the group consisting of: a cleat, a stud, a spike, and a lug.

Clause 81. The structure of any of the preceding clauses, wherein the traction elements are integrally formed with an outsole component of the article of footwear.

Clause 82. The structure of any of the preceding clauses, wherein the traction elements are removable traction elements.

Clause 83. The structure of any of the preceding clauses, wherein the layered material is not disposed on a tip of the traction element configured to be ground contacting.

Clause 84. The structure of any of the preceding clauses, wherein the externally facing layer is disposed in an area separating the traction elements and optionally on one or more sides of the traction elements, wherein the traction elements are in a different region (e.g., the toe region, the heel region, or both) of the outsole component than the externally facing layer (e.g., located in the midfoot region and not in the toe region, the heel region, or both).

Clause 85. A method of making an article, comprising: affixing a first component and the layered material of any one of clauses 1-69 to one another, thereby forming the article.

Clause 86. The method of any of the preceding clauses, wherein the article is an article of footwear, an article of apparel, or an article of sporting equipment.

Clause 87. The method of any of the preceding clauses, wherein the first component is an upper component for an article of footwear.

Clause 88. The method of any of the preceding clauses, wherein the first component is an outsole component for an article of footwear.

Clause 89. The method of any of the preceding clauses, wherein the step of affixing is affixing the outsole component and the layered material such that the externally facing layer forms at least a portion of a side of the outsole component which is configured to be ground facing.

Clause 90. The method of any of the preceding clauses, wherein the article of footwear comprises one or more of the traction elements, wherein the traction elements are on the side of the outsole component configured to be ground facing.

Clause 91. The method of any of the preceding clauses, wherein the traction elements are selected from the group consisting of: a cleat, a stud, a spike, and a lug.

Clause 92. The method of any of the preceding clauses, wherein the traction elements are integrally formed with the outsole component of the article of footwear.

Clause 93. The method of any of the preceding clauses, wherein the traction elements are removable traction elements.

Clause 94. The method of any of the preceding clauses, wherein the layered material is not disposed on a tip of the traction element configured to be ground contacting.

Clause 95. The method of any of the preceding clauses, wherein the layered material is disposed in an area separating the traction elements and optionally on one or more sides of the traction elements, optionally wherein the layer material (e.g., located in the midfoot region) is not disposed in the same a region as the traction elements (e.g., the toe region, the heel region, or both).

Clause 96. An article comprising: a product of the method of any one of clauses 85-95.

Clause 97. A process for manufacturing an article, the process comprising: placing a first element on a molding surface; placing the thermoplastic hot melt adhesive layer of any one of clauses 1-72 in contact with at least a portion of the first element on the molding surface; while the thermoplastic hot melt adhesive layer is in contact with the component on the molding surface, increasing a temperature of the thermoplastic hot melt adhesive layer to a temperature that is at or above an activation temperature of the thermoplastic hot melt adhesive; and subsequent to increasing the temperature of the thermoplastic hot melt adhesive, while the thermoplastic hot melt adhesive layer remains in contact with the component on the molding surface, decreasing the temperature of the thermoplastic hot melt adhesive to a temperature below the melting temperature $T_m$ of the thermoplastic hot melt adhesive; thereby bonding the layered material to the component forming a bonded component.

Clause 98. The process of any of the preceding clauses, wherein the activation temperature of the thermoplastic hot melt adhesive is a temperature at or above the Vicat softening temperature $T_{vs}$ or the melting temperature $T_m$ of the thermoplastic hot melt adhesive.

Clause 99. The process of any of the preceding clauses, wherein the activation temperature of the thermoplastic hot melt adhesive is a temperature below at least one of: 1) the creep relaxation temperature $T_{cr}$; 2) the heat deflection temperature $T_{hd}$; or 3) the Vicat softening temperature $T_{vs}$ of the hydrogel material of the layered material.

Clause 100. The process of any of the preceding clauses, wherein the first element is selected from a first shaped component, a first film, a first textile, a first yarn, and a first fiber, the first element comprises a first element material; and increasing the temperature of the thermoplastic hot melt adhesive to the temperature at or above its activation temperature includes increasing a temperature of the first element to a temperature above the melting temperature $T_m$ of the first element material.

Clause 101. A structure, comprising an article formed by the process of clauses 97-100.

Clause 102. The structure of any of the preceding clauses, wherein the article is an article of footwear, a component of footwear, an article of apparel, a component of apparel, an article of sporting equipment, or a component of sporting equipment.

Clause 103. The structure of any of the preceding clauses, wherein the article is an article of footwear.

Clause 104. The structure of any of the preceding clauses, wherein the article is an outsole component for an article of footwear.

Clause 105. The structure of any of the preceding clauses, wherein the article of footwear comprises one or more of the traction elements, wherein the traction elements are on a side of the article of footwear configured to be ground facing.

Clause 106. The structure of any of the preceding clauses, wherein the traction elements are selected from the group consisting of: a cleat, a stud, a spike, and a lug.

Clause 107. The structure of any of the preceding clauses, wherein the traction elements are integrally formed with an outsole component of the article of footwear.

Clause 108. The structure of any of the preceding clauses, wherein the traction elements are removable traction elements.

Clause 109. The structure of any of the preceding clauses, wherein the layered material is not disposed on tip of the traction element configured to be ground contacting.

Clause 110. The structure of any of the preceding clauses, wherein the layered material is disposed in an area separating the traction elements and optionally on one or more sides of the traction elements, optionally wherein the layered material (e.g., located in the midfoot region) is disposed in a region different than the traction elements (e.g., located in the toe region, the heel region, or both).

Clause 111. A component comprising: a layered material of clauses 1-67 including the externally facing layer comprising the hydrogel material and the second material comprising the thermoplastic hot melt adhesive, the layered material having an external perimeter, wherein the externally facing layer is present on at least a portion of a side of the component; and a second polymeric material affixed to the thermoplastic hot melt adhesive layer and to the external perimeter of the layered material.

Clause 112. The component of any of the preceding clauses, wherein the component is an article of footwear, a component of an article of footwear, an article of apparel, a component of an article of apparel, an article of sporting equipment, or a component of an article of sporting equipment.

Clause 113. The component of any of the preceding clauses, wherein the component is an outsole component for an article of footwear, and the externally facing layer is present on at least a portion of a side of the outsole component configured to be ground facing.

Clause 114. The component of any of the preceding clauses, wherein the outsole component comprises two or more traction elements, and the layered material is disposed in an area separating the traction elements and optionally on one or more sides of the traction elements, optionally wherein the layered material (e.g., located in the midfoot region) is disposed in a region different than the traction elements (e.g., located in the toe region, the heel region, or both).

Clause 115. A method of manufacturing a component, the method comprising: placing a layered material of clauses 1-67 including an external perimeter, the externally facing layer comprising the hydrogel material, and the second layer comprising the thermoplastic hot melt adhesive into a mold so that a portion of the externally facing layer contacts a portion of the molding surface; restraining the portion of the externally facing layer against the portion of the molding surface while flowing a second polymeric material into the mold; solidifying the second polymeric material in the mold thereby bonding the second polymeric material to the thermoplastic hot melt adhesive layer and the external perimeter of the layered material, producing the component with the portion of the externally facing layer forming an outermost layer of the component; and removing the component from the mold.

Clause 116. The method of any of the preceding clauses, wherein, during the flowing, a temperature of the second polymeric material is at or above an activation temperature of the thermoplastic hot melt adhesive.

Clause 117. The method of any of the preceding clauses, wherein, during the restraining, a temperature of the thermoplastic hot melt adhesive is at or above an activation temperature of the thermoplastic hot melt adhesive.

Clause 118. The method of any of the preceding clauses, wherein the activation temperature of the thermoplastic hot melt adhesive is a temperature at or above the Vicat softening temperature $T_{vs}$ or the melting temperature $T_m$ of the thermoplastic hot melt adhesive.

Clause 119. The method of any of the preceding clauses, wherein the activation temperature of the thermoplastic hot melt adhesive is a temperature below at least one of: 1) the creep relaxation temperature $T_{cr}$; 2) the heat deflection temperature $T_{hd}$; or 3) the Vicat softening temperature $T_{vs}$ of the hydrogel material.

Clause 120. The method of any of the preceding clauses, wherein, during the restraining and flowing, a temperature of the layered material remains at a temperature below at least one of: 1) the creep relaxation temperature $T_{cr}$; 2) the heat deflection temperature $T_{hd}$; or 3) the Vicat softening temperature $T_{vs}$ of the hydrogel material of the layered material.

Clause 121. The method of any of the preceding clauses, wherein the component is an article of footwear, a component of an article of footwear, an article of apparel, a component of an article of apparel, an article of sporting equipment, or a component of an article of sporting equipment.

Clause 122. The method of any of the preceding clauses, wherein the component is an outsole component for an article of footwear, and the externally facing layer is present on at least a portion of a side of the outsole component configured to be ground facing.

Clause 123. The method of any of the preceding clauses, wherein the outsole component comprises two or more traction elements, and the layered material is disposed in an area separating the traction elements and optionally on one or more sides of the traction elements.

Clause 124. An article of footwear, comprising: an outsole component on a side of the article of footwear, wherein the side is configured to be ground facing, wherein the outsole component comprises a layered material having an externally facing layer and a second layer opposite the externally facing layer, wherein the externally facing layer includes at least a portion of an outer surface of the article of footwear, wherein the externally facing layer comprises a hydrogel material and the second layer comprises a thermoplastic hot melt adhesive material, and wherein the article of footwear comprises one or more of the traction elements on the side of the article of footwear configured to be ground facing.

Clause 125. The article of any one of the preceding clauses, wherein the externally facing layer is disposed in an area of the article of footwear separating the traction elements and optionally on one or more sides of the traction elements, optionally wherein the traction elements are not located in the same region as the externally facing layer.

Clause 126. The article of any one of the preceding clauses, wherein the article of footwear includes a toe region, a midfoot region, and a heel region, wherein the layered material is disposed in the midfoot region and optionally not disposed in the toe region, the heel region, or both, optionally wherein the traction elements are not located in the midfoot region, optionally wherein the traction elements are located in the toe region, the heel region, or both.

Clause 127. The article of any one of the preceding clauses, wherein the layered material is not disposed on a tip of the traction element configured to be ground contacting.

Clause 128. The article of any one of the preceding clauses, wherein the traction elements are selected from the group consisting of: a cleat, a stud, a spike, and a lug.

Clause 129. The article of any one of the preceding clauses, wherein the traction elements are integrally formed with the outsole component, the traction elements are affixed to the article of footwear adjacent the outsole component, or the traction elements are removable traction elements.

Clause 130. The article of any one of the preceding clauses, wherein an upper of the article of footwear includes the layered material, and the externally facing layer forms at least a portion of an outer surface of the upper.

Clause 131. The article of any one of the preceding clauses, wherein one or more inner layers are disposed between the externally facing layer and the thermoplastic hot melt adhesive layer, wherein the inner layers are selected from a tie layer, a regrind layer, and an elastomer layer.

Clause 132. The article of any one of the preceding clauses, wherein the hydrogel material is selected from the group consisting of: a polyurethane hydrogel, a polyamide hydrogel, a polyurea hydrogel, a polyester hydrogel, a polycarbonate hydrogel, a polyetheramide hydrogel, a hydrogel formed of addition polymers of ethylenically unsaturated monomers, copolymers thereof, and combinations thereof, optionally wherein the hydrogel material includes a polyurethane hydrogel.

Clause 133. The article of any one of the preceding clauses, wherein the hydrogel material comprises a hydrogel formed of a copolymer, wherein the copolymer is a combination of two or more types of polymers within each polymer chain.

Clause 134. The article of any one of the preceding clauses, wherein the copolymer is selected from the group consisting of: a polyurethane/polyurea copolymer, a polyurethane/polyester copolymer, and a polyester/polycarbonate copolymer.

Clause 135. The article of claim 1, wherein the thermoplastic hot melt adhesive material comprises one or more thermoplastic polymers selected from the group consisting of polyesters, polyethers, polyamides, polyurethanes and polyolefins, optionally wherein the thermoplastic hot melt adhesive material comprises one or more thermoplastic polyurethanes.

Clause 136. The article of any one of the preceding clauses, wherein the thermoplastic hot melt adhesive material comprises a low processing temperature polymeric composition, wherein the low processing temperature polymeric composition exhibits a melting temperature of from about 80 degree Celsius to about 135 degree Celsius, the low processing temperature polymeric composition exhibits a glass transition temperature $T_g$ of about 50 degree Celsius or less, the low processing temperature polymeric composition exhibits a melt flow index of about 0.1 g/10 min to about 60 g/10 min at 160 degree Celsius using a test weight of 2.16 kg, the low processing temperature polymeric composition exhibits an enthalpy of melting of at least about 5 J/g, the low processing temperature polymeric composition exhibits a modulus of about 1 megaPascals to about 500 megaPascals, the low processing temperature polymeric composition withstands 5,000 cycles or more in the Cold Ross Flex test without exhibiting visible cracking or stress whitening, or a combination thereof.

Clause 137. The article of any one of the preceding clauses, wherein the tie material comprises a thermoplastic polymer, wherein the thermoplastic polymer is selected from the group consisting of polyesters, polyethers, polyamides, polyurethanes, polyolefins, and a combination thereof.

Clause 138. The article of any one of the preceding clauses, wherein the regrind layer includes a regrind material comprising two or more of the following: the hydrogel material, the thermoplastic hot melt adhesive material, an elastomer material, and a tie material.

Clause 139. A method of making an article of footwear, comprising: affixing an outsole component and a layered material to one another, thereby forming the article, wherein the layered material comprises an externally facing layer and a second layer opposite the externally facing layer, wherein the externally facing layer comprises a hydrogel material and the second layer comprises a thermoplastic hot melt adhesive material, wherein the article of footwear comprises one or more of the traction elements on the side of the article of footwear configured to be ground facing.

Clause 140. The method of any one of the preceding clauses, wherein the step of affixing includes affixing the outsole component and the layered material to each other such that an externally facing layer forms at least a portion of a side of the outsole component which is configured to be ground facing.

Clause 141. The method of any one of the preceding clauses, wherein the externally facing layer is disposed in an area separating the traction elements and optionally on one or more sides of the traction elements, optionally wherein the traction elements are not located in the same region as the externally facing layer.

Clause 142. The method of any one of the preceding clauses, wherein the article of footwear includes a toe region, a midfoot region, and a heel region, wherein the layered material is disposed in the midfoot region and optionally not disposed in the toe region, the heel region, or both, optionally wherein the traction elements are located in the toe region and the heel region, optionally wherein the traction elements are not located in the midfoot region.

Clause 143. The method of any one of the preceding clauses, wherein one or more inner layers are disposed between the externally facing layer and the second layer, wherein the inner layers are selected from a tie layer, a regrind layer, and an elastomer layer.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1 percent to about 5 percent" should be interpreted to include not only the explicitly recited concentration of about 0.1 wt percent to about 5 wt percent, but also include individual concentrations (e.g., 1 percent, 2 percent, 3 percent, and 4 percent) and the sub-ranges (e.g., 0.5 percent, 1.1 percent, 2.2 percent, 3.3 percent, and 4.4 percent) within the indicated range. In an aspect, the term "about" can include traditional rounding according to significant figures of the numerical value. In addition, the phrase "about 'x' to 'y'" includes "about 'x' to about 'y'".

Many variations and modifications may be made to the above-described aspects. All such modifications and variations are intended to be included herein within the scope of this disclosure and protected by the following claims.

What is claimed:

1. An outsole component for an article of footwear, comprising:

a layered material having an externally facing layer and a second layer opposite the externally facing layer, wherein the externally facing layer comprises a hydrogel material and the second layer comprising a thermoplastic hot melt adhesive material; and a backing plate affixed to the second layer of the layered material, wherein the backing plate comprises one or more traction elements configured to be ground-facing when the outsole component is part of an article of footwear;

wherein the externally facing layer of the layered material forms at least a portion of an outer surface of the outsole component.

2. The outsole component for an article of footwear of claim 1, wherein the externally facing layer is disposed on the backing plate in an area separating the one or more traction elements.

3. The outsole component for an article of footwear of claim 1, wherein the backing plate includes a toe region, a midfoot region, and a heel region, wherein the layered material is disposed on the midfoot region.

4. The outsole component for an article of footwear of claim 1 wherein one or more inner layers are disposed between the externally facing layer and the second layer, wherein the one or more inner layers are selected from a tie layer, a regrind layer, and an elastomer layer.

5. The outsole component for an article of footwear of claim 1, wherein the backing plate includes a toe region, a midfoot region, and a heel region, wherein the layered material is disposed on the midfoot region wherein the one or more traction elements are not located in the midfoot region, and wherein the one or more traction elements are located in the toe region, the heel region, or both.

6. The outsole component for an article of footwear of claim 1, wherein the layered material is not disposed on a tip of the one or more traction elements that are configured to be ground contacting.

7. The outsole component for an article of footwear of claim 1, wherein the one or more traction elements are selected from the group consisting of: a cleat, a stud, a spike, and a lug.

8. The outsole component for an article of footwear of claim 1, wherein the one or more traction elements are integrally formed with the backing plate or the one or more traction elements are removably attached to the backing plate.

9. The outsole component for an article of footwear of claim 1, wherein the hydrogel material is selected from the group consisting of: a polyurethane hydrogel, a polyamide hydrogel, a polyurea hydrogel, a polyester hydrogel, a polycarbonate hydrogel, a polyetheramide hydrogel, a hydrogel formed of addition polymers of ethylenically unsaturated monomers, copolymers thereof, and combinations thereof.

10. The outsole component for an article of footwear of claim 1, wherein the hydrogel material comprises a hydrogel formed of a copolymer, wherein the copolymer is a combination of two or more types of polymers within each polymer chain.

11. The outsole component for an article of footwear of claim 10, wherein the copolymer is selected from the group consisting of: a polyurethane/polyurea copolymer, a polyurethane/polyester copolymer, and a polyester/polycarbonate copolymer.

12. The outsole component for an article of footwear of claim 1, wherein the thermoplastic hot melt adhesive material comprises one or more thermoplastic polymers selected from the group consisting of polyesters, polyethers, polyamides, polyurethanes and polyolefins.

13. The outsole component for an article of footwear of claim 1, wherein the thermoplastic hot melt adhesive material comprises a polymeric composition, wherein the polymeric composition exhibits a melting temperature of from about 80 degree Celsius to about 135 degree Celsius.

14. The outsole component for an article of footwear of claim 13, wherein the tie layer includes a tie material comprising a thermoplastic polymer, wherein the thermoplastic polymer is selected from the group consisting of polyesters, polyethers, polyamides, polyurethanes, polyolefins, and a combination thereof.

15. The outsole component for an article of footwear of claim 13, wherein the regrind layer includes a regrind material comprising two or more of the following: the hydrogel material, the thermoplastic hot melt adhesive material, an elastomer material, and a tie material.

16. The outsole component for an article of footwear of claim 1, wherein the thermoplastic hot melt adhesive material comprises a polymeric composition, the polymeric composition exhibits a glass transition temperature Tg of about 50 degree Celsius or less.

17. The outsole component for an article of footwear of claim 1, wherein the thermoplastic hot melt adhesive material comprises a polymeric composition, the polymeric composition exhibits a melt flow index of about 0.1 g/10 min to about 60 g/10 min at 160 degree Celsius using a test weight of 2.16 kg.

18. The outsole component for an article of footwear of claim 1, wherein the thermoplastic hot melt adhesive material comprises a polymeric composition, the polymeric composition exhibits an enthalpy of melting of at least about 5 J/g.

19. An article of footwear comprising an upper and an outsole component according to claim 1.

* * * * *